US007284479B2

(12) United States Patent
Sato

(10) Patent No.: US 7,284,479 B2
(45) Date of Patent: Oct. 23, 2007

(54) PRINTER OPERABLE IN DUPLEX PRINT MODE

(75) Inventor: Mitsuo Sato, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 453 days.

(21) Appl. No.: 10/626,604

(22) Filed: Jul. 25, 2003

(65) Prior Publication Data

US 2005/0076798 A1 Apr. 14, 2005

(30) Foreign Application Priority Data

Jul. 26, 2002 (JP) ..... 2002-218147
Oct. 18, 2002 (JP) ..... 2002-304356
Oct. 18, 2002 (JP) ..... 2002-304381

(51) Int. Cl.
*B41L 13/04* (2006.01)
*B41L 21/00* (2006.01)
*B41L 13/06* (2006.01)

(52) U.S. Cl. ..... 101/118; 101/116; 101/120

(58) Field of Classification Search ..... 101/116, 101/118, 119, 120, 423–424, 128.1, 416.1, 101/419, 420

See application file for complete search history.

(56) References Cited

U.S. PATENT DOCUMENTS 5,148,227 A * 9/1992 Senba et al. ..... 399/349
5,207,157 A * 5/1993 Okazaki et al. ..... 101/116
5,400,065 A * 3/1995 Tomono et al. ..... 347/172
5,680,651 A * 10/1997 Tsuji et al. ..... 399/401
5,937,750 A * 8/1999 Takeda ..... 101/116
6,117,257 A * 9/2000 Takahashi et al. ..... 156/86
6,247,401 B1 6/2001 Sato et al.
6,374,730 B1 * 4/2002 Kuratani et al. ..... 101/115
6,718,872 B2 * 4/2004 Kanno ..... 101/118

FOREIGN PATENT DOCUMENTS

| | | | |
|---|---|---|---|
| JP | 5-70010 | | 3/1993 |
| JP | 9-95033 | | 4/1997 |
| JP | 410166705 | * | 6/1998 |
| JP | 2001239733 | * | 9/2001 |
| JP | 2002-103768 | | 4/2002 |
| JP | 2002172839 | * | 6/2002 |
| JP | 2002-219849 | | 8/2002 |

OTHER PUBLICATIONS

"Machine Translation of Hiroshi".*

* cited by examiner

*Primary Examiner*—Daniel J. Colilla
*Assistant Examiner*—Marissa Ferguson-Samreth
(74) *Attorney, Agent, or Firm*—Oblon, Spivak, McClelland, Maier & Neustadt, P.C.

(57) ABSTRACT

A stencil printer operable in a duplex print mode of the present invention prints an image on one side of a sheet and then prints another image on the other side of the same sheet. The printer includes at least one print drum and at least one press roller facing the print drum for pressing the sheet against the print drum. When the press roller is used to press the other side of the sheet against the print drum, the press roller is implemented as an elastic body provided with a fluorine compound layer on the surface thereof.

73 Claims, 52 Drawing Sheets

FIG. 28

| | PEAK RADIUS | PEAK ANGLE | PITCH | SMEARING | IMAGE QUALITY |
|---|---|---|---|---|---|
| A | 0.05 | 90 | 0.30 | × | ◎ |
| B | 0.03 | 120 | 0.30 | × | ◎ |
| C | 0.03 | 90 | 0.50 | ◎ | × |
| D | 0.04 | 100 | 0.40 | ○ | ○ |
| E | 0.03 | 90 | 0.30 | ◎ | ◎ |
| F | 0.00 | 90 | 0.30 | ◎ | ◎ |
| G | 0.03 | 70 | 0.30 | ◎ | ◎ |
| H | 0.03 | 90 | 0.10 | ◎ | ◎ |
| I | 0.03 | 60 | 0.30 | ◎ | ◎ |
| J | 0.03 | 90 | 0.05 | × | ◎ |

ESTIMATE RESULT SHEARING ×: CONSPICUOUS ○: NOT CONSPICUOUS ◎ ALMOST NONE
IMAGE QUALITY ×: NO GOOD ○: ACCEPTABLE ◎ GOOD

FIG. 31

| | MEAN DIAMETER | MAX. DIFFERENCE | MEAN PITCH | SMEARING | IMAGE QUALITY |
|---|---|---|---|---|---|
| A | 0.12 | 0.05 | 0.40 | × | ◎ |
| B | 0.06 | 0.12 | 0.40 | ◎ | × |
| C | 0.06 | 0.05 | 0.50 | ◎ | × |
| D | 0.10 | 0.03 | 0.15 | ○ | ○ |
| E | 0.08 | 0.05 | 0.40 | ◎ | ◎ |
| F | 0.04 | 0.05 | 0.40 | ◎ | ◎ |
| G | 0.08 | 0.10 | 0.40 | ◎ | ◎ |
| H | 0.08 | 0.05 | 0.30 | ◎ | ◎ |
| I | 0.03 | 0.05 | 0.40 | ◎ | ◎ |
| J | 0.08 | 0.02 | 0.40 | × | ◎ |
| K | 0.08 | 0.05 | 0.10 | × | ◎ |

ESTIMATION RESULT SMEARING ×: CONSPICUOUS ○ NOT CONSPICUOUS ◎ ALMOST NONE

IMAGE QUALITY ×: NO GOOD ○ ACCEPTABLE ◎ GOOD

FIG. 39

| BEAM DIAMETER (μm) | SMEARING RANK | NOTE |
|---|---|---|
| 10 | 3.25(×) | SMEARING |
| 20 | 4.50(O) | GOOD |
| 50 | 4.50(O) | GOOD |
| 100 | 4.25(O) | GOOD |
| 150 | 4.00(O) | GOOD |
| 200 | 3.75(×) | SPOTS |
| 250 | 3.50(×) | SPOTS |

※ RANK 4.00 AND ABOVE ARE OK

※ GLASS BEADS ARE USED

FIG. 40

| MATERIAL | SMEARING RANK | DURABILITY | NOTE |
|---|---|---|---|
| GLASS | 4.50(O) | O | SOME PAPER DUST |
| CERAMIC | 4.50(O) | O | SOME PAPER DUST |
| RUBBER A | 3.50(×) | △ | CRUSH & WEAR |
| RUBBER B | 4.25(O) | × | CRUSH/WEAR/FALL |
| RESIN | 4.50(O) | × | WEAR/FALL |

※ BEAD DIAMETER OF 50 μm

FIG. 42

| GRAIN SIZE | SMEARING RANK | NOTE |
|---|---|---|
| 100 | 3.25(X) | SPOTS/BREAKAGE OF THIN SHEET |
| 250 | 4.50(O) | GOOD |
| 500 | 4.50(O) | GOOD |
| 1000 | 4.25(O) | GOOD |
| 1500 | 4.00(O) | GOOD |
| 2000 | 3.75(X) | RUBBING |
| 2500 | 3.50(X) | RUBBING |

FIG. 45

| | | PEAK RADIUS R (μm) | | | NOTE |
|---|---|---|---|---|---|
| | | 25 | 50 | 100 | |
| PITCH (μm) | 10 | △ | × | × | RUBBING |
| | 20 | ○ | ○ | × | 100[μm], RUBBING |
| | 50 | ○ | ○ | × | 100[μm], RUBBING |
| | 100 | ○ | ○ | × | 100[μm], RUBBING |
| | 200 | ○ | ○ | △ | 100[μm], RUBBING |
| | 300 | ○ | ○ | △ | 100[μm], RUBBING & SPOTS |
| | 500 | × | △ | △ | 100[μm], RUBBING & SPOTS |
| | 1000 | × | × | △ | RUBBING & SPOTS |

PRINTER OPERABLE IN DUPLEX PRINT MODE

BACKGROUND OF THE INVENTION

1. Field of the Invention

The present invention relates to a printer, e.g., a stencil printer constructed to transfer ink to a sheet-like recording medium via a master or perforated stencil wrapped around a print drum. More particularly, the present invention relates to the structure of a press roller, which is included in a printer operable in a duplex print mode, for pressing a sheet against a print drum in contact with an image printed on the sheet.

2. Description of the Background Art

A digital stencil printer, extensively used today as a simple printer, includes a thermal head on which fine heating elements are arranged in an array. While a thermosensitive stencil is conveyed, the heating elements are selectively energized in accordance with image data in contact with the stencil for thereby perforating, or cutting, the stencil with heat. After the perforated stencil, i.e., a master has been wrapped around a porous print drum, a press roller or similar pressing means presses a sheet or sheet-like recording medium against the print drum with the result that ink is transferred from the print drum to the sheet via the master, printing an image on the sheet. Various conveying members joining in sheet conveyance, including rollers, belts and pressing members, are arranged on a path extending from a sheet feeding section to a sheet discharging section via a printing section, so that a sheet is conveyed while sequentially contacting such conveying members. It is to be noted that the members, joining in sheet conveyance, include both of conveying members and members that simply steer a sheet in contact therewith.

A current trend in the stencil printers art is toward duplex print mode operation that prints images on both sides of a sheet for reducing the consumption of sheets as well as a space for storage. It has been customary to produce a duplex print by feeding a sheet from a sheet feeding section via a print position to print an image on one side of the sheet, turning the resulting one-sided sheet by hand, and again feeding the one-sided sheet via the print position to print an image on the other side of the sheet. This procedure, however, forces the operator of the printer to turn the one-sided sheet and again set it in the sheet feeding section or neatly position a stack of one-sided sheets, resulting in time- and labor consuming work.

Further, because ink on the one-sided sheet, carrying an image on one or front side thereof, is still wet just after printing, the rollers and press roller disfigure the image if immediately pressed against the sheet for printing an image on the other or reverse side of the same sheet. In light of this, printing on the other side of the sheet has heretofore been effected on the elapse of several hours or more. Particularly, when the image on the front side includes a solid portion, printing on the reverse side has customarily been effected next day because it takes a longer period of time for the solid portion to be dried.

As stated above, the duplex print mode has a problem that a long drying time must be provided between printing on the front side of a sheet and printing on the reverse side of the same sheet, and a problem that the same sheet must be repeatedly passed through the print position two times. Consequently, the duplex print mode needs a net printing time two times longer than a net printing time necessary for a simplex print mode.

To solve the above problem, Japanese Patent Laid-Open Publication No. 2002-103768, for example, proposes a stencil printer operable in the duplex print mode and including a first print drum and a second print drum positioned downstream of the first print drum in the direction of sheet conveyance. First and second pressing means respectively face the first and second print drums via a sheet conveyance path. After the first pressing means has been pressed against the first print drum, the second pressing means is pressed against the second print drum, thereby producing a duplex print.

Japanese Patent Laid-Open Publication No. 9-95033, for example, discloses a stencil printer operable in a duplex print mode and using a single divided master formed with a first and a second image to be respectively transferred to one side and the other side of a sheet. In the duplex print mode, a first press roller presses a sheet against a print drum via the master wrapped around the print drum to thereby print a first image one side of a sheet. Subsequently, the resulting one-sided sheet is again fed by biasing means, so that a second press roller prints a second image on the other side of the sheet.

With either one of the prior art schemes described above, it is possible to produce a duplex print by passing a sheet only one time for thereby substantially halving the printing time necessary for duplex print mode operation to complete.

However, the problem with the schemes taught in Laid-Open Publication Nos. 2002-103768 and 9-95033 is that when an image is to be formed on the other side of a sheet carrying an image on one side thereof, ink deposited on the one side is transferred to the press roller and then transferred to the other side of the next sheet when an image is to be printed on one side of the next sheet, resulting in so-called offset. More specifically, in a stencil printer using emulsion ink, a certain drying time is necessary for ink to be fixed on a sheet. To obviate the retransfer of ink from the press roller to the reverse side of the next sheet, Japanese Patent Laid-Open Publication No. 2002-219849, for example, proposes to form fine projections on the circumference of a press roller included in a downstream printing section.

The press roller disclosed in Laid-Open Publication No. 2002-219849 may be applied to either one of the schemes taught in Laid-Open Publication Nos. 2002-103768 and 9-95033. We, however, experimentally found that when spherical grains substantially identical in shape were so arranged as to form a smooth surface, as shown in FIG. 11(B) of Laid-Open Publication No. 2002-219849, the total area of the grains to contact the image surface of a sheet was not so different from a plane, failing to contribute to the obviation of smearing ascribable to ink retransfer. Even a configuration shown in FIG. 11(C) of the above document increased the area to contact the image surface of a sheet.

While reducing the area over which the press roller contacts the image surface of a sheet may effectively obviate smearing mentioned above, this scheme makes the tips of the portions of the press roller contacting the image area sharp and causes them to penetrate the sheet or even the master via the sheet. The contact area cannot therefore be reduced beyond a certain limit.

We conducted a series of experiments to determine, when a press roller presses one surface of a sheet, carrying an image on the one surface, to print an image on the other surface in the duplex print mode, a time interval after the printing on the one surface that reduces smearing ascribable to retransferred ink. The experiments showed that smearing ascribable to retransferred ink could be almost obviated when the time interval between the printing on the one surface and the printing on the other surface was 5 seconds or more. In practice, however, the time interval should be 3 seconds or less in order to make the most of the merits of a stencil printer.

On the other hand, sheet conveying processes include one that discharges a sheet carrying an image transferred from a print drum, one that again feeds a sheet, carrying an image thereon, in order to print a multicolor image on one side of the sheet, and one that turns a sheet, carrying an image on one side thereof, and again feeds it for producing a duplex print. A sheet is therefore conveyed while sequentially contacting most of members arranged on various paths and joining in sheet conveyance. It follows that reducing the deposition of ink on the press roller or similar rotatable pressing member cannot accurately protect images from smearing.

Technologies relating to the present invention are also disclosed in, e.g., Japanese Patent Laid-Open Publication No. 5-70010.

SUMMARY OF THE INVENTION

It is an object of the present invention to provide a printer operable in a duplex print mode and capable of effectively obviating smearing ascribable to retransferred ink on a sheet conveyance path to thereby insure attractive prints.

It is another object of the present invention to provide a printer operable in a duplex print mode and saving space, insuring reliable conveyance, and adaptive high speed printing.

A printer operable in a duplex print mode of the present invention prints an image on one side of a sheet-like recording medium and then prints another image on the other side of the same recording medium. The printer includes at least one print drum and at least one press roller facing the print drum for pressing the recording medium against the print drum. When the press roller is used to press the other side of the sheet carrying an image on one side thereof against the print drum, the press roller is implemented as an elastic body provided with a fluorine compound layer on the surface thereof.

BRIEF DESCRIPTION OF THE DRAWINGS

The above and other objects, features and advantages of the present invention will become more apparent from the following detailed description taken with the accompanying drawings in which:

FIG. 28 is a table listing experimental results relating to image quality and smearing ascribable to retransferred ink in a duplex print mode;

FIG. 31 is a table listing experimental results similar to those of FIG. 28;

FIG. 39 is a table listing experimental results relating to a relation between the diameter of beads and image smearing;

FIG. 40 is a table listing experimental results relating to a relation between the material of beads and image smearing and durability;

FIG. 42 is a table listing experimental results relating to a relation between the mean size of abrasive grains and image smearing;

FIG. 45 is a table listing experimental results relating to a relation between the mean pitch of projections, the radius of curvature of the tip of the individual projection, and image smearing;

DESCRIPTION OF THE PREFERRED EMBODIMENTS

Preferred embodiments of the printer in accordance with the present invention will be described hereinafter.

First Embodiment

Figure 1:
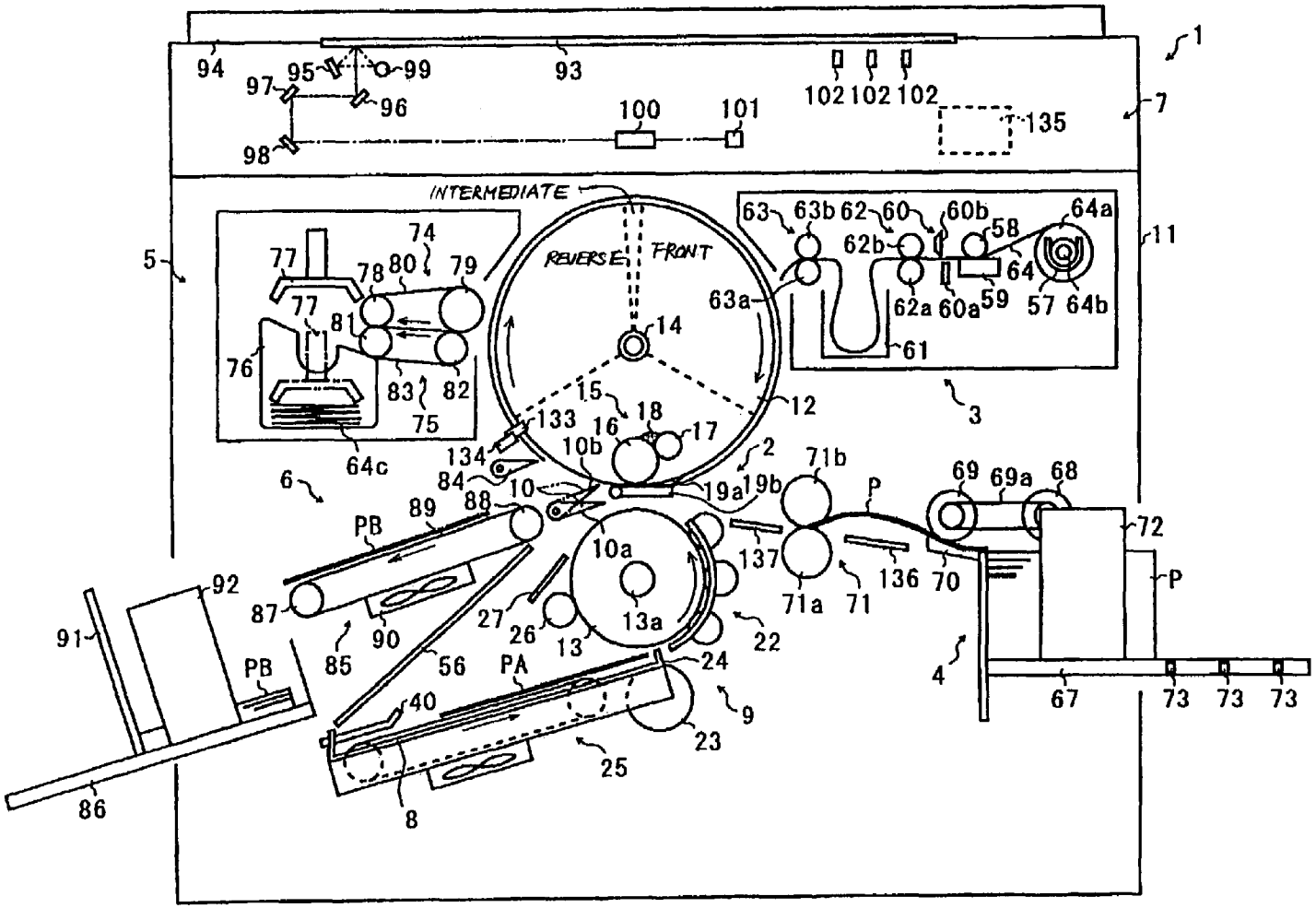
FIG. 1 is a front view showing a first embodiment of the printer operable in a duplex print mode in accordance with the present invention.

Referring to FIG. 1 of the drawings, a printer embodying operable in a duplex print mode embodying the present invention is shown and implemented as a stencil printer by way of example. As shown, the stencil printer, generally 1, is generally made up of a printing section 2, a master making section 3, a sheet feeding section 4, a master discharging section 5, a sheet discharging section 6, an image reading section 7, an auxiliary tray 8, refeeding means 9, and a path selector 10.

The printing section 2, arranged at substantially the center of a frame or printer body 11, includes a print drum 12 and a press roller 13 positioned beneath the print drum 12. The print drum 12 includes a pair of end walls rotatably supported by a shaft 14, which bifunctions as an ink feed pipe. A porous support member, not shown, is wrapped around the end walls while a mesh screen, not shown, is wrapped around the porous support member. Drum drive means 121, see FIG. 13, causes the print drum 12 to rotate. The print drum 12 is removably mounted to the frame 11. In the illustrative embodiment, the print drum 12 is so sized as to deal with sheet sizes of up to A3 in a simplex print mode.

Ink feeding means 15 is disposed in the print drum 12 and includes an ink roller 16 and a doctor roller 17 in addition to the shaft 14 mentioned above. The ink roller 16 is journalled to the end walls of the print drum 12 with its outer periphery adjoining the inner periphery of the print drum 12. Drive means, not shown, drives the ink roller 16 in the same direction as the print drum 12. Likewise, the doctor roller 17 is journalled to the end walls of the print drum 12 with its outer periphery adjoining the inner periphery of the ink roller 16. Drive means, not shown, drives the doctor roller 17 in the opposite direction to the print drum 12. The shaft 14 is formed with a plurality of small holes. Ink, fed from the shaft 14 via the small holes, stays in a wedge-shaped space between the ink roller 16 and the doctor roller 17, forming an ink well 18.

A flat stage 19*a* is formed on the outer periphery of the print drum 12 and extends in the axial direction of the print drum 12. A damper 19*b* is positioned on the stage 19*a* for clamping the leading edge of a master. Opening/closing means, not shown, causes the clamper 19*b* to open and then close when the clamper 19*b* is brought to a preselected position by the print drum 12.

Figure 2:
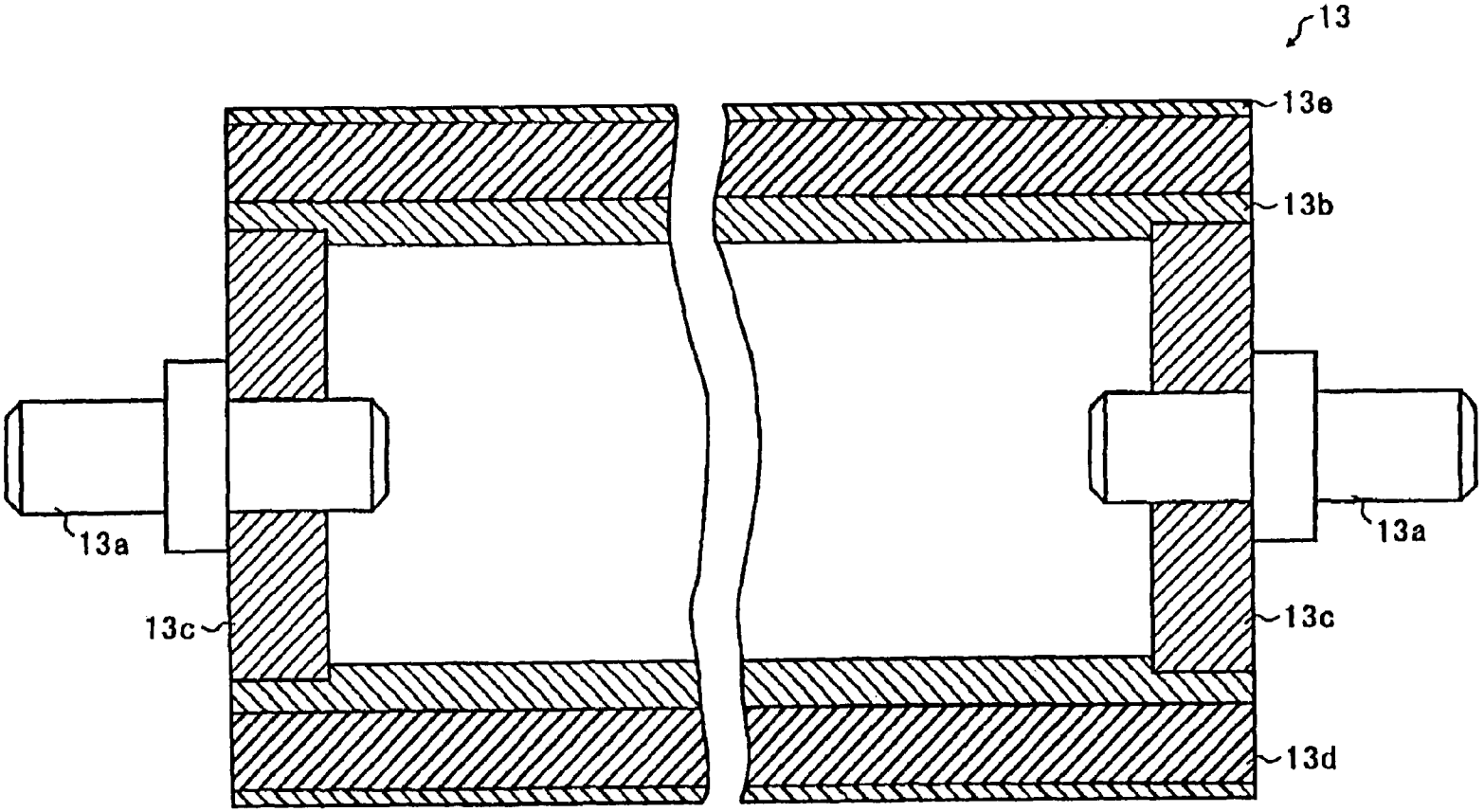
FIG. 2 is a section showing a specific configuration of a press roller included in the first embodiment.

As shown in FIG. 2 specifically, the press roller 13 includes a base made up of a hollow pipe 13*b* formed of aluminum or similar light metal, a pair of end plates 13*c* formed of light metal and mounted on opposite ends of the pipe 13*b*, and a pair of metallic core members 13*a* mounted on the end plates 13*c*. An elastic layer, which is about 5 mm to 10 mm thick, is formed on the outer periphery of the base by use of, e.g., silicone rubber. Further, a resin layer 13*e* is formed on the elastic layer 13*d* by use of a fluorine compound, constituting a fluorine compound layer. In the illustrative embodiment, the press roller 13 is provided with an outside diameter of about 70 mm and a length substantially equal to the axial length of the print drum 12.

In the illustrative embodiment, the resin layer 13*e* is implemented as a seamless film tube whose surface is smooth enough to obstruct the deposition of ink, i.e., to be readily cleaned. The resin layer 13*e* is made as thin as possible, preferably 20 μm to 50 μm, so as not to vary the hardness of the elastic layer 13*d*. The resin layer 13*e* should preferably be formed of PTFE (polytetrafluoroethylene) resin, PFA (tetrafluoroethylene-perfluoroalkylvinylether copolymer) resin or FEP (tetrafluoroethylene-hexafluoropropylene copolymer) resin. Alternatively, use may be made of, e.g., ultra-high-molecular-weight polyethylene resin.

Figure 3:
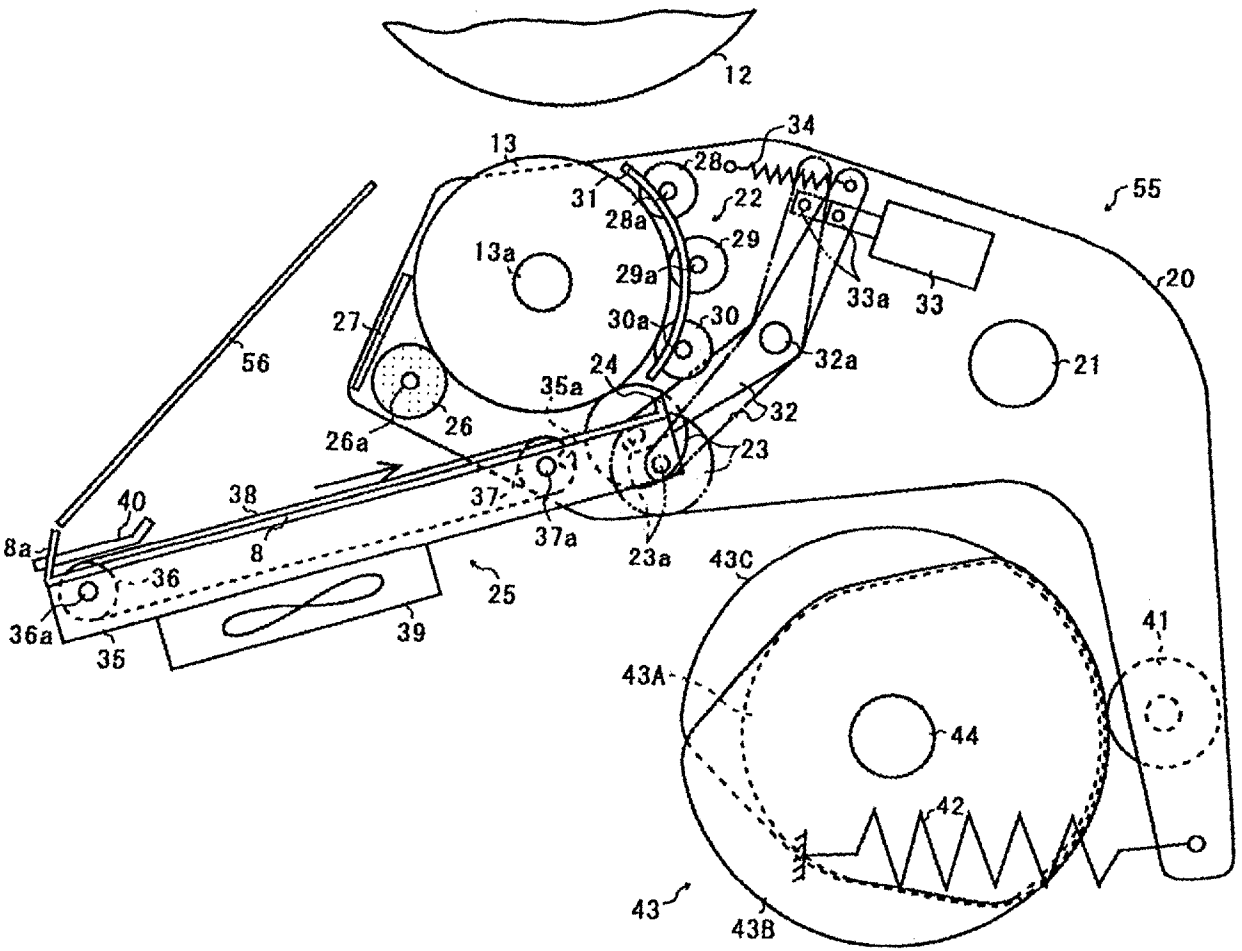
FIG. 3 is a front view showing a press roller moving mechanism included in the illustrative embodiment and the press roller released from a print drum.

As shown in FIG. 3, the core members 13*a* of the press roller 13 each are rotatably supported by one of a pair generally L-shaped of arms 20. The arms 20 are connected to each other by a shaft 21 at their bent portions while the shaft 21 is journalled to the frame 11. Arranged between the arms 20 are the press roller 13, a refeed guide 22, refeed registration roller 23, a refeed positioning member 24, a refeed conveying unit 25, a cleaning roller or cleaning means 26, and a guide 27.

The refeed guide 22, positioned at the right-hand side of the press roller 13, includes a plurality of rollers 28, 29 and 30 and a sheet guide plate 31. The rollers 28 through 30 are respectively mounted on shafts 28*a* through 30*a* and pressed against the press roller 13. The sheet guide plate 31 is curved such that a sheet or sheet-like recording member PA, carrying an image on one side thereof, moves along the circumference of the press roller 13. The shafts 28*a* through 30*a* are rotatably supported by the arms 20 at opposite ends thereof and constantly biased toward the core members 13*a* by biasing means not shown. The rollers 28 through 30 each extend over substantially the entire width of the press roller 13.

The sheet guide plate 31 is affixed to the arms 20 at opposite ends thereof and spaced from the circumference of the press roller 13 by a preselected distance smaller than the radius of each of the rollers 28 through 30. The sheet guide plate 31 is provided with curvature whose center coincides with the core members 13*a*. A plurality of holes are formed in the sheet guide plate 31 to allow the rollers 28 through 30 to contact the press roller 13.

The refeed registration roller 23, positioned below the press roller 13, is rotatably mounted on a shaft 23*a*, which is journalled to one end of a pair of bent arms 32. The arms 32 are angularly movably supported by a shaft 32*a*, which is affixed to the arms 20, at their bent portions and positioned such that the arms 32 do not interfere with the roller 30 during angular movement.

A solenoid 33 is mounted on one of the arms 20 via a bracket not shown. A tension spring 34 is anchored at one end thereof to one of the arms 20 and constantly biases the arm 32 counterclockwise, as viewed in FIG. 3, about the shaft 32*a*. A plunger 33*a*, protruding from the solenoid 33, and the other end of the tension spring 34 are connected to the arm 32. When the solenoid 33 is energized, the refeed registration roller 23 is pressed against the press roller 13 by preselected pressure, as indicated by a solid line in FIG. 3. When the solenoid 33 is deenergized, the refeed registration roller 23 is released from the press roller 13 under the action of the tension spring 34 to a position indicated by a dash-and-dots line in FIG. 3.

The refeed conveying unit 25, arranged below the press roller 13, includes a unit body 35, a drive roller 36, a driven roller 37, an endless belt 38, and a suction fan 39. The auxiliary tray 8 is positioned on and constructed integrally with the top of the refeed conveying unit 25.

The unit body 35 is implemented as a top-open box having a width slightly smaller than the distance between the arms 20. A drive shaft 36*a* and a driven shaft 37*a* are rotatably supported by respective bearings mounted on the unit body 35 at the upstream side and downstream side, respectively, in the direction of sheet conveyance. The drive shaft 36*a* extends throughout opposite side walls of the unit body 35 and has opposite ends thereof rotatably supported by bearings, not shown, mounted on the frame 11. A drive motor 122, see FIG. 13, mounted on the frame 11 causes the drive shaft 36*a* to rotate via a drive gear, not shown, mounted on one end of the drive shaft 36*a*. Opposite ends of the driven shaft 37*a* do not extend throughout the side walls of the unit body 35.

Bosses 35*a* are formed on the outer surfaces of the side walls of the unit body 35 at the upstream end in the direction of sheet conveyance, and each is received in a slot formed in the individual arm 20. In this configuration, when a press roller moving mechanism 55, which will be described later, moves the press roller 13 into or out of contact with the print drum 12, the unit body 35 is angularly moved about the drive shaft 36*a* in accordance with the movement of the arms 20.

Roller segments, constituting the drive roller 36, are mounted on the drive shaft 36*a* at preselected intervals. Likewise, roller segments, constituting the driven roller 37, are mounted on the driven shaft 37*a* at the same intervals as the roller segments of the drive roller 36. The endless belt 38 is implemented as belt segments each being passed over one of the drive roller segments and one of the driven roller segments associated with each other under preselected tension. The endless belt 38, implemented as a frictional resistance member, is caused to move in a direction indicated by an arrow in FIG. 3 by the drive motor 122 via the drive shaft 36*a*.

Figure 4:
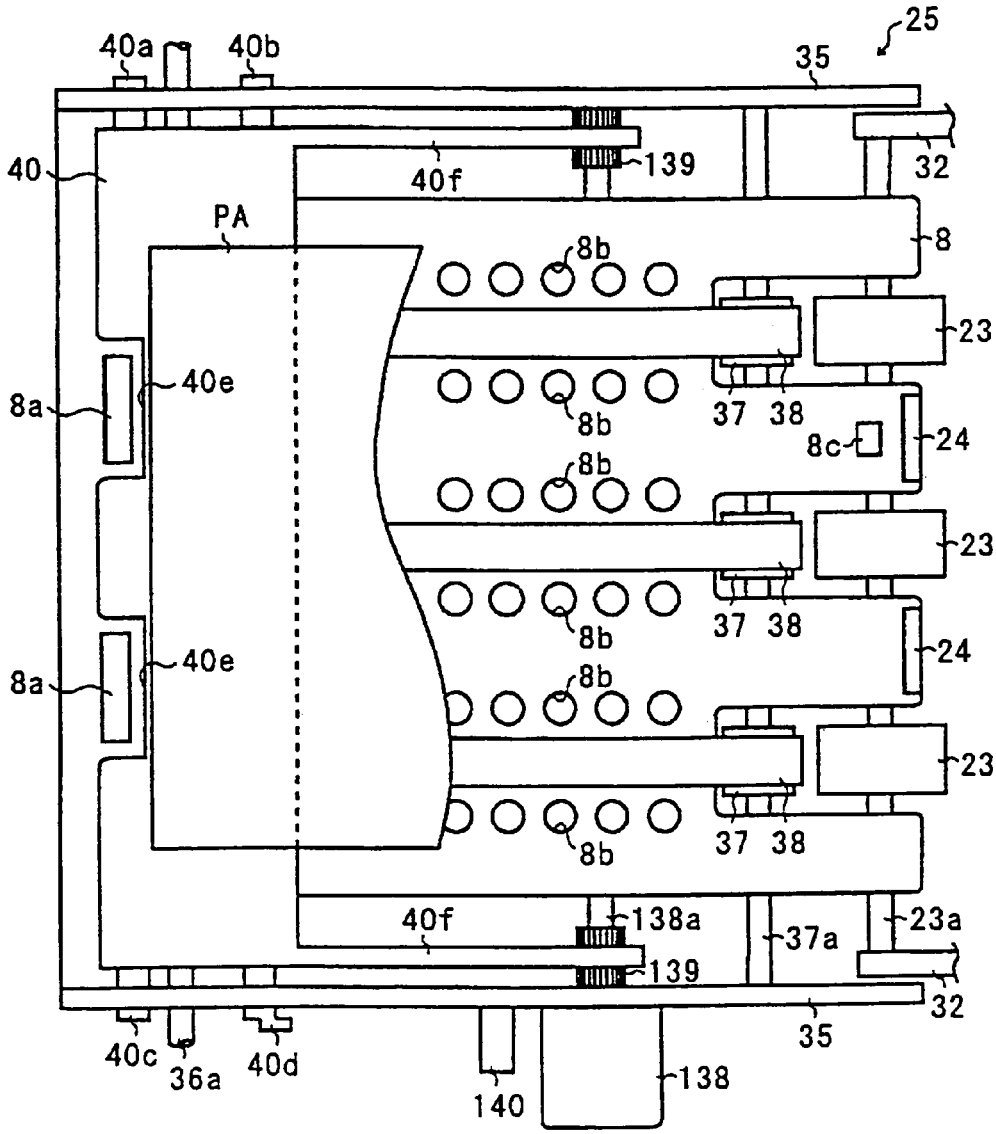
FIG. 4 is a plan view showing a refeed conveying unit and a sheet receiving plate included in the illustrative embodiment.

The suction fan 39 and auxiliary tray 8 are mounted on the top and bottom of the unit body 35, respectively. The auxiliary tray 8 is configured such that the rollers 36 and 36 partly face a sheet conveying surface. As shown in FIG. 4, a plurality of holes 8*b* are formed in the auxiliary tray 8 at both sides of each belt segment 38. Two end fences 8*a* are positioned on the downstream end of the auxiliary tray 8 in the direction sheet conveyance so as to stop one edge of the sheet PA, which is fed from the printing section 2 and carries an image on one side thereof (one-sided sheet PA hereinafter).

The refeed positioning member 24 is positioned on the upstream end of the auxiliary tray 8 in the direction of sheet conveyance in order to temporarily stop the other edge of the one-sided sheet PA at a preselected position before the sheet PA is again fed to the printing section 2. In the illustrative embodiment, two refeed positioning members 24 are formed integrally with the auxiliary tray 8. A sensor 8*c* is mounted on the auxiliary tray 8 for sensing the other edge of the one-sided sheet PA approached the refeed positioning member 24. On sensing the other edge of the one-sided sheet PA, the sensor 8*c* sends a signal to control means 129, which will be described specifically later.

The bottom of the unit body 35 on which the suction fan 39 is mounted is formed with a hole portion, not shown, so that the suction fan 39 generates negative pressure in the unit body 35 via the hole portion. As a result, the one-sided sheet PA is retained on the tops of the belt segments 38 being moved. The suction of the suction fan 39 and the frictional resistance of the belt segments 38 are selected such that when the other end of the one-sided sheet PA abuts against the refeed positioning member 24, the sheet PA and belt segments 38 slip on each other.

The auxiliary tray 8, refeed guide 22, refeed registration roller 23, refeed positioning member 24 and refeed conveying unit 25 constitute the refeeding means 9. The refeeding means 9 additionally includes a generally U-shaped sheet receiving plate 40 shown in FIGS. 1, 3 and 4.

As shown in FIG. 4, the sheet receiving plate 40 is formed with lugs 40*a*, 40*b*, 40*c* and 40*d* on opposite side walls thereof. The lugs 40*a* through 40*d* each are received in a particular slot, not shown, formed in each side wall of the unit body 35. Notches 40*e* are formed in one end of the sheet receiving plate 40 and configured to receive the end fences 8*a*. Rack portions 40*f* extend from opposite side edges of the sheet receiving plate 40 toward the other end. The sheet receiving plate 40 is spaced above the belt segments 38 by a preselected distance that allows the belt segments 38 to smoothly convey the one-sided sheet PA.

A stepping motor 138 is mounted on the outer surface of one side wall of the unit body 35 and includes an output shaft 138*a* on which two pinions 139 are mounted. The end of the output shaft 138*a* is journalled to the other side wall of the unit body 35. The pinions 139 each are meshed with one of the rack portions 40*f*.

A home position sensor 140 is located in the vicinity of the stepping motor 138 in order to sense the sheet receiving plate 40 held at a home position. More specifically, the home position sensor 140 is so positioned as to sense the lug 40*d* and sends its output signal to the control means 129.

Figure 5:
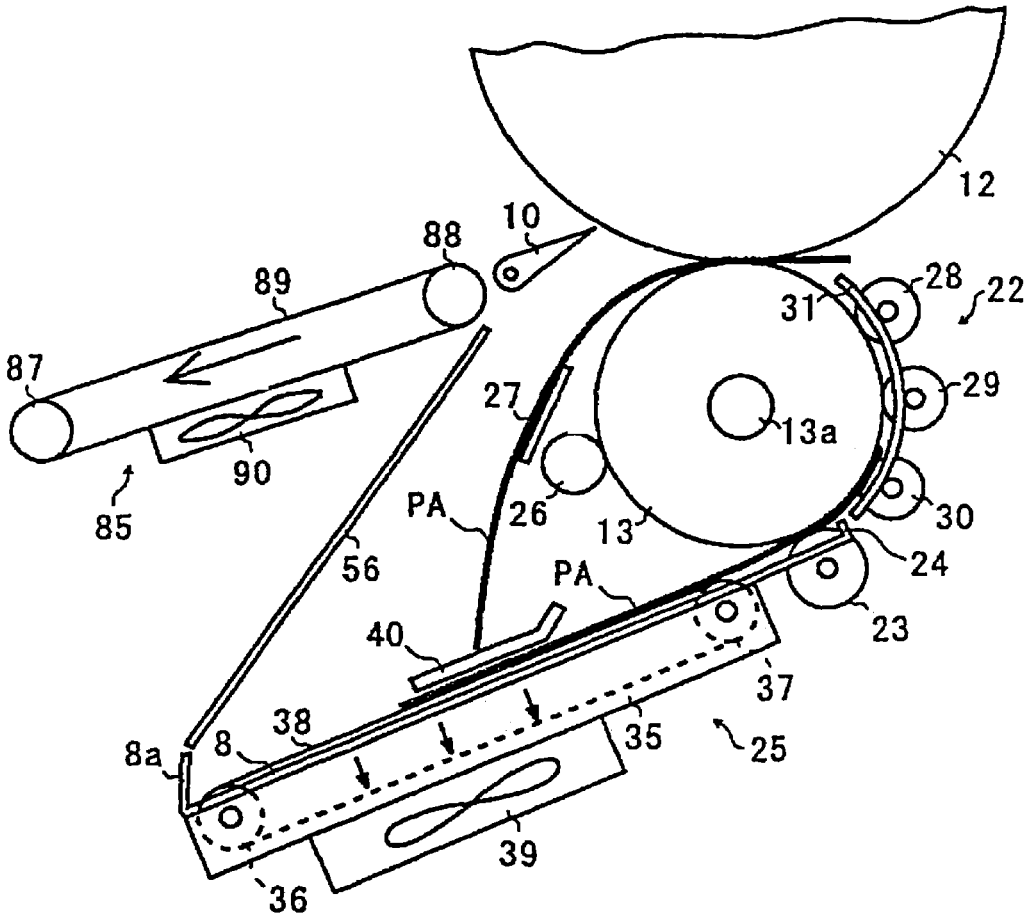
FIGS. 5 and 6 are fragmentary views of a printing section included in the illustrative embodiment, showing the behavior of a sheet or sheet-like recording medium in a continues print mode.
Figure 6:
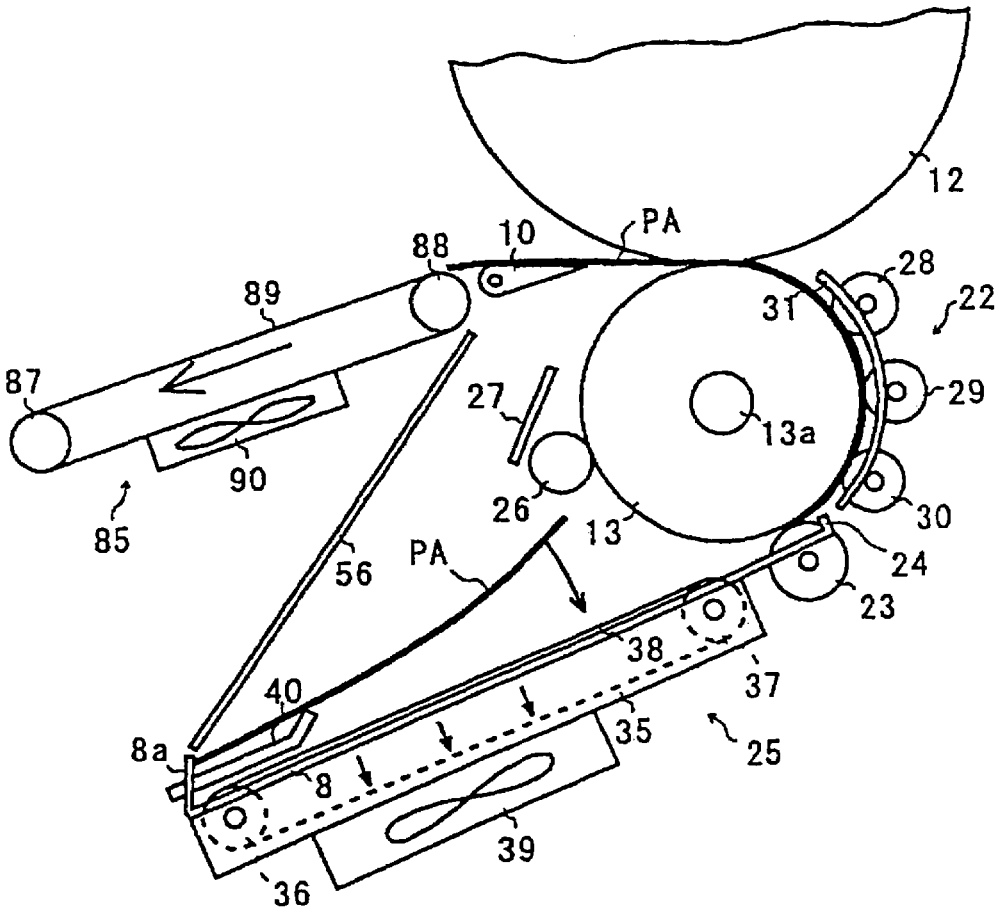

FIGS. 5 and 6 respectively show a first position or home position and a second position between which the sheet receiving plate 40 is movable by being driven by the stepping motor 138. In the first position, the sheet receiving plate 40 is closest to the press roller 13 and receives one edge of the one-sided sheet PA fed from the printing section 2. In the second position, the sheet receiving plate 40 is remotest from the press roller 13 and causes the other edge of the one-sided sheet PA positioned on the plate 40 to contact the belt segments 38.

The length of the sheet receiving plate 40 in the direction of sheet conveyance is selected such that when the plate 40 is brought to the second position, the other edge of the one-sided sheet PA on the plate 40 drops onto the belt segments 38, and such that when the other edge of the sheet PA, being conveyed by the refeed conveying unit 25 abuts against the refeed positioning member 24, one end of the sheet PA drops from the plate 40 held at the second position.

The cleaning roller 26, positioned above the refeed conveying unit 25 in the vicinity of the press roller 13, wipes off ink from the surface of the press roller 13 and has substantially the same width as the press roller 13. As shown in FIG. 3, the cleaning roller 26 includes a core 26*a* rotatably received in slots, not shown, formed in the arms 20. Biasing means, not shown, are received in the above slots and constantly bias the cleaning roller 26 toward the press roller 13, so that the cleaning roller 26 is constantly pressed against the press roller 13*c* by preselected pressure of about 1 N to 3 N.

Drive means, not shown, mounted on one arm 20 causes the cleaning roller 26 to rotate in the same direction as the press roller 13 when the press roller 13 is in rotation, but at a peripheral speed which is about one-tenth of the peripheral speed of the press roller 13. Although such a difference in peripheral speed may implement the expected cleaning effect even when the cleaning roller 26 is rotated in the opposite direction to the press roller 26, the cleaning effect is more enhanced when the former is rotated in the same direction as the latter. The cleaning roller 26 and drive means assigned thereto constitute cleaning means.

At least the surface of the cleaning roller 26 is formed of a porous material, e.g., sponge, Japanese paper, highly moisture-absorptive foam rubber, foam synthetic resin, non-woven fabric, felt or a cleaner sheet. Alternatively, use may be made of felt or a cleaner sheet impregnated with oil or a cleaning liquid, in which case the cleaning roller 26 must be rotated at a speed lower than the press roller 13 in contact with the press roller 13 in order to enhance the cleaning effect.

Figure 7:
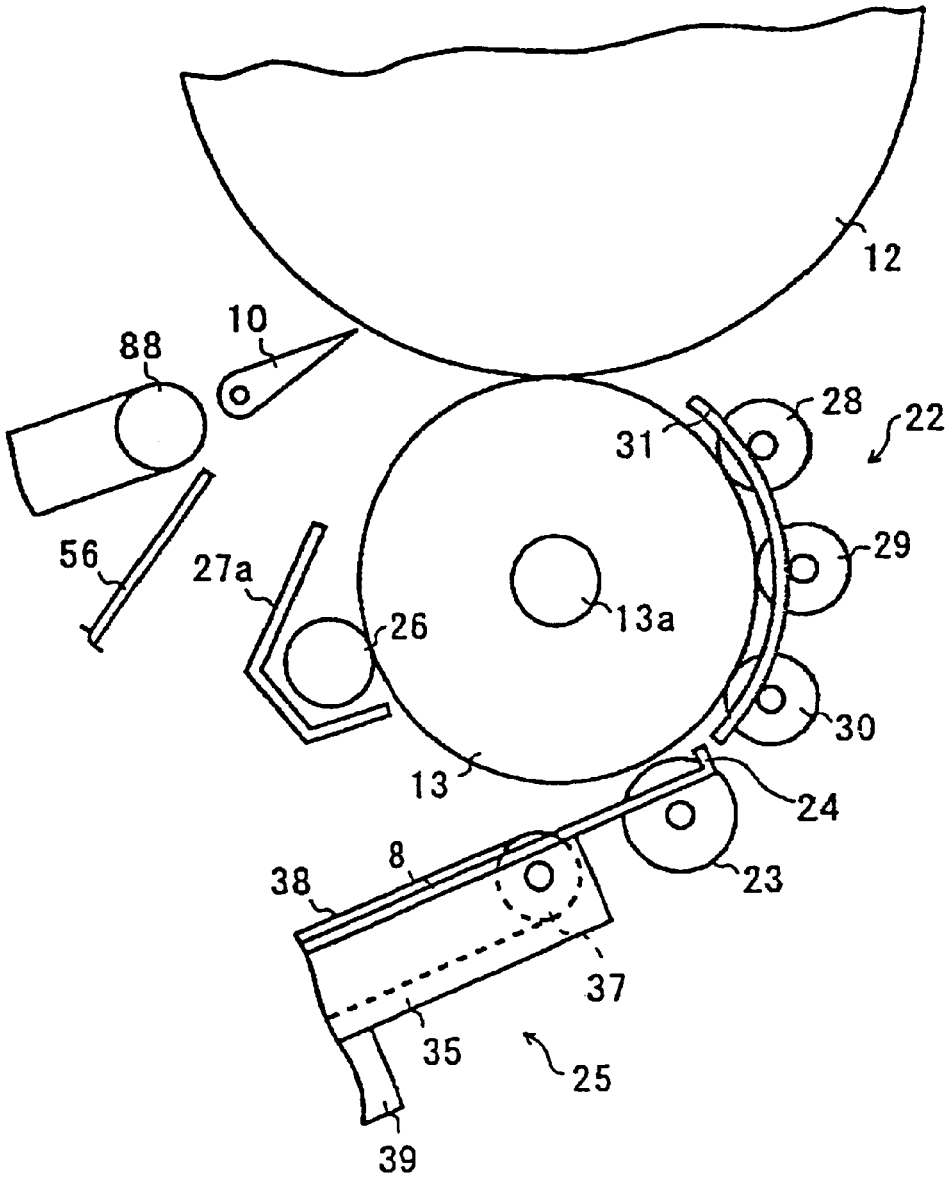
FIG. 7 is a view showing a guide representative of a modification of the illustrative embodiment.

The flat guide 27 is positioned above the cleaning roller 26 and affixed to the arms 20 at opposite ends thereof. The guide 27 guides the one-sided sheet PA fed from the printing section 2 such that the sheet PA moves toward the auxiliary tray 8 without contacting the cleaning roller 26. The guide 27 adjoins the press roller 13 and cleaning roller 26. FIG. 7 shows an alternative guide 27*a* configured to prevent the one-sided sheet PA from contacting the cleaning roller 26 when the sheet PA is again fed by the refeeding means 9 as well. By roller the cleaning roller 26 to wipe off ink from the press roller 13, it is possible to surely prevent ink from being transferred from the press roller 13 to a sheet P or the one-sided sheet PA for thereby insuring desirable prints.

Rotatable cam followers 41 are mounted on the other ends of the arms 20 remote from the press roller 13, and each protrudes outward from the associated arm 20. A print pressure spring 42 is anchored to the frame 11 at one end and anchored to part of each arm 20 adjoining the cam follower 41 at the other end. In this condition, the arms 20 are constantly biased clockwise, as viewed in FIG. 3, about the shaft 21.

Figure 8:
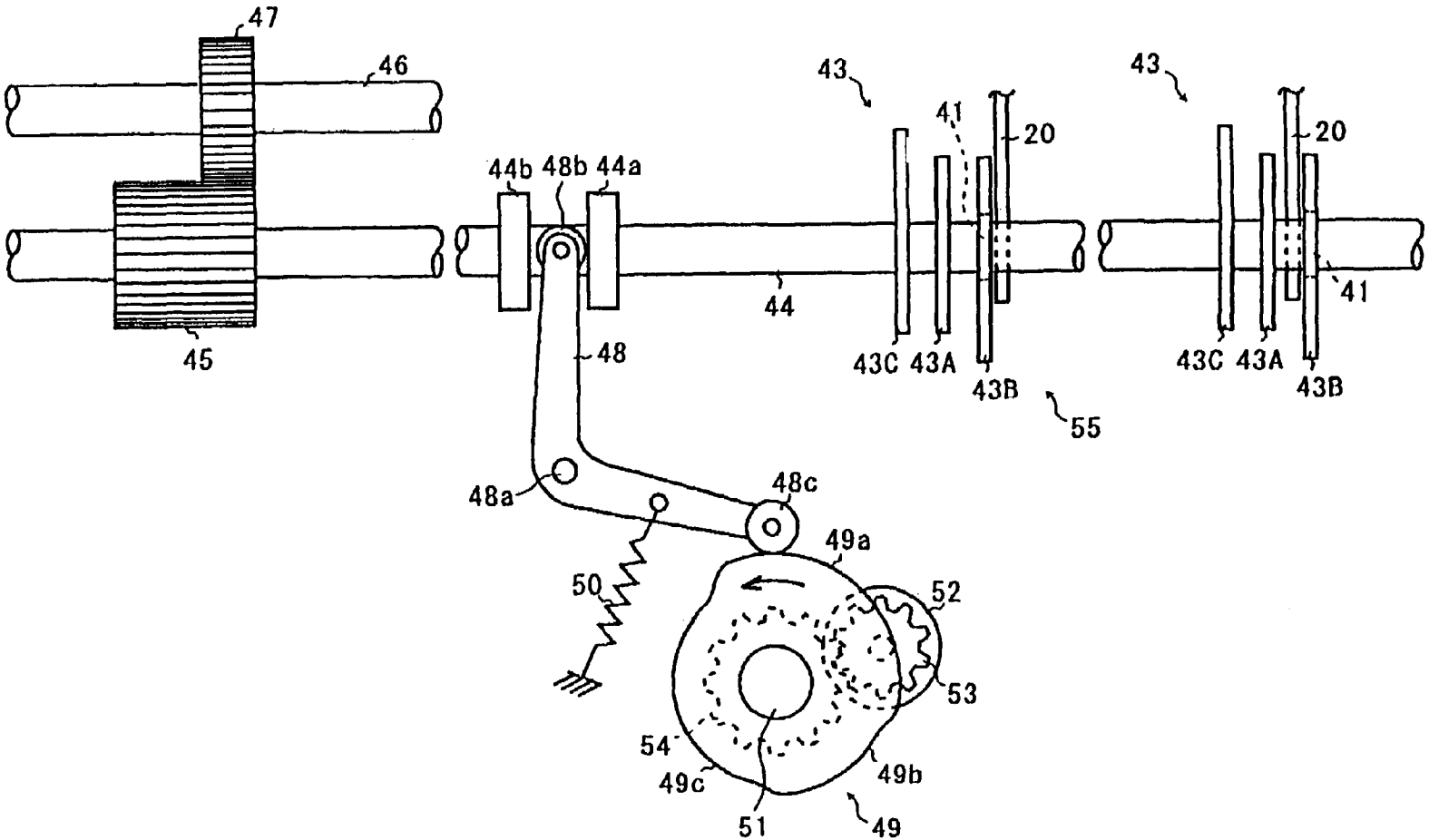
FIG. 8 is a side elevation showing the press roller moving mechanism.

A cam 43, having three cam plates 43A, 43B and 43C, is positioned at the left-hand side of each cam follower 41. The cam plates 43A through 43C are sequentially positioned in this order, as named from the front side of the frame 11, and mounted on a cam shaft 44 journalled to the frame 11. The cam shaft 44 is movable in the direction perpendicular to the sheet surface of FIG. 3. The cam plates 43A through 43C, arranged at equal intervals, each is made up of a disk or base portion coaxial with the cam shaft 44 and a projection. The projections of the cam plates 43A through 43C have the same height. As shown in FIG. 8, drum drive means 121 causes the cam shaft 44 to rotate clockwise, as viewed in FIG. 3, via a gear 47 mounted on a shaft 46 journalled to the frame 11 and a drive gear 45 mounted on the cam shaft 44.

Figure 9:
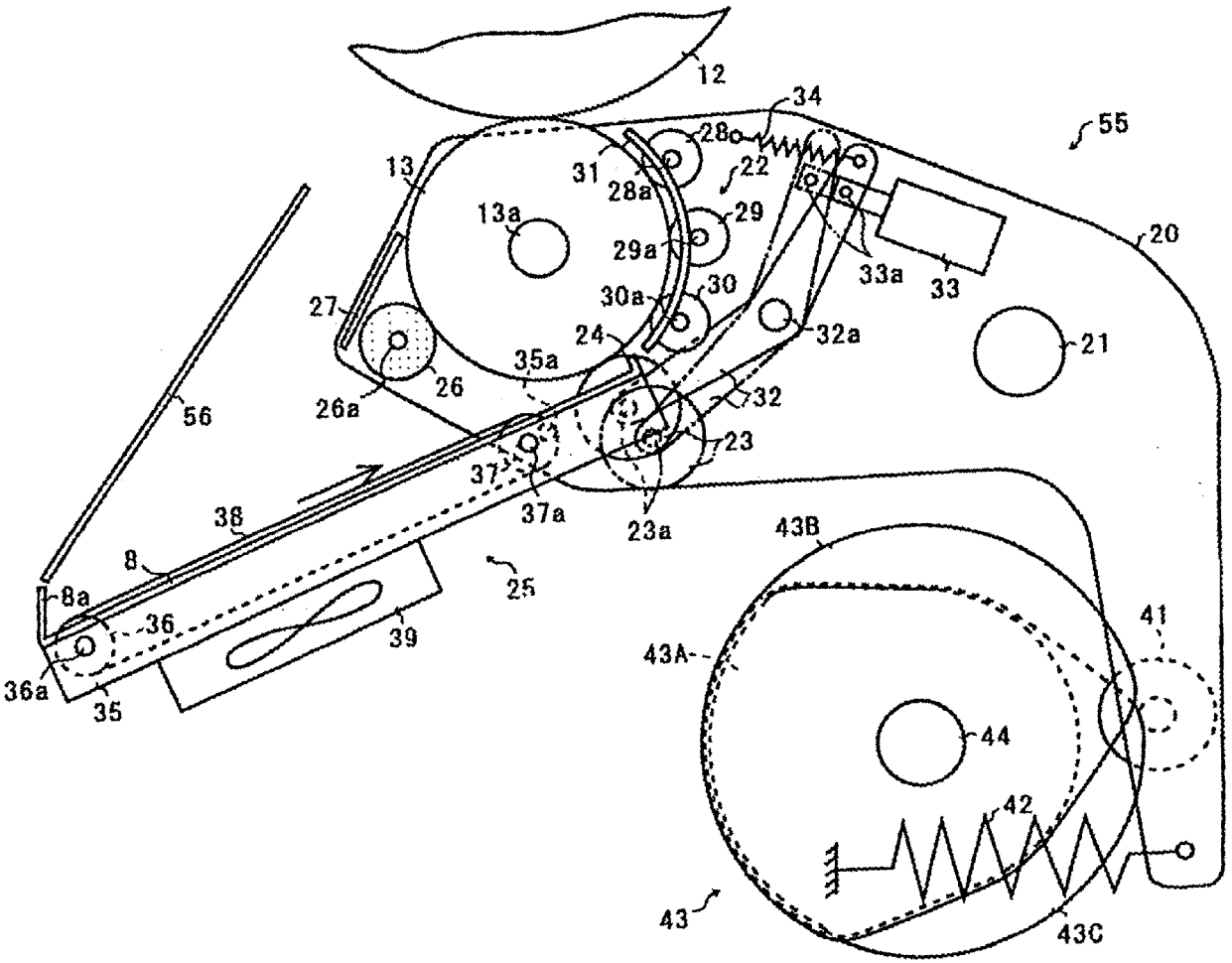
FIG. 9 is a front view showing the press roller moving mechanism and the press roller pressed against the print drum.

When the projection of any one of the cam plates 43A through 43C contacts the cam follower 41, the press roller 13 is released from the print drum 12, as shown in FIG. 3. When the above projection is released from the cam follower 41, the press roller 13 is brought into contact with the print drum 12 under the action of the print pressure springs 42, as shown in FIG. 9. The cam plates 43A through 43C each are configured such that when the press roller 13 is pressed against the print drum 12, the base portion does not contact the cam follower 41.

The projection of the cam plate 43A is so configured as to cause the press roller 13 to contact the print drum 12 over a range including all of a front zone, an intermediate zone and a reverse zone shown in FIG. 1. The projection of the cam plate 43B is so configured as to limit the above range to the surface zone while the projection of the cam plate 43C is so configured as to limit the range to the downstream portion of the front zone, intermediate zone and reverse zone. The distance between the cam plates 43A through 43C is selected to be sufficiently greater than the thickness of each arm 20.

Press roller locking means, not shown, adjoins the right edges of the arms 20, as viewed in FIG. 3, and inhibits the arms 20 from angularly moving when the press roller 13 is released from the print drum 12. More specifically, the press roller locking means includes a solenoid, not shown, that selectively locks or unlocks the arms 20 when turned on or turned off, respectively. The solenoid is turned on when the cam follower 41 is held in contact with anyone of the cam plates 43A through 43C.

As shown in FIG. 8, a generally L-shaped arm 48 and a stepped cam 49 are positioned below the cam shaft 44. The arm 48 is supported by a shaft 48*a*, which is journalled to the frame 11, at its bent portion. A roller 48*b* and a cam follower 48*c* are mounted on opposite ends of the arm 48. A tension spring 50 is anchored at one end to the frame 11 and at the other end to the arm 48 between the cam follower 48*c* and the shaft 48*a*, constantly biasing the arm 48 clockwise, as viewed in FIG. 8, about the shaft 48*a*. The roller 48*b* is positioned between disks 44*a* and 44*b* mounted on the intermediate portion of the cam shaft 44 and spaced from each other. The cam follower 48*c* is held in contact with the periphery of the stepped cam 49 by the tension spring 50.

The stepped cam 49 is mounted on a shaft 51 journalled to the frame 11 and has three cam portions 49*a*, 49*b* and 49*c*. A gear 54 is mounted on the shaft 51 and held in mesh with a gear 53 mounted on the output shaft of a stepping motor 52, which is mounted on the frame 11. The stepping motor 52 causes the stepped cam 49 to rotate in a direction indicated by an arrow in FIG. 8. As a result, the stepped cam 49 causes the arm 48 to angularly move about the shaft 48*a*, so that the roller 48*b* pushes the disk 44*a* or 44*b* to thereby move the cam shaft 44 in the right-and-left direction in FIG. 8. More specifically, the cam portions 49*a* through 49*c* are configured such that the cam plate 43B, 43A or 43C contacts the cam follower 41 when the cam portion 49*a*, 49*b* or 49*c*, respectively, contacts the cam follower 48*c*.

The cam follower 41, print pressure spring 42, cam 43, press roller locking means, arm 48 and stepped cam 49 constitute the press roller moving mechanism 55. The press roller moving mechanism 55 causes the press roller 13 to move between the released position shown in FIG. 3 and the contact position shown in FIG. 9.

The path selector 10 is positioned on a conveyance path assigned to the sheet P at the left-hand side of the contact position of the print drum 12 and press roller 13. The path selector 10, substantially identical in width as the print drum 12 and press roller 13, is mounted on a shaft journalled to the frame 11 at its downstream end in the direction of sheet conveyance. A solenoid 123, see FIG. 13, selectively moves the sharp, upstream end of the path selector 10 to either one of a first and a second position indicated by a solid line and a dash-and-dots line, respectively, in FIG. 1.

In the first position, the edge of the path selector 10 adjoins the surface of the press roller 13, but does not interfere with the clamper 19*b* on the print drum 12. In the second position, the edge of the path selector 10 adjoins the surface of the print drum 12. More specifically, in the first position, the path selector 10 steers the one-sided sheet PA moved away from the nip between the print drum 12 and the press roller 13 toward the sheet discharging section 6. In the second position, the path selector 10 steers the above one-sided sheet PA toward the auxiliary tray 8 via the path between the guides 27 and 26.

Figure 10:
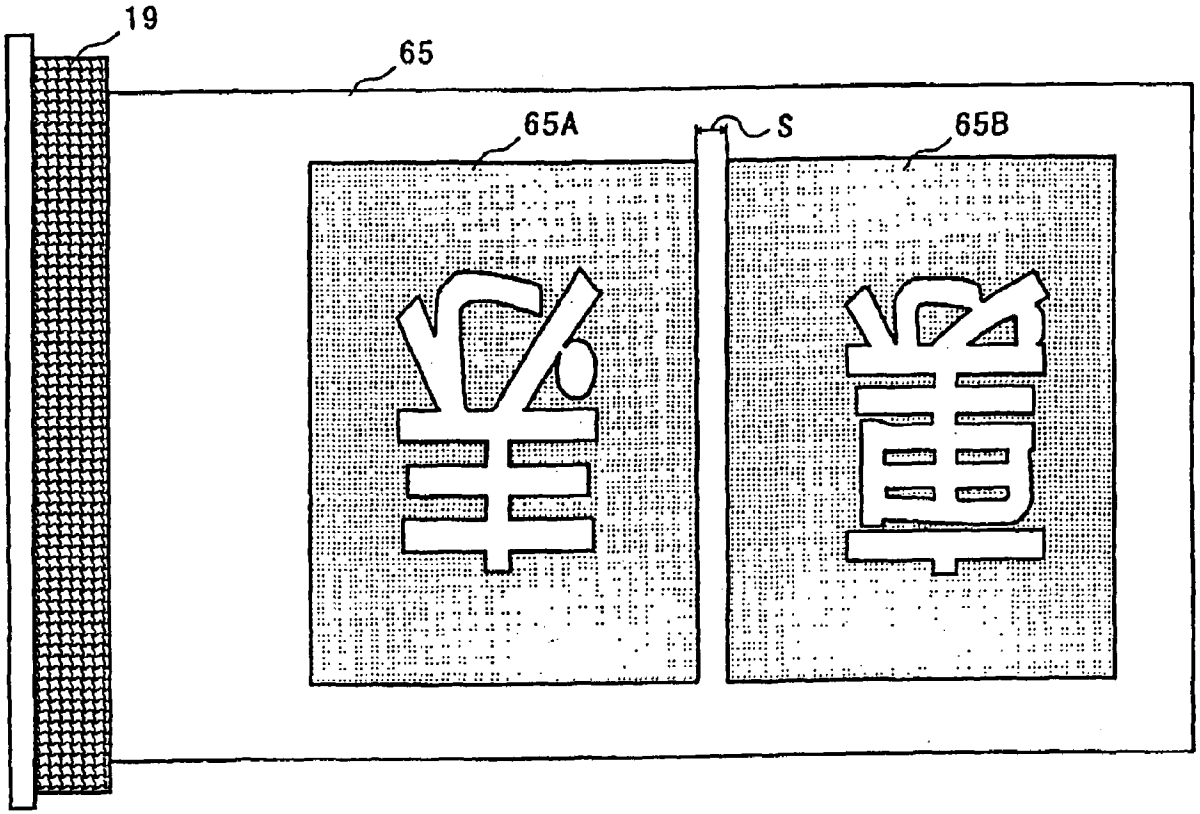
FIGS. 10 and 11 each show a particular, specific master available with the illustrative embodiment.
Figure 11:
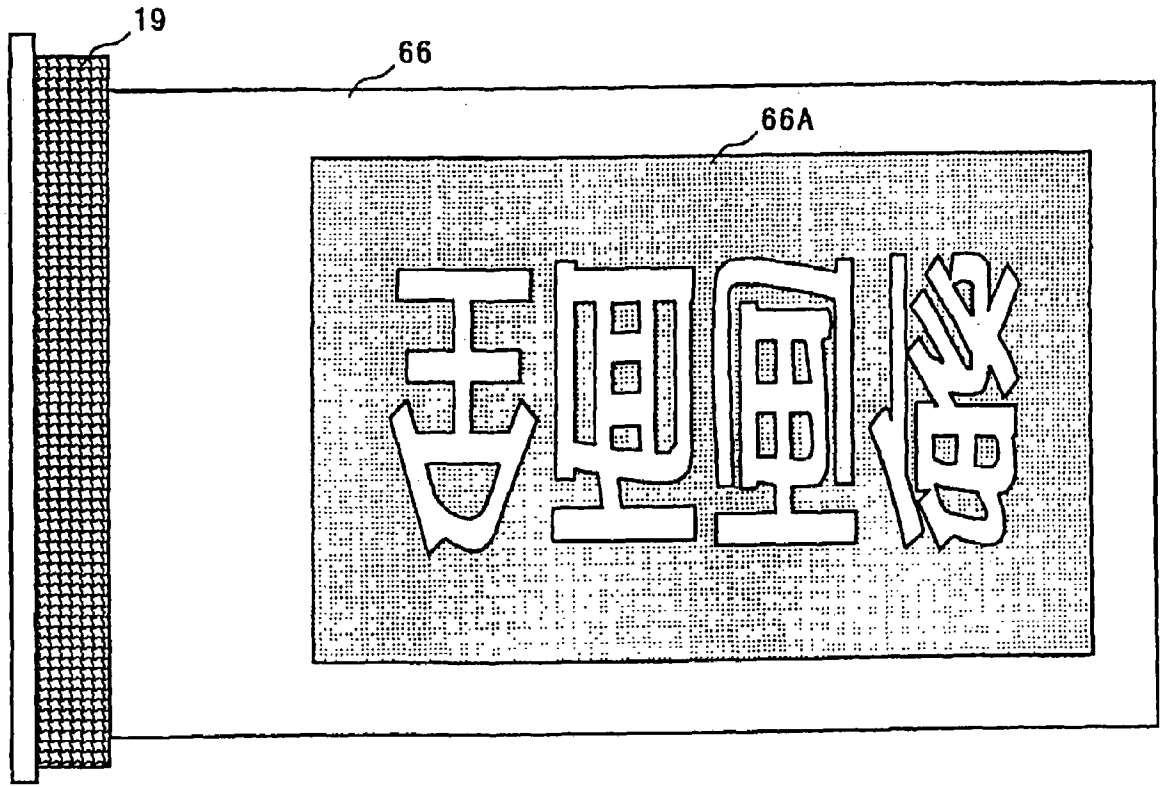

Referring again to FIG. 1, the master making section 3, arranged in the upper right portion of the frame 11, includes a stencil holder 57, a platen roller 58, a thermal head 59, cutting means 60, a master stocking portion 61, a tension roller pair 62, and a reverse roller pair 63. The master making section 3 perforates, or cuts, a stencil 64 for making a master. FIGS. 10 and 11 respectively show a specific divided master 65 and a specific non-divided master 66 that can be selectively produced by the master making section 3. The divided master 65 has a first and a second perforated image 65A and 65B divided from each other while the non-divided master 66 has a third perforated image 66A covering the total area of the first and second images 65A and 65B. When the divided master 65 is wrapped around the print drum 12, the first and second images 65A and 65B are respectively positioned in the front zone and reverse zone of the print drum 12 shown in FIG. 1.

The master holder 57 is mounted on a pair of side walls included in the master making section 3. The stencil 64 is made up of a thermoplastic resin film and a porous base adhered together and is implemented as a roll 64*a* including a core 64*b*. The core 64*b* is rotatably, removably supported by the master holder 57 at opposite ends thereof.

Figure 13:
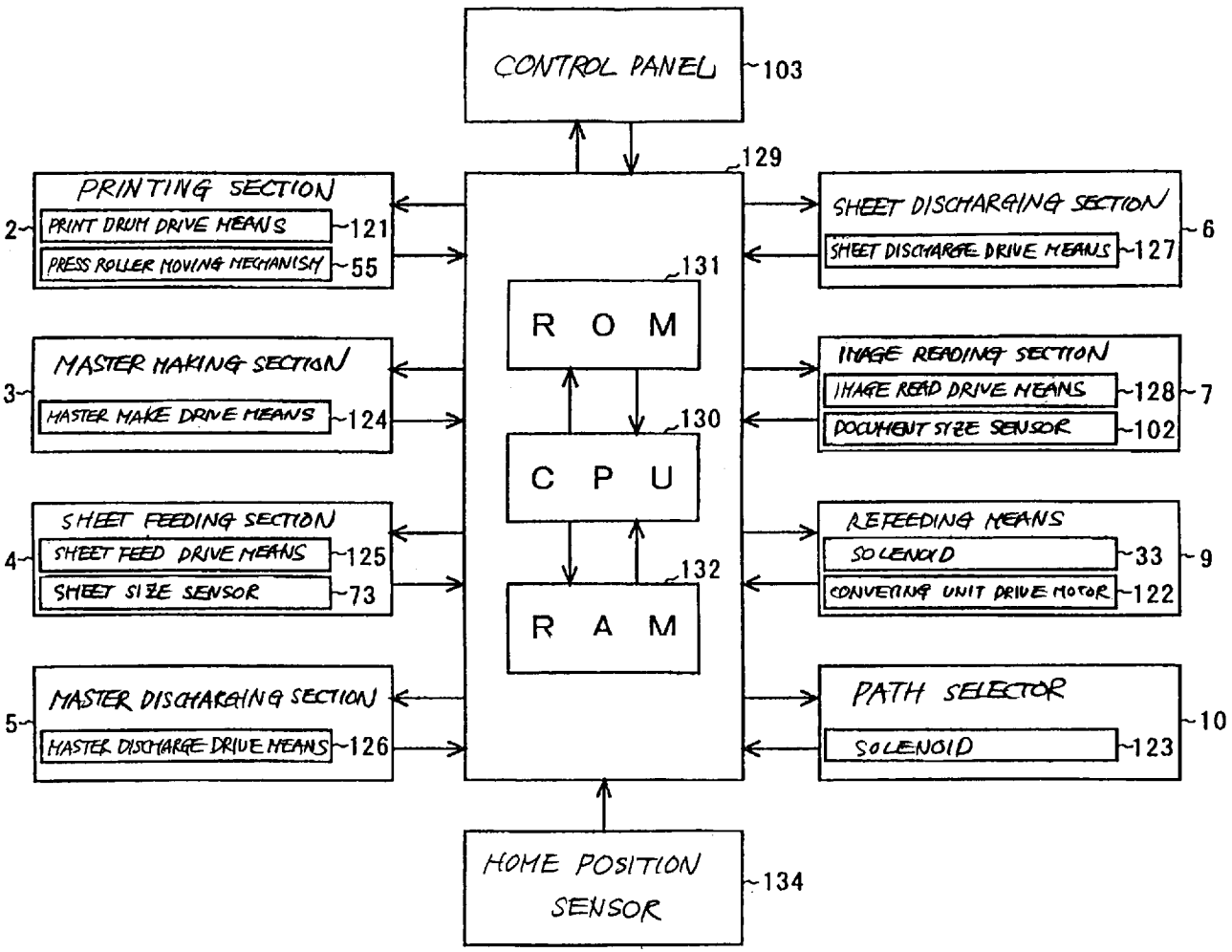
FIG. 13 is a block diagram schematically showing a control system included in the illustrative embodiment.

The platen roller 58, positioned at the left-hand side of the master holder 57, is journalled to the side walls of the master making section 3 and rotated by master making drive means 124, see FIG. 13, including a stepping motor. The thermal head 59, positioned below the platen roller 58, includes a number of heating elements and is also mounted on the above side walls. Biasing means, not shown, constantly biases the thermal head 59 against the platen roller 58. In this condition, the heating elements of the thermal head 59 are selectively energized in accordance with image data to thereby perforate the thermoplastic film surface of the stencil 64 with heat.

The cutting means 60, positioned at the left-hand side of the platen roller 58 and thermal head 59, includes a stationary edge 60*a* affixed to the side walls of the master making section 3 and a movable edge 60*b* movable relative to the stationary edge 60*a*. The two edges 60*a* and 60*b* cooperate to cut the stencil 64 with the conventional configuration.

The master stocking section 61, positioned below and downstream of the cutting means 60 in the direction of master conveyance, forms a space for temporarily storing the divided master 65, FIG. 10, or the non-divided master 66, FIG. 11, in the form of a loop. The master stocking section 61 is partitioned by a plurality of plates. A suction fan, not shown, is positioned at the deepest portion of the master stocking section 61. The suction fan generates negative pressure in the master stocking section 61, which is a hermetically closed space, so that the divided master 65 or the non-divided master 66 being conveyed is introduced into the master stocking section 61.

The tension roller pair 62, intervening between the cutting means 60 and the master stocking section 61, comprises a drive roller 62*a* and a driven roller 62*b* journalled to the side walls of the master making section 3. Biasing means, not shown, constantly biases the driven roller 62*b* toward the drive roller 62*a*. The drive roller 62*a*, driven by the master making drive means 124, conveys the stencil or master 64 in cooperation with the driven roller 62*b*. The drive roller 62*a* is driven at a slightly higher peripheral speed than the platen roller 58 and includes a torque limiter, so that preselected tension acts on the master 64 between the platen roller 58 and the tension roller pair 62.

The reverse roller pair 63, positioned downstream of the master stocking section 61 in the direction of master conveyance, comprises a drive roller 63*a* and a driven roller 63*b* journalled to the side walls of the master making section 3. The drive roller 63*a*, driven by the master making drive section 124, conveys the master 64 in cooperation with the driven roller 63*b*, which is pressed against the drive roller 63*a* by biasing means not shown. A one-way clutch, not shown, is included in the drive roller 63*a*.

A movable master guide, not shown, is positioned between the tension roller pair 62 and the reverse roller pair 63 and angularly movably supported by a support member not shown. A solenoid, not shown, selectively moves the master guide between a position where the top of the master guide forms part of a master path and a position where it does not obstruct the entry of the master 64 into the master stocking section 61.

The sheet feeding section 4 is arranged below the master making section 3 and includes a sheet tray 67 loaded with a stack of sheets P, a pickup roller 68, a reverse roller 69, a pad 70, and a registration roller pair 71. Sheet feed drive means 125, see FIG. 13, causes the sheet tray 67 to move upward or downward with elevating means. The sheet tray 67 is so sized as to allow sheets P of size A3 to be stacked thereon in a profile position. A pair of side fences 72 are mounted on the sheet tray 67 in such a manner as to be movable toward and away from each other along rails, not shown, in the direction of sheet width perpendicular to the direction of sheet conveyance. A sheet size sensor 73 is positioned on the free end of the sheet tray 67 for sensing the size of the sheets P stacked on the sheet tray 67.

The pickup roller 68, having a surface implemented by a high frictional resistance member, is rotatably supported by a bracket, not shown, angularly movably supported by the frame 11. When the elevating means of the sheet feed drive means 125 raises the sheet tray 67, the pickup roller 68 is pressed against the top of the sheet stack P. The pickup roller 68 is driven by the sheet feed driving means 125.

The reverse roller 69 and pad 70, also having surfaces implemented by high frictional resistance members, are positioned at the left-hand side of the pickup roller 68. The reverse roller 69 is operatively connected to the pickup roller 68 by a timing belt 69*a* and rotated in the same direction as the pickup roller 68 when the pickup roller 68 is driven. The pad 70 is constantly pressed against the reverse roller 69 by biasing means not shown.

The registration roller pair 71, positioned at the left-hand side of the reverse roller 69 and pad 70, comprises a drive roller 71*a* and a driven roller 71*b*. The output torque of the print drum drive means 121 is transferred to the drive roller 71*a* via drive transmitting means, not shown, including gears and a cam, causing the drive roller 71*a* to rotate in synchronism with the print drum 12. The drive roller 71*a* therefore conveys the sheet P toward the printing section 2 at preselected timing in cooperation with the driven roller 71*b* pressed against the drive roller 71*a*.

Guides 136 and 137 are respectively positioned on the sheet path upstream and downstream of the registration roller pair 71 for guiding the sheet P being conveyed from the sheet feeding section 4 toward the printing section 2. The guides 136 and 137 are affixed to opposite side walls, not shown, included in the frame 11.

The master discharging section 5, positioned above and at the left-hand side of the printing section 2, includes an upper and a lower discharge member 74 and 75, a waste master box 76, and a compressor 77. In the upper discharge member 74, an endless belt 80 is passed over a drive roller 78 and a driven roller 79. The drive roller 78 is rotated clockwise, as viewed in FIG. 1, by master discharge drive means 126, see FIG. 13, causing the belt 80 to turn in a direction indicated by an arrow in FIG. 1. Likewise, in the lower discharge member 75, an endless belt 83 is passed over a drive roller 81 and a driven roller 82. The output torque of the master discharge drive means 126 is transferred to the drive roller 81 via drive transmitting means, so that the belt 83 turns in a direction indicated by an arrow in FIG. 1. Moving means, not shown, included in the master discharge drive means 126 selectively moves the lower discharge member 75 between a position shown in FIG. 1 and a position where part of the belt 83 passed over the driven roller 82 contacts the print drum 12.

The waste master box 76 is removably mounted to the frame 11. The compressor 77 compresses a used master 64*c* conveyed by the upper and lower discharge members 74 and 75 into the waste master box 76 downward. Elevating means, not shown, included in the master discharge drive means 126 causes the compressor 77 to move in the up-and-down direction.

The sheet discharging section 5, arranged below the master discharging section 5, includes a peeler 84, a sheet discharge conveying unit 85, and a print tray 86. The peeler 84 is implemented as a plurality of peeler segments arranged in the widthwise direction of the print drum 12 and mounted on a shaft, which is angularly movably supported by the frame 11. Peeler drive means, not shown, selectively moves the peeler 84 via the shaft between a position where the edge of the peeler 84 adjoins the surface of the print drum 12 and a position where it is spaced from the above surface so as not to interfere with, e.g., the clamper 19*b*. The peeler drive means is driven by the print drum drive means 121 in such a manner as to angularly move the peeler 84 in synchronism with the rotation of the print drum 12.

The sheet discharge conveying unit 85, positioned below the peeler 84 at the left-hand side of the path selector 10, includes a drive roller 87, a driven roller 88, an endless belt 89, and a suction fan 90. The drive roller 87 is implemented as a plurality of roller segments mounted on a shaft, not shown, journalled to opposite side walls included in the conveying unit 85. These roller segments are rotated together by sheet discharge drive means 127, see FIG. 13. The driven roller 88 is also implemented as a plurality of roller segments mounted on a shaft, not shown, journalled to the above side walls and positioned at the same intervals as the drive roller segments. The endless belt 87 comprises a plurality of belts 89 each being passed over one drive roller 87 and one driven roller 88 associated with each other. The suction fan 90 is positioned below the drive roller 87, driven roller 88 and belt 89. The conveying unit 85 conveys a printed sheet PB in a direction indicated by an arrow in FIG. 1 while retaining it on the belt 89 with the suction of the suction fan 90.

The print tray 86 for stacking consecutive printed sheets PB includes a single end fence 91 and a pair of side fences 92. The end fence 91 and side fences 92 are respectively movable in the direction of sheet conveyance and the direction of sheet width.

The image reading section 7, positioned in the upper portion of the frame 11, includes a glass platen 93, a cover plate 94 hinged to be movable toward and away from the glass platen 93, mirrors 95, 96, 97 and 98, a fluorescent lamp 99, a lens 100, a CCD (Charge Coupled Device) or similar image sensor 101, a plurality of sheet size sensors 102, and an image memory 135 capable of storing image data read. The image reading section 7 reads a document laid on the glass platen 93 by being driven by read drive means 128, see FIG. 13.

As shown in FIG. 1, a dog 133 is mounted on the outer surface of one end wall of the print drum 12 while a home position sensor 134 is mounted on the frame 11 in the vicinity of the print drum 12. When the print drum 12 moves to a position where the clamper 19*b* faces the press roller 13, the home position sensor 134 senses the dog 133 and sends a signal to the control means 129.

Figure 12:
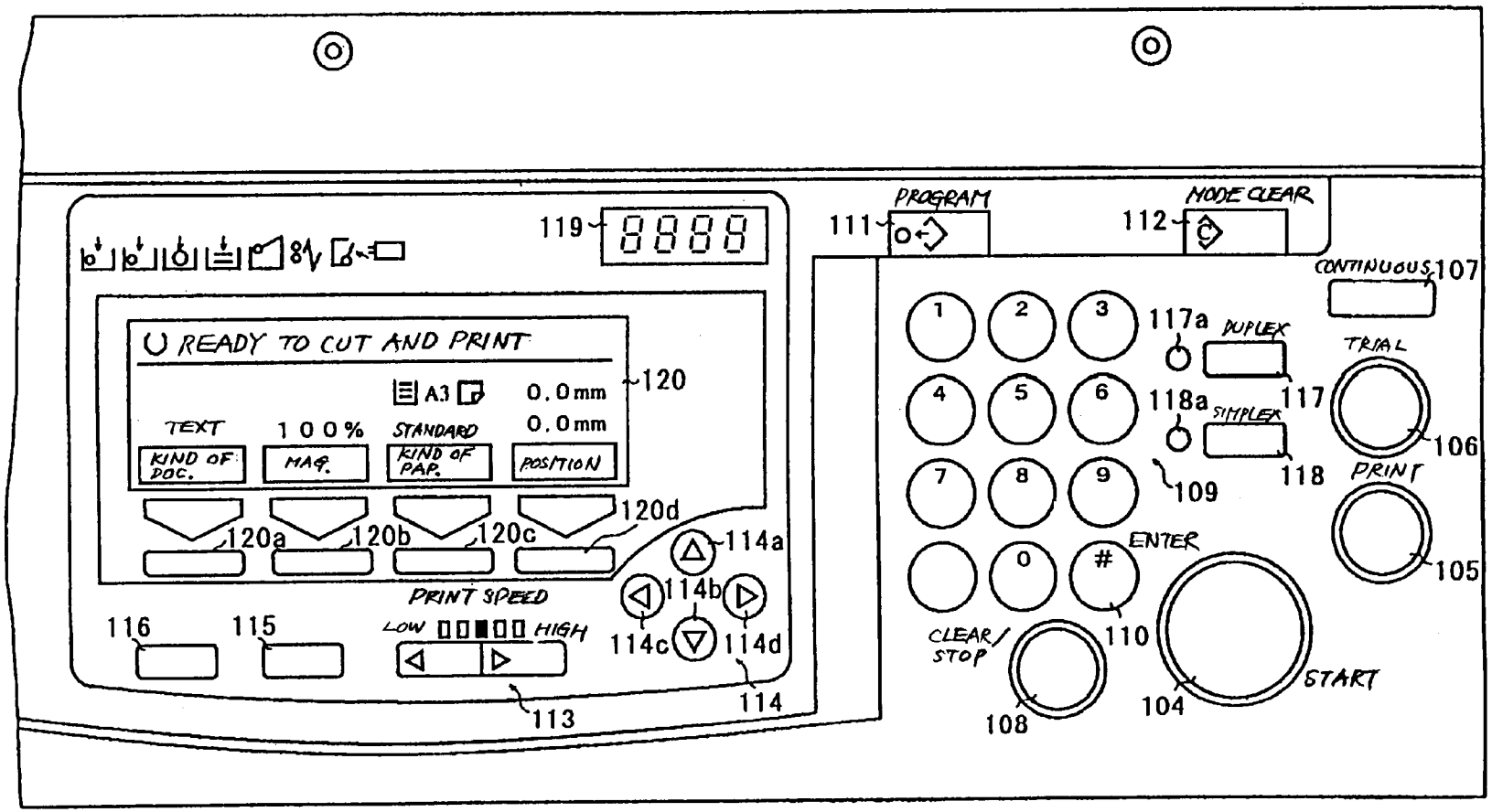
FIG. 12 shows a specific configuration of a control panel included in the illustrative embodiment.

FIG. 12 shows a specific configuration of a control panel 103 mounted on the top front portion of the frame 11. As shown, the control panel 103 includes a cut start key 104, a print start key 105, a trial print key 106, a continue key 107, a clear/stop key 108, ten keys 109, an enter key 110, a program key 111, a mode clear key 112, print speed keys 113, direction keys 114, a sheet size key 115, a thickness key 116, a duplex print key 117, a simplex print key 118, an indicator 119 implemented by seven-segment LEDs (Light Emitting Diodes), and a display 120 implemented by an LCD (Liquid Crystal Display) panel.

When the operator of the printer presses the cut start key 104, a master making operation is effected after a master discharging operation and a document reading operation. The master making operation is followed by an operation for closely adhering a master on the print drum 12, causing the printer 1 to wait in a stand-by condition. When the print start key 105 is pressed in the stand-by condition after various printing conditions have been selected, the printer 1 starts printing an image on the sheet. When the trial print key 106 is pressed after various conditions have been selected, a single trial print is produced. When the continue key 107 is pressed after various printing conditions have been input, but before the cut start key 104 is pressed, the printing operation is effected just after the master making, document reading and cutting operations.

The clear/stop key 108 is pressed to stop the operation of the printer 1 or to clear a numerical value entered on the ten keys 109. The enter key 110 is used to set, e.g., the numerical value input while the program key 111 is used to register or call operations to be frequently performed. The mode clear key 112 is used to clear various modes to thereby establish the initial statuses. The print speed keys 113 are selected pressed before printing in order to increase the printing speed when a relatively dark image is desired or when temperature around the printer 1 is low or decrease the printing speed in the opposite situation. The direction keys 114 comprise an up key 114*a*, a down key 114*b*, a left key 114 and a right key 114*d* and available for editing purposes.

The sheet size key 115 may be used to input a desired sheet size; the sheet size input on the sheet size key 115 has priority over the sheet size sensed by the sheet size sensor 73. The thickness key 116 is available for inputting the thickness of the sheet P before duplex printing. In the illustrative embodiment, any one of "ordinary sheet", "thin sheet" and "thick sheet" may be input on the thickness key 116.

When the operator, desiring a duplex print mode, presses the duplex print key 117 before the cut start key 104, an LED 117*a* adjoining the key 117 turns on to show the operator that a duplex print mode is established. When the duplex print key 117 is pressed, the operation of the cut start key 104 is rejected unless the thickness of the sheet P is input on the thickness key 116. On the other hand, when the operator, desiring a simplex print mode, presses the simplex print key 118 before the cut start key 104, an LED 118*a* adjoining the key 118 turns on to shown the operator that a simplex print mode is established. In the initial condition of the printer 1, the LED 118*a* turns on, i.e., the simplex mode is selected.

The indicator 119 mainly displays a numerical value representative of, e.g., a desired number of prints. The monitor 120 has a hierarchical display structure. By touching any one of select keys 120*a* through 120*d* positioned below the monitor 120, the operator is capable of selecting a magnification change mode, a position control mode or similar mode and input desired information in each mode. The display 120 displays the status of the printer 1, e.g., "Ready to print." as shown in FIG. 12 specifically as well as a master jam, a print jam, sheet jam and a replenish command relating to sheets, a stencil or ink.

FIG. 13 shows a control system included in the illustrative embodiment. As shown, the control means 129 mentioned earlier is implemented as a microcomputer disposed in the frame 11 and including a CPU (Central processing Unit) 130, a ROM (Read Only Memory) 131 and a RAM (Random Access Memory) 132 as usual.

Various signals output from the control panel 103 and the output signals of various sensors mounted on the frame 1 are sent to the control means 129. The CPU 130 controls, in accordance with the above signals and a program called from the ROM 131, the entire printer 1, i.e., the drive means included in the printing section 2, master making section 3, sheet feeding section 4, master discharging section 5, sheet discharging section 6 and image reading section 7 as well as the solenoid 33, conveying unit drive motor 122 and path selector 10 included in the refeeding means 9. The RAM 132 serves as a work area for the CPU 130. Further, the control means 129 grasps the angular position of the print drum 12 in accordance with the output of an encoder, not shown, included in the print drum drive means 121.

In operation, the operator of the printer 1 stacks sheets P on the sheet tray 67, opens the cover plate 94 to lay a desired document on the glass platen 93, and again closes the cover plate 94. Subsequently, after inputting various master making conditions on the keys of the control panel 103, the operator presses the duplex print key 117 or the simplex print key 118 and then presses the cut start key 104.

Assume that the operator presses the simplex print key 118. Then, after confirming the turn-on of the LED 118*a*, the operator presses the cut start key 104. The sheet size sensor 73 and document size sensor 102 send their outputs representative of a sheet size and a document size, respectively, to the control means 129. The control means 129 compares the two input signals and immediately starts an image reading operation if the sheet size and document size are the same. If the sheet size and document size are different from each other, then the control means 129 displays the difference on the monitor 120 for thereby alerting the operator. Alternatively, when the sheet size and document size are different, the control means 129 may automatically enlarge or reduce the magnification so as to match the two sizes.

When the operator presses the cut start key 104, the image reading section 7 reads the document laid on the glass platen 93. More specifically, while the lamp 99 illuminates the document, the resulting imagewise reflection from the document is incident to the image sensor 101 via the mirrors 95 through 98 and lens 100 and photoelectrically transduced thereby. An electric signal thus output from the image sensor 101 is input to an analog-to-digital converter included in the frame 11 and then written to the image memory 135 in the form of digital image data.

In parallel with the image reading operation, the master discharging section 5 removes a used master from the print drum 12. More specifically, when the cut start key 104 is pressed, the print drum 12 starts rotating. When the home position sensor 134 senses the dog 133 of the print drum 12 brought to the home position shown in FIG. 1, the sensor 134 sends a home position signal to the control means 129. In response, the control means 129 starts counting pulses output from the encoder mentioned earlier. Subsequently, on determining that the leading edge of the used master on the print drum 12 has reached a preselected position corresponding to part of the belt 83 passed over the driven roller 82, the control means 129 causes the print drum drive means 121 to stop operating.

When the print drum drive means 121 stops operating, as stated above, the print drum drive means 121 and master discharge drive means 126 operate to rotate the drive rollers 78 and 81 and shift the lower discharge member 75 toward the print drum 12 until the belt 83 contacts the used master 64*c*. As a result, the used master 64*c* is lifted by the rotation of the drum 12 and the movement of the belt 83 away from the print drum 12 and then peeled off by the lower discharge member 75 and upper discharge member 74. The used master 64*c* thus peeled off is introduced into the waste master box 76 and then compressed by the compressor 77.

Even after the used master 64*c* has been fully peeled off, the print drum 12 is continuously rotated until the clamper 19*b* arrives at a preselected stand-by position located at the upper right portion. On the stop of the print drum 12, the opening/closing means causes the clamper 19*b* to open. In this condition, the clamper 19*b* waits for the arrival of a new master.

In parallel with the master discharging operation, the master making section 3 makes a master. More specifically, when the cut start key 104 is pressed, the platen roller 58, tension roller pair 62 and reverse roller pair 63 start rotating to thereby pull out the stencil 64 from the roll 64*a*. At this instant, the movable stencil guide is held at the conveying position. When the image forming region of the stencil 64 thus pulled out arrives at the heating elements of the thermal head 59, the image data stored in the image memory 135 are called and then processed in a conventional manner. The heating elements of the thermal head 59 are selectively energized in accordance with the processed image data, forming the third image 66A in the thermoplastic resin film surface of the stencil 64. When the leading edge of the stencil 64, being conveyed and perforated, is nipped by the reverse roller pair 63, the movable stencil guide is shifted to the retracted position while the reverse roller pair 63 is caused to stop rotating.

The platen roller 58 and tension roller pair 62 continuously rotate even after the stop of rotation of the reverse roller pair 63. Consequently, the perforated stencil or master 66 is sequentially introduced into the master stocking section 61 while forming a loop, as illustrated. Before the reverse roller pair 63 stops rotating, the suction fan disposed in the master stocking section 61 starts sucking the master 66 and allows it to smoothly enter the master stocking section 61.

When the master discharging operation completes and the printer 1 is waiting during the master making operation described above, the reverse roller pair 63 again starts rotating to convey the master 66 stored in the master stocking section 61 toward the stage 19*a* and clamper 19*b* held in the open position. As soon as the leading edge of the master 66 arrives at a preselected position where it can be clamped by the clamper 19*b*, the opening/closing means causes the clamper 19*b* to close with the result that the leading edge of the master 66 is retained on the print drum 12 by the stage 19*a* and clamper 19*b*.

Subsequently, the print drum 12 is intermittently rotated clockwise, as viewed in FIG. 1, wrapping the master 66 therearound. At this instant, while the reverse roller pair 63 is not driven, the drive roller 63*a* is caused to follow the rotation of the stencil 66 being pulled out by the one-way clutch disposed in the drive roller 63*a*. When the image data called from the image memory 135 ends, the thermal head 59 stops operating. The platen roller 58, tension roller pair 62 and reverse roller pair 63 are caused to stop operating while the cutting means 60 is operated to cut away the master 66. The master 66 is then pulled out from the master making section 3 in accordance with the rotation of the print drum 12. The master making and master feeding operation completes when the print drum 12 is rotated to the home position and stopped there.

The master feeding operation is followed by the following operation. When the print drum 12 is stopped at the home position, the solenoid 123 is turned on to locate the path selector 10 at the first position while the press roller locking means is operated. At the same time, the stepping motor 52 is energized to rotate the stepped cam 49 until the cam portion 49*b* contacts the cam follower 48*c*. As a result, the arm 48 is angularly moved about the shaft 48*a* to shift the cam shaft 44 to the position where the cam plate 43A can contact the cam follower 41. At this time, the press roller locking means is caused to stop operating.

Subsequently, the pickup roller 68, reverse roller 69, drive roller 87 and suction fan 90 are driven while the print drum 12 is rotated clockwise at a low speed. The pickup roller 68 and reverse roller 69 pay out the top sheet P from the sheet tray 67 toward the registration roller pair 71. After the registration roller pair 71 has nipped the leading edge of the sheet P, the drive roller 71*a* is driven to start conveying the sheet P toward the print drum 12 and press roller 13 at the time when the leading edge of the third image 66A of the master 66 wrapped around the drum 12 arrives at the position of the press roller 13.

The cam shaft 44 and cam 43, included in the press roller moving mechanism 55, are caused to start rotating in synchronism with the rotation of the print drum 12. At the particular timing mentioned above, the cam plate 43A, moved to the position corresponding to the cam follower 41, releases its projection from the cam follower 41. Consequently, the press roller 13 is pressed against the print drum 12 by the print pressure springs 42, pressing the sheet P being conveyed by the registration roller pair 71 against the master 66. In this condition, ink applied to the inner periphery of the print drum 12 by the ink roller 16 is transferred to the sheet P via the porous potion of the print drum 12, porous support member, mesh screen and the perforations of the mater 66, causing the master 66 to closely adhere to the print drum 12.

The sheet P, carrying an image printed thereon in accordance with the third image 66A, is steered toward the sheet discharge conveying unit 85 by the path selector 10 held in the first position. At this instant, the peeler 84 peels off the sheet P from the master 66. The sheet PB thus peeled off drops and is received by the sheet discharge conveying unit 85. The conveying unit 85 conveys the sheet PB to the print tray 86 while retaining it on the belt 89 due to the suction of the suction fan 90. Thereafter, the print drum 12 is again rotated to the home position and stopped there. The printer 1 again waits in the stand-by condition.

Assume that after inputting desired printing conditions on the print speed key 113 and various keys on the control panel 103 in the stand-by condition of the printer 1, the operator presses the trial print key 106. In response, the print drum 12 is driven at a desired printing speed while a single sheet P is fed from the sheet feeding section 4. The registration roller pair 71 stops the sheet P and then starts conveying it at the previously stated timing. The sheet P is then pressed against the master 66 wrapped around the print drum 12 by the press roller 13, so that an image is printed on the sheet P. Subsequently, the sheet, labeled PB, is steered toward the sheet discharging section 10 by the path selector 10, peeled off by the peeler 84, and then conveyed by the sheet discharge conveying unit 85 to the print tray 86 as a trial print.

If the position, density and so forth of the image printed on the trial print are acceptable, then the operator inputs a desired number of prints on the ten keys 109. In response, a number of sheets P identical with the desired number of prints are continuously fed from the sheet feeding section 4 and processed in the same conditions as the trial print. As soon as the desired number of prints are output, the print drum 12 is brought to a stop at the home position.

Hereinafter will be described a duplex print mode operation selected on the duplex print key 117. The operator, confirmed the turn-on of the LED 117*a* assigned to the duplex print mode, presses the thickness key 116 for inputting the thickness of sheets P to use. If the operator does not press the thickness key 116, the control means 129 rejects an input on the cut start key 104. If the operator presses the cut start key 104 without pressing the thickness key 116, then the control means 129 displays an adequate message urging the operator to input thickness on the monitor 120. In the illustrative embodiment, when either one of "ordinary sheet" and "thin sheet" is selected on the thickness key 116, the control means 129 accepts an input on the cut start key 104. On the other hand, when "thick sheet" is selected on the thickness key 116, the control means 129 rejects an input on the cut start key 104 and displays a message urging the operator to set adequate sheets on the display 120.

Assume that the operator sets ordinary sheets or thin sheets on the sheet tray 67 as sheets P, inputs thickness based on the sheets P on the thickness key 116, and then presses the cut start key 104. Then, the sensors 73 and 102 send their output signals to the control means 129. The control means 129 compares the two signals representative of a sheet size and a document size as in the simplex print mode. In the illustrative embodiment, the maximum sheet size applicable to the print drum 12 is A3, so that the maximum sheet size usable in the duplex print mode is A4 held in a landscape position.

If the sheet size and document size compared by the control means 129 are identical with each other, then the control means 129 causes the image reading operation to start immediately. If the two sizes are different from each other, then the control means 129 alerts the operator to the difference via the monitor 120. Alternatively, the control means 129 may automatically enlarge or reduce the magnification to thereby match the two sizes or may display a procedure for reduction or for the rotation of image data on the display 120 to thereby assist the operator. Further, if the sheet size is larger than the A4 landscape size, then the control means 129 may inhibit the duplex print mode from being executed while urging the operator to select the simplex print mode.

When the operator presses the cut start key 104, the image of a first document is read and written to the image memory 135 in the form of image data in the same manner as in the simplex mode operation. Subsequently, the control means 129 displays a message urging the operator to set a second document on the display 120. Watching the message appearing on the display 120, the operator opens the cover plate 94, removes the first document from the glass platen 93, sets the second document on the glass platen 93, and again closes the cover plate 94. When a sensor, not shown, senses the closing of the cover plate 94 and when a sensor, not shown, senses the second document laid on the glass platen 93, the image of the second document is read and written to the image memory 135 in the form of image data.

If desired, documents may be sequentially conveyed to the glass platen 93 by an ADF (Automatic Document Feeder) or image data may be input to the printer 1 from an apparatus located outside of the printer 1. Further, an arrangement may be made such that in the duplex print mode a single document, carrying images on both sides thereof, is conveyed via a turning path.

In parallel with the image reading operation, the master discharging section 5 removes the used master 64*c* from the print drum 12 as in the simplex print mode. The print drum 12 is held in a halt with the clamper 19*b* being held in the open position by the opening/closing means. The master making section 3 performs the master making operation different from the master making operation of the simplex print mode in that the first and second images 65A and 65B, FIG. 10, are formed in the stencil 64 side by side and spaced from each other by a preselected blank portion S. The blank portion S coincides with the intermediate zone, FIG. 1, when the resulting divided master 65 is wrapped around the print drum 12.

When the divided master 65 is stored in the master stocking section 61 and when the master discharging operation ends, the reverse roller pair 63 is operated to convey the divided master 65 toward the space between the stage 19*a* and the clamper 19*b*. Subsequently, the print drum 12 is intermittently driven to wrap the divided master 65 therearound as in the simplex print mode. When the entire image data representative of the two document images are sent from the image memory 135, the cutting means 60 cuts away the divided master 65. As a result, the divided master 65 is pulled out from the master making section 3 by the print drum 12 in rotation. The print drum 12 is then brought to a halt at the home position.

After the master making operation described above, the stepping motor 52 is energized to rotate the stepped cam 49 while the press roller locking means is operated to cause the cam portion 49*a* to contact the cam follower 48*c*. Consequently, the arm 48 is angularly moved about the shaft 48*a* to shift the cam shaft 44 to the position where the cam plate 43B can contact the cam follower 41. Subsequently, the press roller locking means is caused to unlock the press roller 13.

In the above condition, the pickup roller 68, reverse roller 69, drive rollers 36 and 37 and fans 39 and 90 are driven. At the same time, the print drum 12 is caused to rotate clockwise, as viewed in FIG. 1, at the low speed. A first sheet P is fed from the sheet tray 67 toward the registration roller pair 71. When the clamper 19*b* moves away from the position of the path selector 10, the solenoid 123 is energized to shift the path selector 10 to the second position. Subsequently, the drive roller 71*a* is driven at the time when the leading edge of the first image 65A, in the direction of rotation of the print drum 12, included in the divided master 65 arrives at the position of the press roller 13, so that the first sheet P is conveyed toward the gap between the print drum 12 and the press roller 13.

At the particular timing mentioned above, the cam plate 43B, shifted to the position where it can contact the cam follower 41, releases its projection from the cam follower 41 with the result that the press roller 13 is brought into contact with the print drum 12 under the action of the print pressure springs 42. Consequently, the press roller 13, one side of the first sheet P, the first image 65A of the master 65 and the print drum 12 are pressed together, so that an image representative of the first image 65A is printed on the first sheet P. This causes part of the master 65 formed with the first image 65A to closely adhere to the print drum 12.

The resulting one-sided sheet PA, carrying the image corresponding to the first image 65A thereon, is steered by the path selector 10 downward toward the refeeding means 9 while being peeled off from the master 65 by the edge of the path selector 10.

The one-sided sheet PA thus steered downward by the path selector 10 is conveyed via the gap between the guides 27 and 56 until one end of the sheet PA abuts against the sheet receiving plate 40, which is held in the first position shown in FIG. 5. When the sheet receiving plate 40, moving in synchronism with the rotation of the print drum 12 and press roller 13, reaches the second position shown in FIG. 6, the one edge of the sheet PA abuts against the end fences 8*a* while the other edge of the sheet PA contacts the auxiliary tray 8.

The other edge of the one-sided sheet PA mentioned above is conveyed in the direction indicated by an arrow A in FIG. 1 while being retained on the belt 38 by the suction fan 39, and then abuts against the refeed positioning member 24. At this instant, the sensor 8*c* senses the other edge of the sheet PA and sends its output to the control means 129. In response, the control means 129 interrupts the drive of the drive roller 36 and suction fan 39.

Even when the first sheet P is being guided to the auxiliary tray 8, the print drum 12 is continuously rotated. When the press roller 13 fully contacts the entire front zone of the print drum 12, the projection of the cam plate 43B is caused to contact the cam follower 41, releasing the press roller 13 from the print drum 12. The cam plate 43B therefore prevents the press roller 13 from contacting the reverse zone of the print drum 12 when the sheet P is absent, so that the press roller 13 is free from the deposition of ink. At this instant, after the press roller locking means has locked the press roller 13 at the released position, the stepping motor 52 is energized to rotate the stepped cam 49 such that the cam portion 49*b* contacts the cam follower 48*c*. As a result, the arm 48 is angularly moved about the shaft 48*a* to shift the cam shaft 44 to the position where the cam plate 43A can contact the cam follower 41.

Substantially at the same time as the operation described above, a second sheet P is fed from the sheet tray 67 to the registration roller pair 71. The drive roller 71*a* is again driven at the previously stated timing to convey the second sheet P to the gap between the print drum 12 and the press roller 13.

On the other hand, in the press roller moving mechanism 55, the press roller locking means unlocks the press roller 13 when the cam shaft 44 reaches the position where the projection of the cam plate 43A can contact the cam follower 41. At this instant, the print drum 12, rotating in synchronism with the cam shaft 44 is in a position where the non-porous portion thereof other than the front, reverse and intermediate zones faces the press roller 13. The solenoid 123 is energized after the front region of the print drum 12 has moved away from the press roller 13, but before the clamper 19*b* again faces the path selector 10, shifting the path selector 10 from the second position to the first position.

At the time when the second sheet P starts being conveyed by the registration roller pair 71, the projection of the cam plate 43A is released from the cam follower 41 with the result that the press roller 13 is brought into contact with the print drum 12 under the action of the print pressure springs 42. Consequently, the press roller 13, one side of the sheet P, the portion of the master 65 where the first image 64A is formed and the print drum 12 are pressed together, so that an image representative of the first image 64A is printed on one side of the sheet P.

The resulting second one-sided sheet PB is steered toward the sheet discharge conveying unit 85 by the path selector 10 while being peeled off from the master 65 by the peeler 84. At this time, the second one-sided sheet PB drops onto the conveying unit 85 and then driven out to the print tray 86 thereby.

After the second sheet P has been conveyed by the registration roller pair 71, the solenoid 33 is energized at preselected timing slightly earlier than the time when the leading edge, in the direction of rotation of the print drum 12, of the portion of the master 65 where the second image 65B is formed faces the press roller 13, causing the arm 32 to angularly move clockwise, as viewed in FIG. 3, about the shaft 32*a*. As a result, the refeed registration roller 23 is angularly moved from the released position to the contact position. Consequently, the one-sided sheet PA, stopped with its other end abutting against the refeed positioning member 24, abuts against the press roller 13 being rotated by the print drum 12 in contact therewith.

The press roller 13 in rotation conveys the one-sided sheet PA to the downstream side in the direction of rotation. At this instant, the sheet guide 31 and rollers 28 through 30 cooperate to guide the one-sided sheet PA toward the print drum 12 while maintaining it in close contact with the press roller 13. In this condition, although the one-sided sheet PA carries the image corresponding to the first image 65A, the sheet PA is prevented from being shifted on the press roller 13 because the refeed guide member 22 holds the sheet PA in close contact with the press roller 13. The image on the sheet PA is therefore protected from smearing ascribable to rubbing or thickening. After the trailing edge of the second sheet P and the intermediate zone of the print drum 12 have moved away from the position of the press roller 13, the one-sided sheet PA is brought to the nip between the print drum 12 and the press roller 12 when the leading edge of the reverse zone of the print drum 12 arrives at the press roller 13.

When the one-sided sheet PA is brought to the above nip, the press roller 13, the other side of the sheet PA, the portion of the master 65 where the second image 65B is formed and the print drum 12 are pressed together. As a result, an image corresponding to the second image 65B is printed on the other side of the sheet PA. This causes the above portion of the master 65 to closely adhere to the print drum 12.

The first sheet P, now a two-sided sheet or duplex print PB carrying the images corresponding to the first and second images 65A and 65B on both sides thereof, is guided by the path selector 10 toward the sheet discharge conveying unit 85 while peeled off from the master 65 by the peeler 84. The sheet PB then drops onto the conveying unit 85 and conveyed to the print tray 86 thereby. The printer 1 then remains in the stand-by condition.

In the stand-by condition, the operator inputs desired printing conditions on the print speed key 113 and various keys arranged on the operation panel 103 and then presses the trial print key 106. At this instant, too, the control means 129 urges the operator to input sheet thickness via the display 120. when the operator selects "thick sheet", the control means 129 rejects an input on the trial print key 106 and urges the operator to set adequate sheets.

When the trial print key 106 is pressed, the cam shaft 44 is shifted to the position where the cam plate 43B can contact the cam follower 41 as in the operation described above, and then the print drum 12 is rotated at the desired printing speed. Also, the path selector 10 is shifted to the second position. After the start of rotation of the print drum 12, a first sheet P is fed from the sheet feeding section 4, stopped by the registration roller pair 71, and then conveyed thereby at the same timing as in the previous operation. The sheet P is then pressed against the first image 65A of the master 65 by the press roller 13.

The first sheet P, now a one-sided sheet PA carrying the image corresponding to the first image 65A, is steered by the path selector 10 toward the sheet receiving plate 40, which is held in the first position, while being peeled off from the master 65. The sheet PA reached the sheet receiving plate 40, which moves toward the second position, abuts against the end fences 8*a* at one end and contacts the belt 38 at the other edge. The sheet PA is retained on the belt 38 by the suction of the suction fan 39 with its other edge abutting against the refeed positioning member 24.

Subsequently, the press roller locking means locks the press roller 13 in the released position. After the stepped cam 49 has been rotated to shift the cam shaft 44 to the position where the cam plate 43A can contact the cam follower 41, the press roller locking means unlocks the press roller 13. The path selector 10 is shifted from the second position to the first position before the clamper 19*b* again faces the path selector 10. Substantially at the same time, a second sheet P is fed from the sheet feeding section 4, once stopped by the registration roller pair 71, and then conveyed thereby at the same timing as the first sheet P.

The second sheet P is pressed against the first image 65A of the master 65 by the press roller 13. Subsequently, the second sheet P, now a printed sheet PB carrying an image corresponding to the first image 65A, is steered by the path selector 10 toward the sheet discharge conveying unit 85. The sheet PB is then peeled off from the master 65 by the peeler 84, dropped onto the conveying unit 85, and then conveyed thereby to the print tray 86.

After the second sheet P has been conveyed by the registration roller pair 71, the solenoid 33 is energized at the same timing as in the previous operation so as to angularly move the refeed registration roller 23 from the released position to the contact position. Consequently, the one-sided sheet PA, stopped with its other end abutting against the refeed positioning member 24, abuts against the press roller 13 being rotated by the print drum 12 in contact therewith. The sheet PA is then conveyed toward the printing section 2 in close contact with the press roller 13 via the refeed guide member 22.

In the printing section 2, the press roller 13 presses the one-sided sheet PA against the print drum 12 via the second image 65B of the master 65, so that an image corresponding to the second image 65B is printed on the other side of the sheet PA. The sheet PA, now a two-sided sheet or duplex print PB, is steered by the path selector 10 toward the sheet discharge conveying unit 85. The sheet PB is then conveyed by the conveying unit toward the print tray 86 85 while being peeled off from the master 65 by the peeler 84. This is the end of the trial printing operation.

If the positions, density and so forth of the images of the trial print are acceptable, then the operator inputs a desired number of prints on the ten keys 109 and the presses the print start key 105. At this instant, too, the control means 129 urges the operator to input sheet thickness via the display 120. If the operator selects "thick sheet", then the control means 129 rejects an input on the print start key 105 and urges the operator to set adequate sheets via the display 120. Assume that the desired number of prints input on the ten keys 109 is N.

When the print start key 105 is pressed, the cam shaft 44 is again shifted to the position where the cam plate 43B can contact the cam follower 41, and then the print drum 12 is rotated at the desired printing speed. Also, the path selector 10 is shifted to the second position. After the start of rotation of the print drum 12, a first sheet P is fed from the sheet feeding section 4, stopped by the registration roller pair 71, and then conveyed thereby at the same timing as in the trial printing operation. The press roller 13 presses the first sheet P against the first image 65A of the master 65, so that an image corresponding to the first image 65A is printed on one side of the sheet P.

The first sheet P, now a one-sided sheet PA carrying the image corresponding to the first image 65A, is steered by the path selector 10 while being peeled off from the print drum 12 thereby until one edge of the sheet PA abuts against the sheet receiving plate 40, which is held in the first position. When the sheet receiving plate 40 is brought to the second position, the one-sided sheet PA abuts against the end fences 8*a* at one edge and contacts the auxiliary tray 8 at the other edge. The sheet PA, conveyed by the belt 38, is caused to stay with its other end abutting against the refeed positioning member 24.

Subsequently, the press roller locking means locks the press roller 13 in the released position. After the cam shaft 44 has been shifted to the position where the cam plate 43A can contact the cam follower 41, the press roller locking means unlocks the press roller 13. Substantially at the same time, a second sheet P is fed from the sheet feeding section 4 to the printing section 2 via the registration roller pair 71. The path selector 10 is shifted to the first position so as not to interfere with the clamper 19*b* and then returned to the second position.

The press roller presses the second sheet P against the first image 65A of the master 65, so that an image corresponding to the first image 65A is printed on the second sheet P. The second sheet P, now a second one-sided sheet PA, is steered by the path selector 10 while being peeled off from the master 65 thereby and is then conveyed to the auxiliary tray 8 via the sheet receiving plate 40, which is held at the first position. At this instant, the solenoid 33 is energized at the same timing as during trial printing with the result that the first one-sided sheet PA, staying on the auxiliary tray 8, is again conveyed to the printing section 2 by the rotation of the press roller 13.

During the conveyance of the second one-sided sheet PA toward the auxiliary tray 8, the sheet receiving plate 40 prevents one edge of the sheet PA from contacting one edge of the first one-sided sheet PA. This protects one edge portion of the second one-sided sheet PA and one-edge portion of the first one-sided sheet PA from smearing ascribable to the contact of the two sheets PA.

In the above condition, one edge of the second one-sided sheet PA must be conveyed to the left in FIG. 5. If the sheet receiving plate 40 is absent, then one edge of the second one-sided sheet PA contacts one edge of the first one-sided sheet PA, which is being conveyed to the right in FIG. 5, so that the viscosity of ink on the first sheet PA and the rightward conveyance of the first sheet PA cancel the leftward conveyance of the second sheet PA. As a result, the second sheet PA stops moving and jams the path.

Moreover, the second one-sided sheet PA directly drops onto the auxiliary tray 8 from which the first one-sided sheet PA has already been delivered, and is retained on the auxiliary tray 8 by the suction of the suction fan 39. In addition, the leftward conveyance is canceled by the frictional force of the belt 38. As a result, the second sheet PA jams the path.

In the illustrative embodiment, the sheet receiving plate 40 receives one edge of the one-sided sheet PA conveyed from the printing section 2 for thereby obviating sheet jams stated above and insuring smooth continuous printing.

After the trailing edge of the second one-sided sheet PA has moved away from the nip between the print drum 12 and the press roller 13, the first one-sided sheet PA is again fed to the nip between the print drum 12 and the press roller 13 at the time when the reverse zone of the press roller 13 next to the intermediate zone faces the press roller 13. Subsequently, the press roller presses the first one-sided sheet PA against the second image 65B of the master 65, so that an image corresponding tot he second image 65B is printed on the other side or reverse side of the sheet PA. This sheet PA therefore becomes a two-sided sheet or duplex print PB.

During the above operation, the solenoid 123 is energized just before the intermediate zone of the print drum 12 faces the press roller 13, shifting the path selector 10 from the second position to the first position. As a result, the second one-sided sheet PA, being guided by the path selector 10, has its other edge guided onto the auxiliary tray 8 via a small gap between the lower surface 10*a* of the path selector 10 and the press roller 13 and sheet receiving plate 40. On the other hand, the first two-sided sheet PB, following the second one-sided sheet PA, is guided toward the sheet discharging conveying unit 85 along the upper surface 10*b* of the path selector 10. The two-sided sheet PB is conveyed to the print tray 86 by the conveying unit 85 while being peeled off from the master 65 by the peeler 84.

Subsequently, a third sheet P is conveyed from the sheet feeding device 4 to the printing section 2 via the registration roller pair 71. Again, the path selector 10 is shifted to the first position so as not to interfere with the clamper 19*b* and then returned to the second position. After an image corresponding to the first image 65A has been printed on the third sheet P, the sheet P, now a one-sided sheet PA, is guided by the path selector 10 to the auxiliary tray 8 via the sheet receiving plate 40. The solenoid 33 is energized at preselected timing to deliver the second one-sided sheet PA, staying on the auxiliary tray 8, toward the printing section 2.

The second one-sided sheet PA is fed to the nip between the print drum 12 and the press roller 13 at the same timing as the first one-sided sheet PA and becomes a second two-sided sheet or duplex sheet PB carrying an image corresponding to the second image 65B on the other side thereof. Again, the path selector 10 is shifted from the second position to the first position with the result that the other edge of the third one-sided sheet PA is guided to the auxiliary tray 8 via the small gap between the lower surface 10*a* of the path selector 10 and the press roller 13 and sheet receiving plate 40.

Subsequently, one edge of the second two-sided sheet PB conveyed from the auxiliary tray 8 is guided to the sheet discharge conveying unit 85 along the upper surface 10*b* of the path selector 10. This sheet PB is then conveyed by the conveying unit 85 to the print tray 86 while being peeled off from the master 65 by the peeler 84.

The procedure described above is repeated with consecutive sheets up to the (N-1)-th sheet. After the N-th sheet P has been conveyed from the sheet feeding section to the printing section and then brought to the auxiliary tray 8 via the sheet receiving plate 40 as the N-th one-sided sheet PA, an image corresponding to the second image 65B is printed on the other side of the (N−1)-th one-sided sheet PA. After the (N−1)-th one-sided sheet PA has been driven out to the print tray 86 as the (N−1)-th two-sided sheet PB, the press roller locking means locks the press roller 13 at the released position. In this condition, after the cam shaft 44 has been shifted to the position where the cam plate 43C can contact the cam follower 41, the press roller locking means unlocks the press roller 13. At this instant, the path selector 10 is held in the first position.

At a first timing earlier than the time when the leading edge, in the direction of rotation of the print drum 12, of the portion of the master 65 where the second image 65B is formed arrives at the press roller 13, the projection of the cam plate 43C is released from the cam follower 41 with the result that the press roller 13 is pressed against the print drum 12 under the action of the print pressure springs 42. Subsequently, at a second timing slightly earlier than the time when the leading edge, in the above direction, of the portion of the master 65 where the second image 65B is formed arrives at the press roller 13, the solenoid 33 is energized to move the arm 32 clockwise, as viewed in FIG. 3, about the shaft 32*a*. Consequently, the refeed registration roller 23 is shifted from the released position to the contact position, so that the N-th one-sided sheet PA, staying with its other edge contacting the refeed positioning member 24, is caused to contact the press roller 13 being rotated by the print drum 12 in contact therewith.

The N-th one-sided sheet PA is delivered to the nip between the print drum 12 and the press roller 13 at the same timing as the first one-sided sheet PA and then becomes the N-th two-sided sheet or duplex print PB carrying an image corresponding to the second image 65B on the other side thereof. The N-th two-sided sheet PB is conveyed to the sheet discharge conveying unit 85 along the upper surface 10*b* of the path selector 10, peeled off from the master 65 by the peeler 84, and then driven out to the print tray 86 by the conveying unit 85. Subsequently, after the reverse zone of the print drum 12 has moved away from the press roller 13, the cam plate 43C is brought into contact with the cam follower 41, releasing the press roller 13 from the print drum 12. The cam plate 43C therefore prevents the press roller 13 from contacting the print drum 12 when the sheet P is absent, thereby preventing ink from being transferred to the press roller 13. At this instant, the press roller locking means locks the press roller 13 at the released position. Thereafter, the print drum 12 is brought to a stop at the home position. The printer 1 thus completed the printing operation again waits in the stand-by position.

During any one of the operations described above, the image surface of the one-sided sheet PA, being refed from the refeeding means 9, contacts the press roller 13, so that ink is again transferred from the sheet PA to the press roller 13. However, in the illustrative embodiment, a minimum amount of ink deposits on the press roller 13 because the surface of the press roller 13 is implemented by a seamless film tube formed of a fluorine compound and having extremely smooth surface.

Further, in the illustrative embodiment, the surface of the press roller 13 is ink-repellent. This, coupled with the cleaning roller 26, promotes the removal of fink from the press roller 13 for thereby obviating retransfer of ink from the press roller 13 to a sheet P.

As stated above, in the illustrative embodiment, in the simplex print mode, a mater 66 is made by the master making section and wrapped around the print drum 12 while a sheet P is fed from the sheet feeding section 4 and pressed against the print drum 12 by the press roller 13. Therefore, the simplex mode can be executed in the same manner as in the conventional stencil printer without wasting the stencil 64. In the duplex print mode, after a master made by the master making section 3 has been wrapped around the print drum 12, a first sheet P fed from the sheet feeding section 4 is pressed against the print drum 12 by the press roller 13 and then conveyed to the auxiliary tray 8. Subsequently, a second sheet P fed from the sheet feeding section is pressed against the print drum 12 and then conveyed to the auxiliary tray 8 while the first one-sided sheet PA, turned and refed by the refeeding means 9, is pressed against the print drum 12 and then driven out to the print tray 86 as a duplex print PB. Therefore, images printed on both sides of the sheet P are formed by ink transferred from the print drum 12 by the press roller 13, insuring an attractive duplex print.

Moreover, because the printing section 2 includes the print drum 12 and press roller 13 smaller in diameter than the print drum 12 and because the auxiliary tray 8 is positioned below the sheet discharge conveying unit 85, the printer 1 is comparable in size with the conventional simplex printer and therefore needs a minimum of space.

Figure 14:
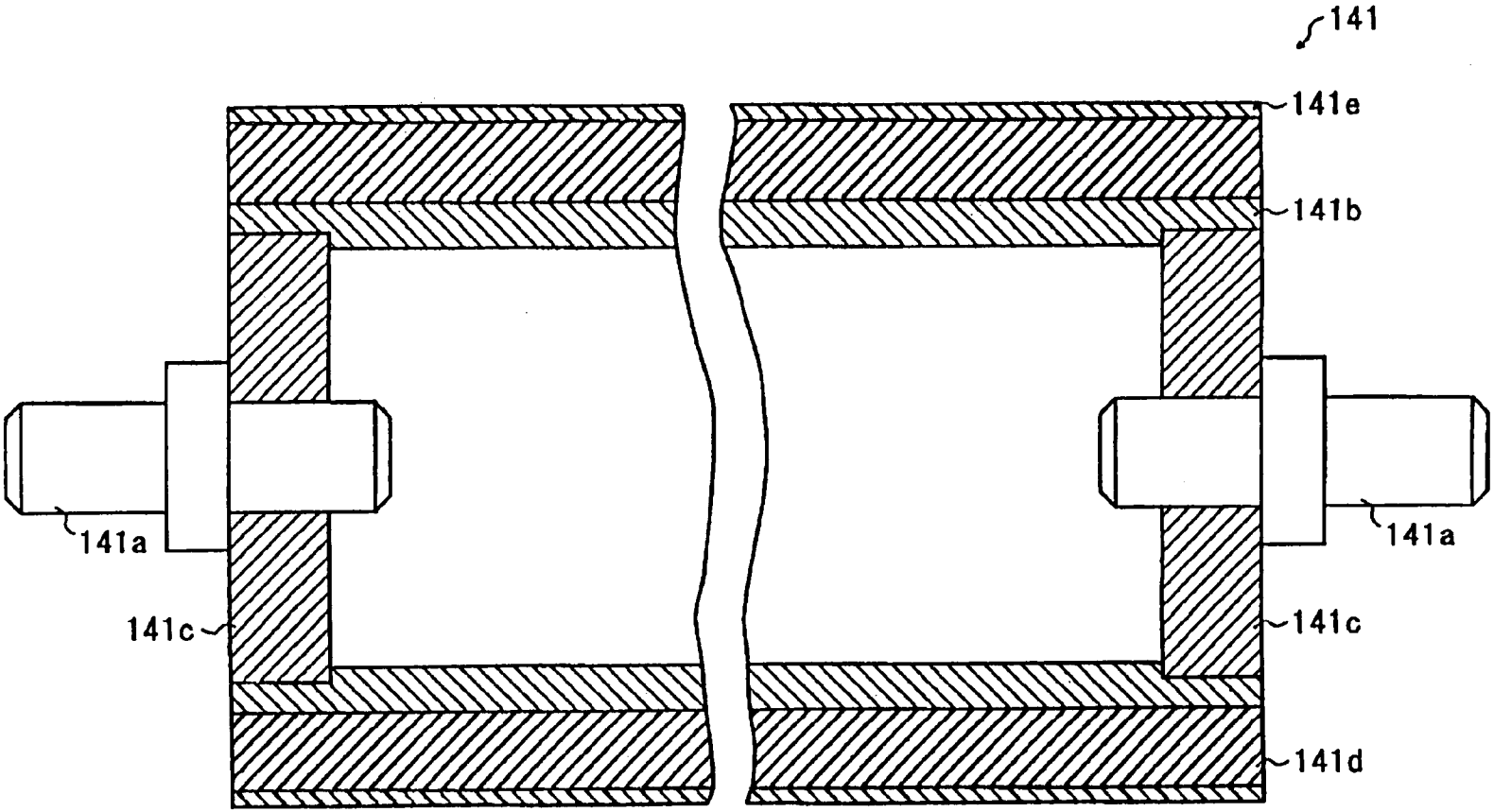
FIG. 14 shows a first modification of the press roller included in the illustrative embodiment.

FIG. 14 shows a first modification of the press roller 13 included in the illustrative embodiment. As shown, the press roller, labeled 141, includes a base made up of a hollow pipe 141*b* formed of light metal, a pair of end plates 141*c* formed of metal and mounted on opposite ends of the pipe 141*b*, and a pair of metallic core members 141*a* mounted on the end plates 141*c* like the press roller 13. An elastic layer 141*d*, which is about 5 mm to 10 mm thick, is formed on the outer periphery of the base by use of, e.g., silicone rubber. Further, a resin layer 141*e* is formed on the elastic layer 141*d* by use of a fluorine compound, constituting a fluorine compound layer.

In the modification, the outer periphery of the elastic layer 141*d* is ground to have a uniformly smooth, highly accurate circular configuration. The resin layer 141*e* is coated on the elastic layer 141*d* thus ground. More specifically, a liquid, consisting of a binder and fluorine-containing resin uniformly dispersed in the binder, is uniformly coated on the elastic layer 141*d* by spraying and then dried by heat. For example, use may be made of an FLC coat (trade name) using fluorocarbon resin latex. The resin layer 141*e* is 30 μm to 50 μm thick.

The press roller 141 with the configuration described above not only achieves the same advantages as the press roller 13, but also enhances image quality while sacrificing the elasticity of the elastic layer less than the press roller 13. In addition, the press roller 141 is simple in structure and therefore low cost.

Figure 15:
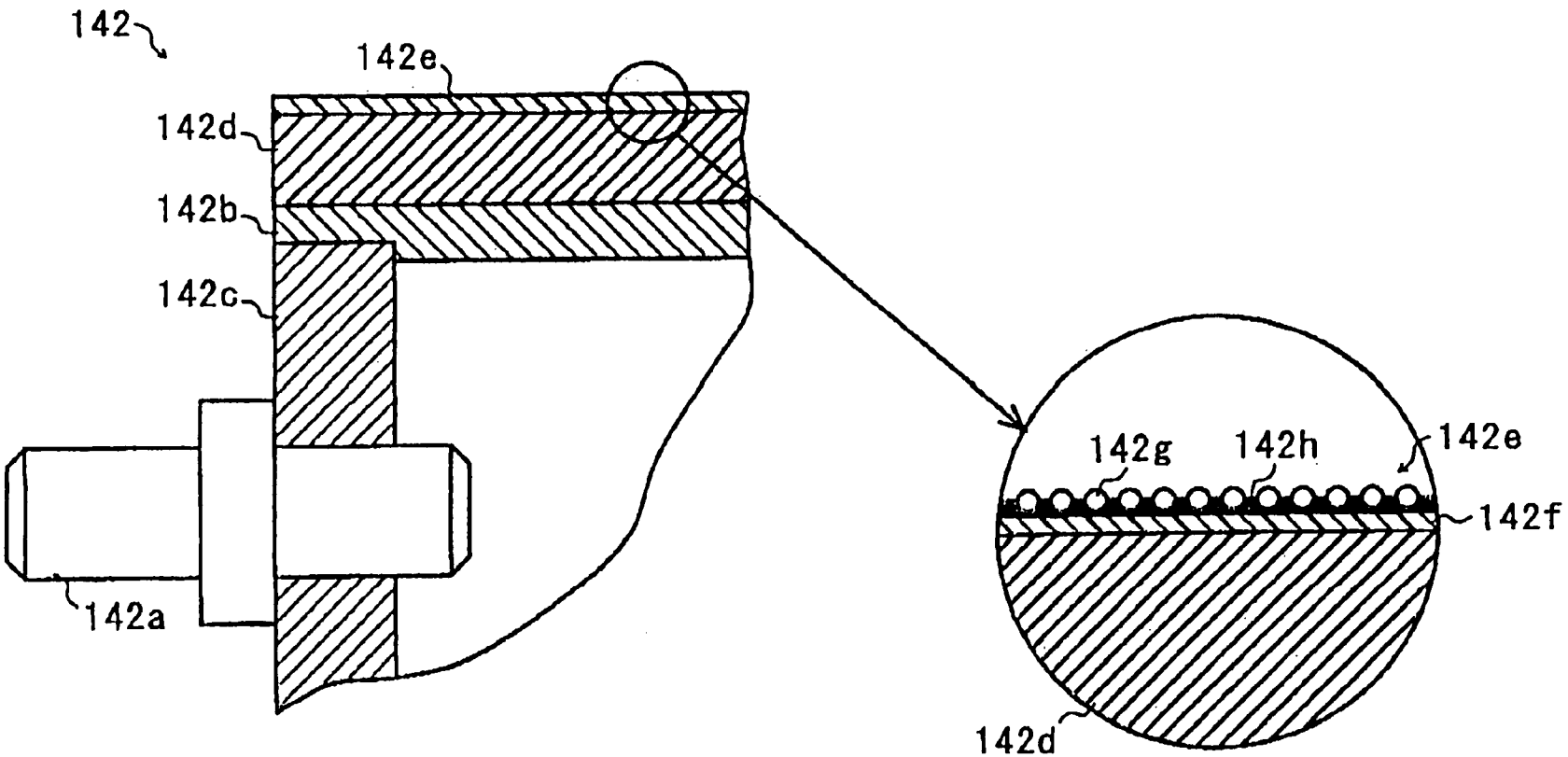
FIG. 15 shows a second modification of the press roller included in the illustrative embodiment.

FIG. 15 shows a second modification of the press roller 13. As shown, the press roller, labeled 142, includes a base made up of a hollow pipe 142*b* formed of light metal, a pair of end plates 142*c* formed of metal and mounted on opposite ends of the pipe 142*b*, and a pair of metallic core members 142*a* mounted on the end plates 142*c* like the press roller 13. An elastic layer 142*d*, which is about 5 mm to 10 mm thick, is formed on the outer periphery of the base by use of, e.g., silicone rubber. Further, a hard film 142*e*, provided with a finely undulated surface, is wrapped around the elastic layer 142*d*.

The elastic layer 142*d*, like the elastic layer 141*d*, has its surface ground in a uniformly smooth, highly accurate circular configuration. The film 142*e* is affixed to the surface of the elastic layer 142*d* thus ground. As shown in FIG. 15 in an enlarged scale, the film 142*e* consists of a 30 μm to 200 μm thick resin film 142*f* and a plurality of glass balls or fine glass grains 142*g* adhered to the film 142*f* by adhesive 142*h*. The film 142*e*, typified by an ICP film (trade name), is implemented as a web having preselected width and wrapped around the elastic layer 142*d*.

The press roller 142 achieves, in addition to the advantages of the press roller 13, an advantage that the undulated surface reduces adhesion of a sheet and therefore the amount of ink to deposit on the press roller 142. This further reduces the amount of ink to be transferred from the press roller 142 to a sheet P for thereby insuring attractive prints.

The undulation of the press roller 142, which is extremely fine, does not effect image quality while the glass balls 142*g*, which allow a minimum of ink to deposit thereon, further reduce defective printing. Further, the glass balls 142*g*, which are spherical, do not damage the surface of the cleaning roller 26 or do not penetrate a master even when the master is directly pressed against the glass balls 142*g*, and enhance reliable cleaning. If desired, the glass balls 142*g* may be replaced with fine ceramic grains identical in shape as the glass balls 142*g* while the adhesive 142*h* may be replaced with a two-sided adhesive tape.

The film 142*e* may be replaced with a seamless film tube fitted on the elastic layer 142*d*, in which case the glass balls 142*g* will be affixed to the film tube by the adhesive 142*h*. Alternatively, special adhesive may be coated on the elastic layer 142*d* as a resin layer corresponding to the resin film 142*f*, in which case the glass balls 142*g* or the ceramic balls will be adhered to the special resin by spraying.

Figure 16:
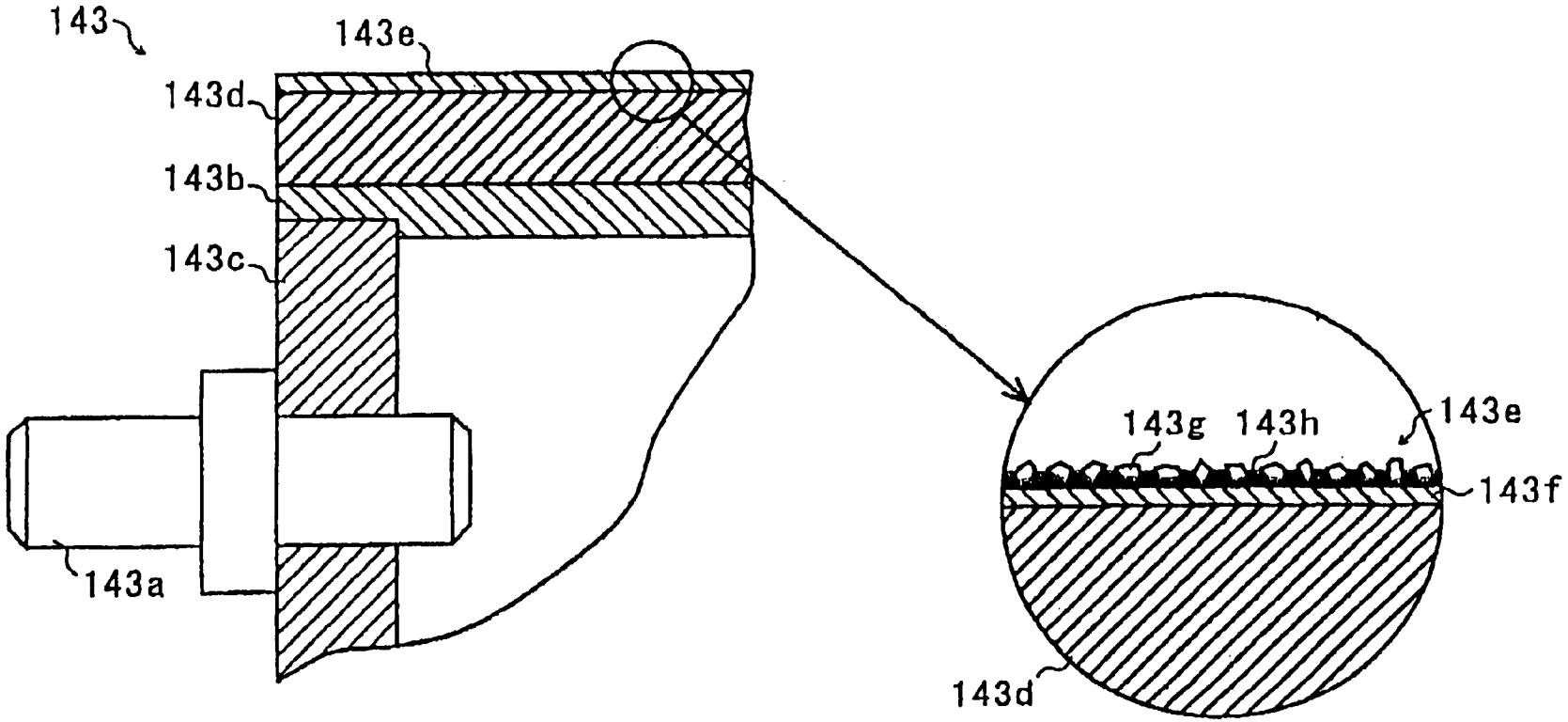
FIG. 16 shows a third modification of the press roller included in the illustrative embodiment.

FIG. 16 shows a third modification of the press roller 13. As shown, the press roller, labeled 143, is identical with the press roller 142, FIG. 15, in that a base is made up of a hollow pipe 143*b* formed of light metal, a pair of end plates 143*c* formed of metal and mounted on opposite ends of the pipe 143*b*, and a pair of metallic core members 143*a* mounted on the end plates 143*c*. An elastic layer 143*d*, which is about 5 mm to 10 mm thick, is formed on the outer periphery of the base by use of, e.g., silicone rubber. Further, a hard film 143*e*, provided with a finely undulated surface, is wrapped around the elastic layer 143*d*.

The elastic layer 143*d*, like the elastic layer 142*d*, has its surface ground in a uniformly smooth, highly accurate circular configuration. The film 143*e* is affixed to the surface of the elastic layer 143*d* thus ground. As shown in FIG. 16 in an enlarged scale, the film 143*e* consists of a 30 μm to 200 μm thick resin film 143*f* and a plurality of abrasive grains 143*g*, which are extremely fine, non-spherical ceramic grains 143*g*, adhered to the film 143*f* by adhesive 143*h*. More specifically, the film 143*e* may be implemented as sandpaper whose roughness is about #500 to #1,500 while the resin film 142*f* may be replaced with reinforced paper. The film 143*e* is implemented as a web having preselected width and spirally wrapped around the elastic layer 143*d*.

The press roller 143 achieves the same advantages as the press roller 13 and press roller 142, FIG. 15. The abrasive grains 143*g* may be replaced with fine glass grains identical in shape as the abrasive grains 143*g* while the adhesive 143*h* may be replaced with a two-sided adhesive tape.

Figure 17:
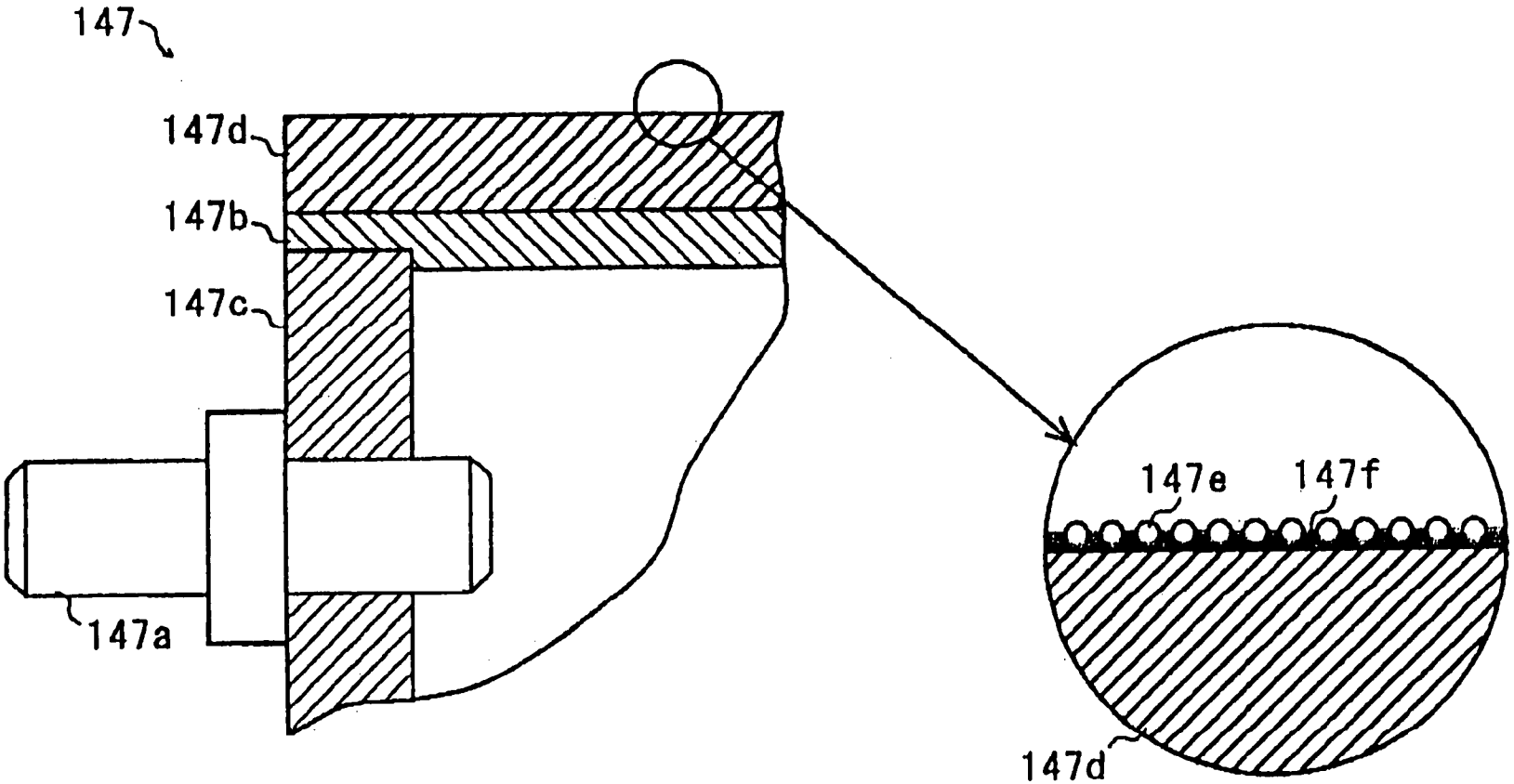
FIG. 17 shows a fourth modification of the press roller included in the illustrative embodiment.

FIG. 17 shows a fourth modification of the press roller 13. As shown, the press roller, labeled 147 is identical with the press roller 142, FIG. 15, in that a base is made up of a hollow pipe 147*b* formed of light metal, a pair of end plates 147*c* formed of metal and mounted on opposite ends of the pipe 147*b*, and a pair of metallic core members 147*a* mounted on the end plates 147*c*. An elastic layer 147*d*, which is about 5 mm to 10 mm thick, is wrapped around the base.

The elastic layer 147*d*, like the elastic layer 142*d*, has its surface ground in a uniformly smooth, highly accurate circular configuration. As shown in FIG. 17 in an enlarged scale, a plurality of glass balls 147*e*, which are fine glass grains like the glass grains 142*g*, are adhered to the elastic layer 147*d* thus ground.

The press roller 147 achieves the same advantages as the press roller 142. If desired, a plurality of fine ceramic grains may be substituted for the glass balls 147*e* while a two-sided adhesive tape may be substituted for the adhesive 147*f*.

Figure 18:
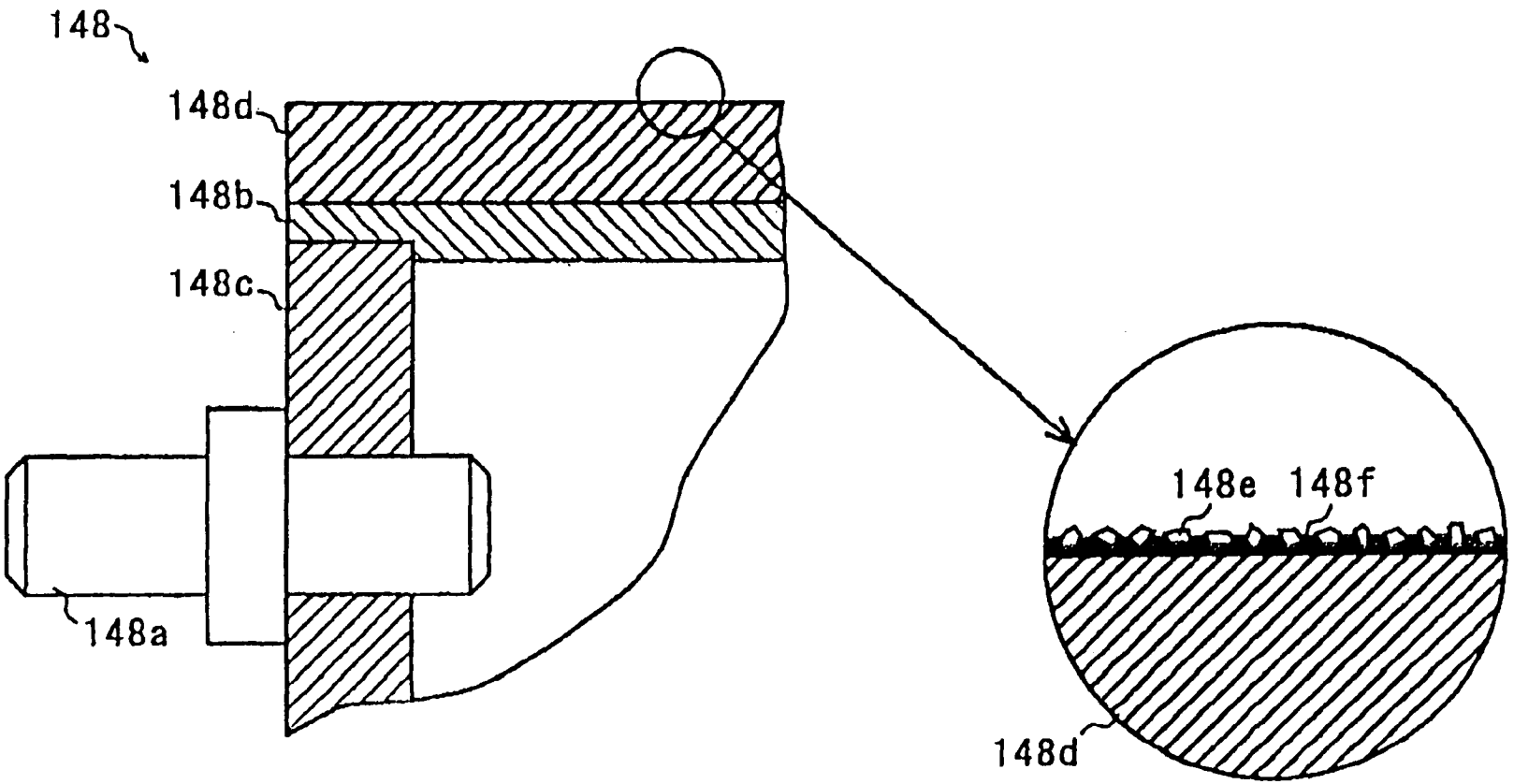
FIG. 18 shows a fifth modification of the press roller included in the illustrative embodiment.

FIG. 18 shows a fifth modification of the press roller 13. As shown, the press roller, labeled 148, is identical with the press roller 147, FIG. 17, in that a base is made up of a hollow pipe 148*b* formed of light metal, a pair of end plates 148*c* formed of metal and mounted on opposite ends of the pipe 148*b*, and a pair of metallic core members 148*a* mounted on the end plates 148*c*. An elastic layer 148*d* similar to the elastic layer 147*d* is wrapped around the base.

The elastic layer 148*d* has its surface ground in a uniformly smooth, highly accurate circular configuration. As shown in FIG. 18 in an enlarged scale, a plurality of abrasive grains 148*e*, which are fine ceramic grains like the abrasive grains 143*g*, are adhered to the elastic layer 148*d* thus ground by adhesive 148*f*.

The press roller 148 achieves the same advantages as the press roller 147. If desired, a plurality of fine glass grains may be substituted for the abrasive grains 148*e* while a two-sided adhesive tape may be substituted for the adhesive 148*f*.

The modifications of the press roller 13 described above are applicable not only to the printer 1 of the illustrative embodiment, but also to a stencil printer of the type including a plurality of press rollers, as taught in Laid-Open Publication No. 9-95033 or 2002-103768 mentioned earlier. In this type of printer, when a press roller positioned at the upstream side in the direction of sheet conveyance presses a sheet, ink transfer from the sheet to the press roller does not occur because an image is absent on the sheet. The modifications therefore each may be applied to at least a press roller positioned at the downstream side in the above direction.

Figure 19:
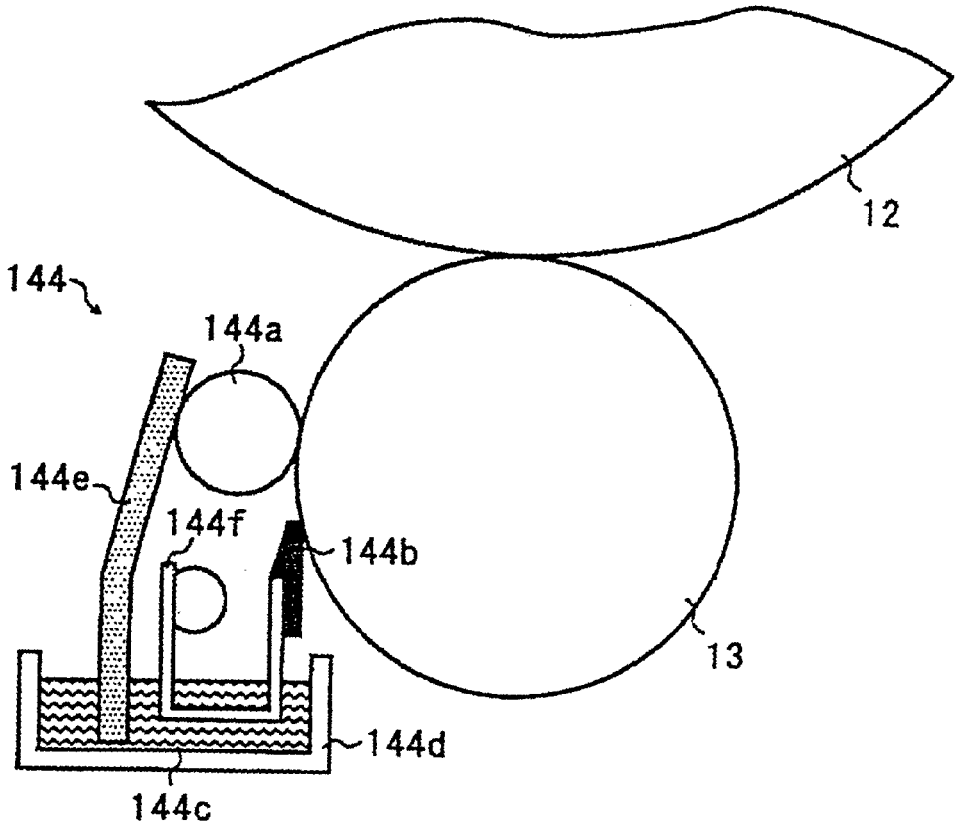
FIG. 19 shows a first modification of cleaning means included in the illustrative embodiment.

FIG. 19 shows a first modification of the cleaning means including the cleaning roller 26. As shown, the cleaning means, labeled 144, is substituted for the cleaning roller 26 and includes a coating roller or coating means 144*a*, a blade 144*b*, a tank 144*d* storing a cleaning liquid 144*c*, and a piece of felt 144*e*. The coating roller 144*a*, formed of rubber of similar material, is rotatably supported by the unit sides walls of the cleaning means 144, not shown, and pressed against the press roller 13 by preselected pressure. The blade 144*b*, formed of urethane or rubber, is supported by a support member 144*f* disposed in the tank 144*d* with its edge being pressed against the press roller by preselected pressure at a preselected angle. The blade 144*b* contacts the press roller 13 at a position just downstream of the position where the coating roller 144*a* contacts the press roller 13.

The tank 144*d* is mounted on the frame 11 via the unit side walls of the cleaning means 144. For the cleaning liquid 144*c* stored in the tank 144*d*, use may be made of silicone oil or similar oil or a solution containing a surfactant. The felt 144*e*, disposed in the tank 144*d* is dipped in the cleaning liquid 144*c* at one end and pressed against the coating roller 144*d* by preselected pressure at the other end. The cleaning liquid 144*c* is fed from the tank 144*d* to the coating roller 144*a* by the capilarity of the felt 144*e*.

In the configuration shown in FIG. 19, ink transferred to the press roller 13 is increased in fluidity by a small amount of cleaning liquid 144*c* coated on the press roller 13 and is then wiped off by the blade 144*b*. Generally, water-in-oil type of emulsion ink conventional with a stencil printer containers oil and water dispersed by a surfactant and has therefore the property of both of water and oil when transferred to a sheet. Therefore, it is difficult to select a material that does not allow such ink to easily deposit thereon in the aspect of wettability. Further, after the low viscosity component of the ink has been penetrated into the fibers of a sheet after transfer, the residual component is transferred from the sheet to the press roller and cannot therefore be mechanically easily scraped off due to increased viscosity. By contrast, the cleaning liquid 144*c* applied to the ink deposited on the press roller 13 successfully reduces the viscosity of the ink before the ink is scraped off. It is therefore possible to surely remove the ink from the press roller 13 and protects the successive sheets from the transfer of the ink.

Figure 20:
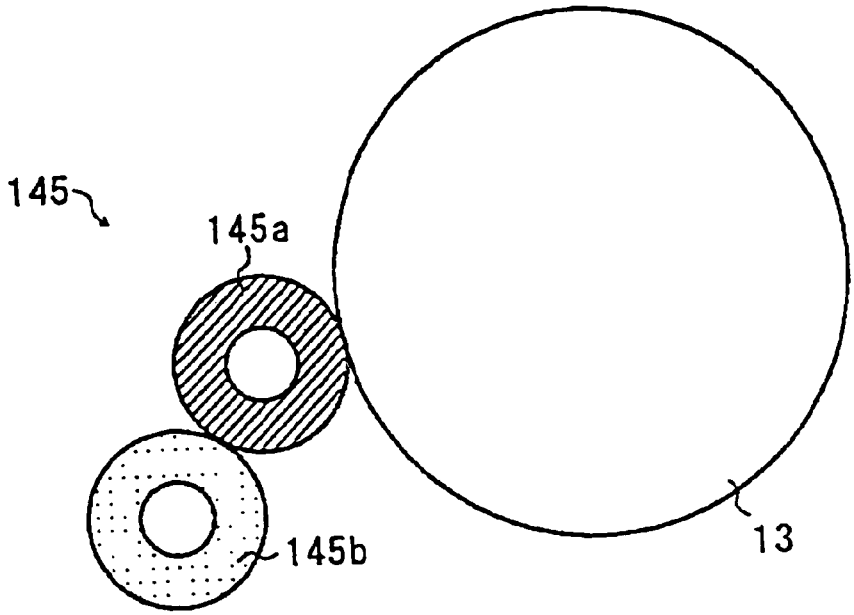
FIG. 20 shows a second modification of cleaning means included in the illustrative embodiment.

FIG. 20 shows a second modification of the cleaning means. As shown, the cleaning means, labeled 145, includes a roller 145*a* to which ink is to be transferred and a cleaning roller 145*b*. At least the surface of the roller 145*a* is implemented by an adhesive material, e.g., liquid silicone coated on a rubber roller or adhesive silicone rubber having low viscosity. The roller 145*a* is rotatably supported by the side walls of the cleaning means 145, not shown, and pressed against the press roller 13 by preselected pressure to be rotated thereby.

The cleaning roller 145*b* is also rotatably supported by the unit side walls and has at least its surface configured in the same manner as the cleaning roller 26 stated earlier. More specifically, the surface of the cleaning roller 145*b* is formed of a porous material, e.g., Japanese paper, sponge, highly moisture-absorptive foam rubber, foam synthetic rubber, nonwoven fabric, felt or cleaner sheet. The cleaning roller 145*b* is pressed against the roller 145*a* by preselected pressure. Drive means, not shown, causes, when the roller 145*a* is in rotation, the cleaning roller 145*b* to rotate in the opposite direction at a peripheral speed that is one-tenth of the peripheral speed of the roller 145*a*.

In the configuration shown in FIG. 20, ink deposited on the press roller 13, which is slightly ink-repulsive, is easily transferred to the roller 145*a* because the surface of the roller 145*a* is low in viscosity, but adhesive. Further, the roller 145*a*, held in close contact with the press roller 13, peels off the ink in such a manner as to wrap it, further promoting sure removal of ink from the press roller 13.

If ink transferred from the press roller 13 to the roller 145*a* is left on the roller 145*a*, then the ink is again transferred from the roller 145*a* to the press roller 13. In light of this, the cleaning roller 145*b* removes the ink from the roller 145*a* for thereby surely removing the ink from the ink roller 13.

Figure 21:
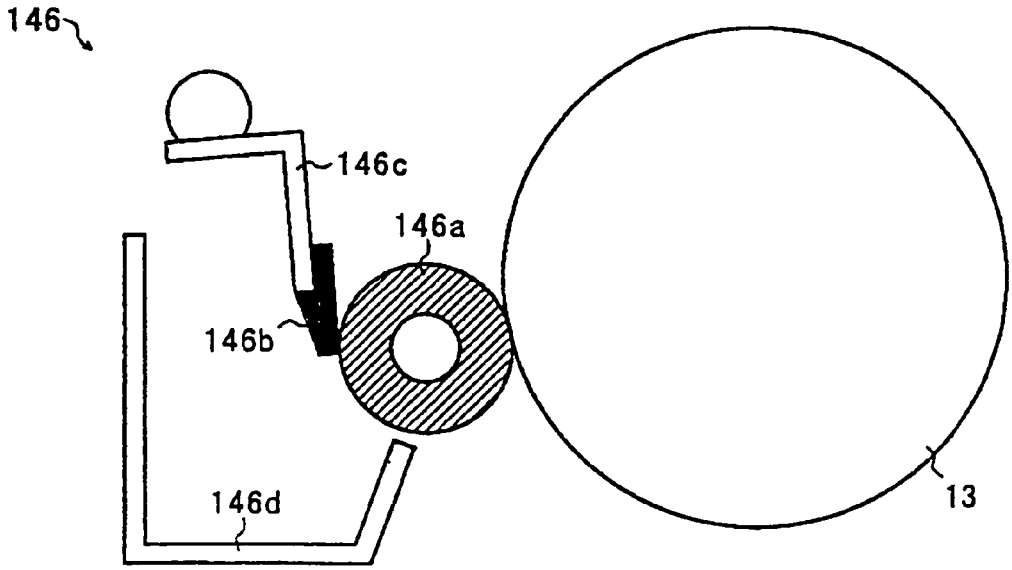
FIG. 21 shows a third modification of cleaning means included in the illustrative embodiment.

FIG. 21 shows a third modification of the cleaning means. As shown, the cleaning means, labeled 146, includes a roller 146*a* to which ink is to be transferred and a blade 146*b*. At least the surface of the roller 146*a* is formed of extremely smooth metal or hard rubber and rotatably supported by the side walls of the cleaning means 146 not shown. The roller 146*a* is pressed against the press roller 13 to be rotated thereby. The roller 146*a* should preferably comprise a stainless steel roller having a polished surface, a hard urethane roller having a finely ground surface or a roller implemented as a glass tube.

The blade 146*b* is formed of urethane, rubber or similar adhesive material and has its base end mounted on a support member 146*c*, which is angularly movably supported by the unit side walls of the cleaning means 146 not shown. The edge of the blade 146*b* is pressed against the roller 146*a* by preselected pressure at a preselected angle by biasing means not shown.

In the configuration shown in FIG. 21, ink deposited on the press roller 13, which is slightly ink-repulsive, is easily transferred to the roller 146*a* because the surface of the roller 146*a* is extremely smooth and pressed by high pressure, promoting sure removal of ink from the press roller 13.

The ink collected from the press roller 13 by the roller 146*a* is scraped off by the blade 146*b*. Because the blade 146*c* is adhesive while the surface of the roller 146*a* is extremely smooth and hard, the blade 146*b* can scrape off the ink from the roller 146*a* for thereby insuring the removal of the ink from the press roller 13. The ink removed from the roller 146*a* by the blade 146*b* is collected in a receiving member 146*d* positioned below the blade 146*b*.

The modifications of the cleaning means described above are also applicable not only to the printer 1 of the illustrative embodiment, but also to a stencil printer of the type including a plurality of press rollers, as taught in Laid-Open Publication No. 9-95033 or 2002-103768 mentioned earlier. In this type of printer, when a press roller positioned at the upstream side in the direction of sheet conveyance presses a sheet, ink transfer from the sheet to the press roller does not occur because an image is absent on the sheet. The modifications therefore each may be applied to a press roller positioned at the downstream side in the above direction.

Second Embodiment

A second embodiment of the printer in accordance with the present invention will be described hereinafter. Because FIGS. 1 and 3 through 13 and the description made with reference thereto apply to the second embodiment also, the following description will concentrate on differences between the first and second embodiments.

Figure 22:
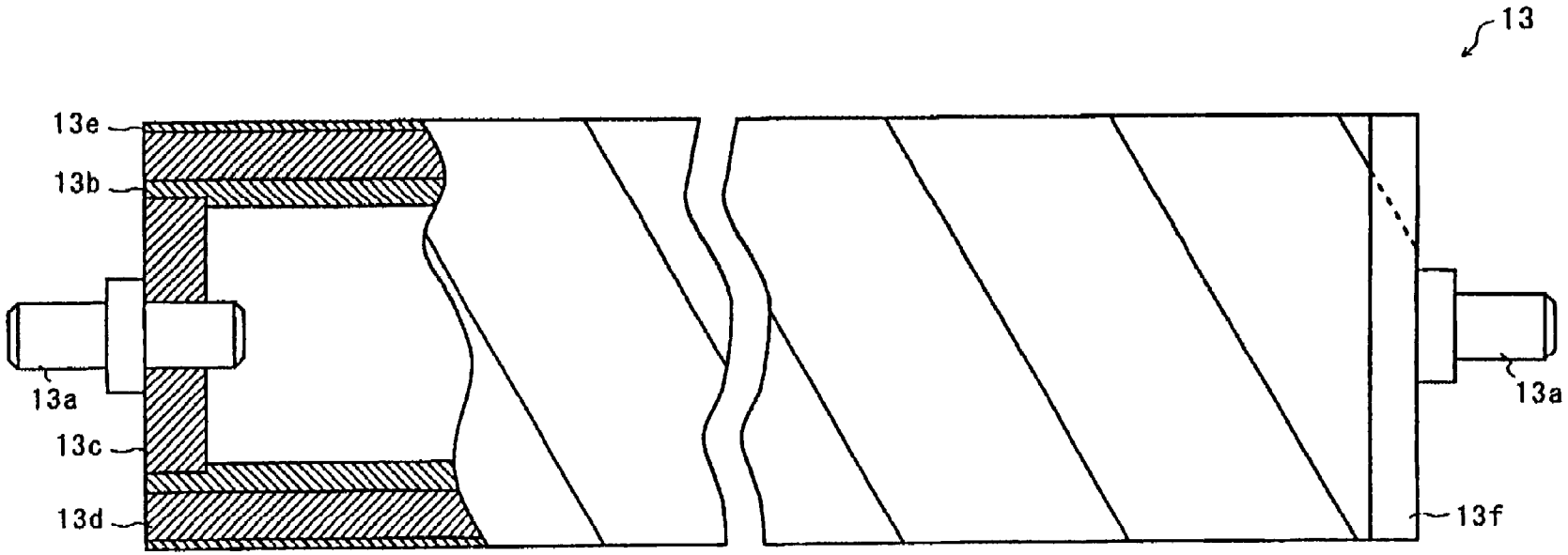
FIG. 22 shows a press roller included in a second embodiment of the printer in accordance with the present invention.

As shown in FIG. 22, the press roller 13 included in the second embodiment also includes the base made up of the hollow pipe 13*b*, end plates 13*c*, and core members 13*a*. The silicone rubber or similar elastic layer 13*d*, which is 5 mm to mm thick, is formed on the base. In the illustrative embodiment, the sheet member 13*e* is implemented as a web spirally wrapped around the elastic layer 13*d* such that the distance between nearby turns is 0.3 mm or less. A tape 13*f* is fitted on the end of the web to prevent the web from being unwrapped.

Figure 23:
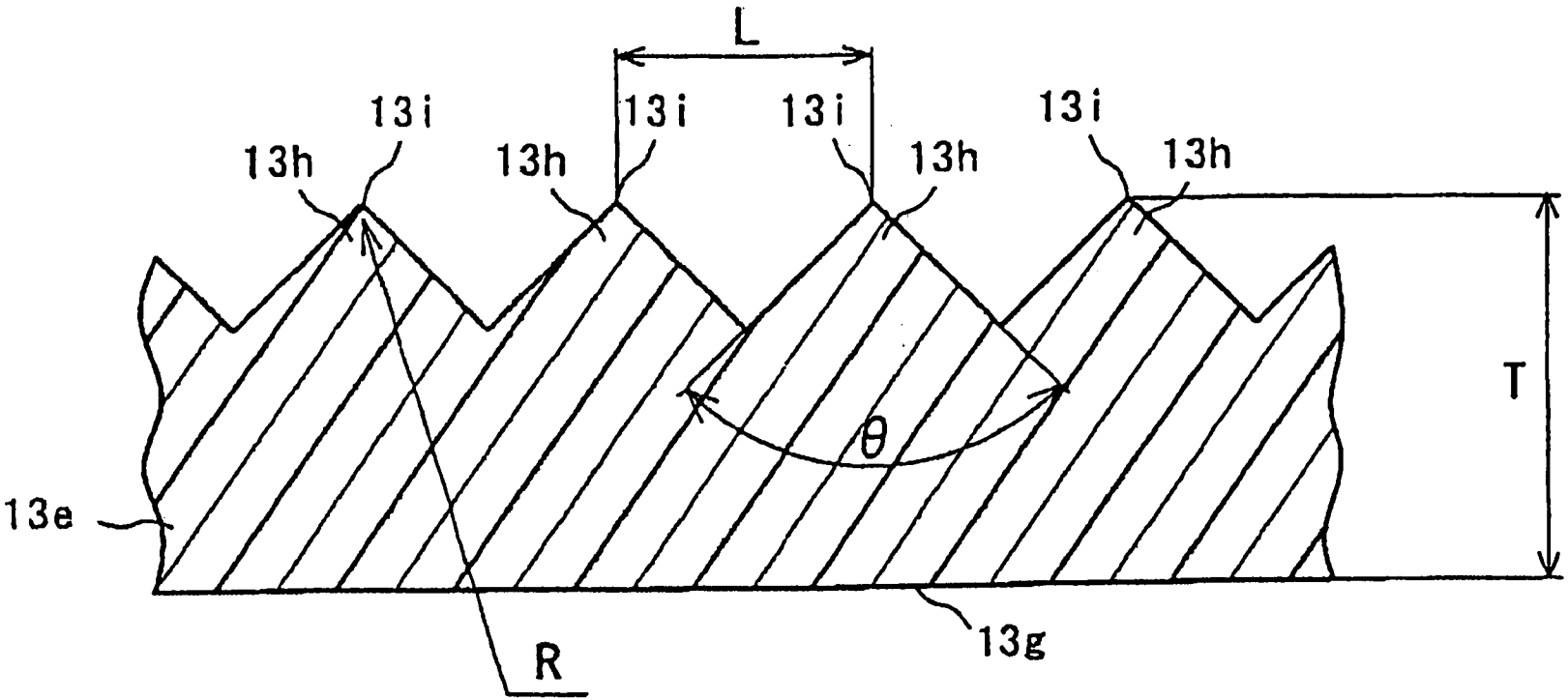
FIG. 23 shows a specific configuration of a sheet member included in the press roller of FIG. 22.

FIG. 23 shows part of the sheet member 13*e* in an enlarged section. As shown, the surface of the sheet member 13*e* opposite to the other surface 13*g*, which is to be adhered to the elastic layer 13*d*, is formed with a plurality of projections 13*h*, so that the sheet member 13*e* forms an undulated portion. The sheet member 13*e* is formed by molding polyurethane, polyolefin or similar thermoplastic synthetic resin with a special mold. In the illustrative embodiment, the sheet member 13*e* has thickness T selected to be between 0.3 mm and 0.4 mm. The projections 13*h* all have a conical shape or a polygonal pyramidal shape, and each has a peak 13*i* having an angle θ and a radius R. The projections 13*h* are arranged at a pitch L in terms of the distance between the peaks 13*i*. The angle θ, radius R and pitch L will be described more specifically later.

Figure 24:
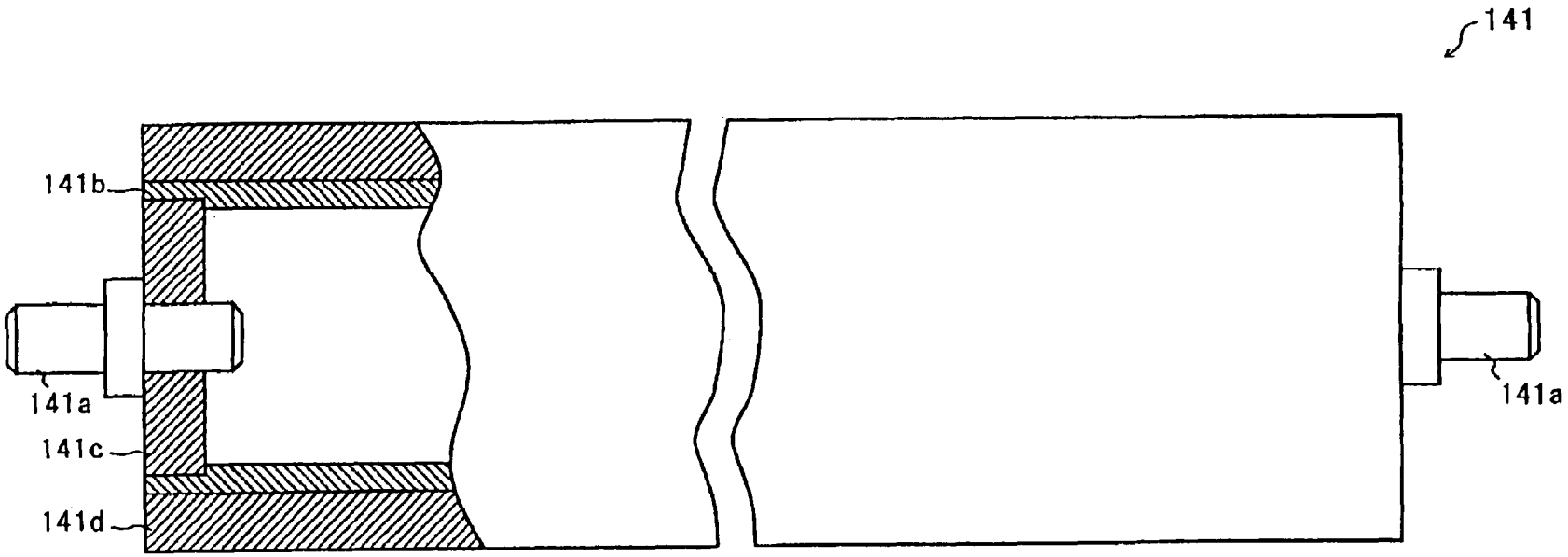
FIG. 24 shows a conventional press roller.

Reference will be made to FIG. 24 for describing the problem of a conventional press roller to arise in the duplex print mode. As shown, the conventional press roller does not include the sheet member 13*e* although including the core members 141*a*, hollow pipe 141*b*, end plates 141*c* and elastic layer 141*d*.

Figure 25:
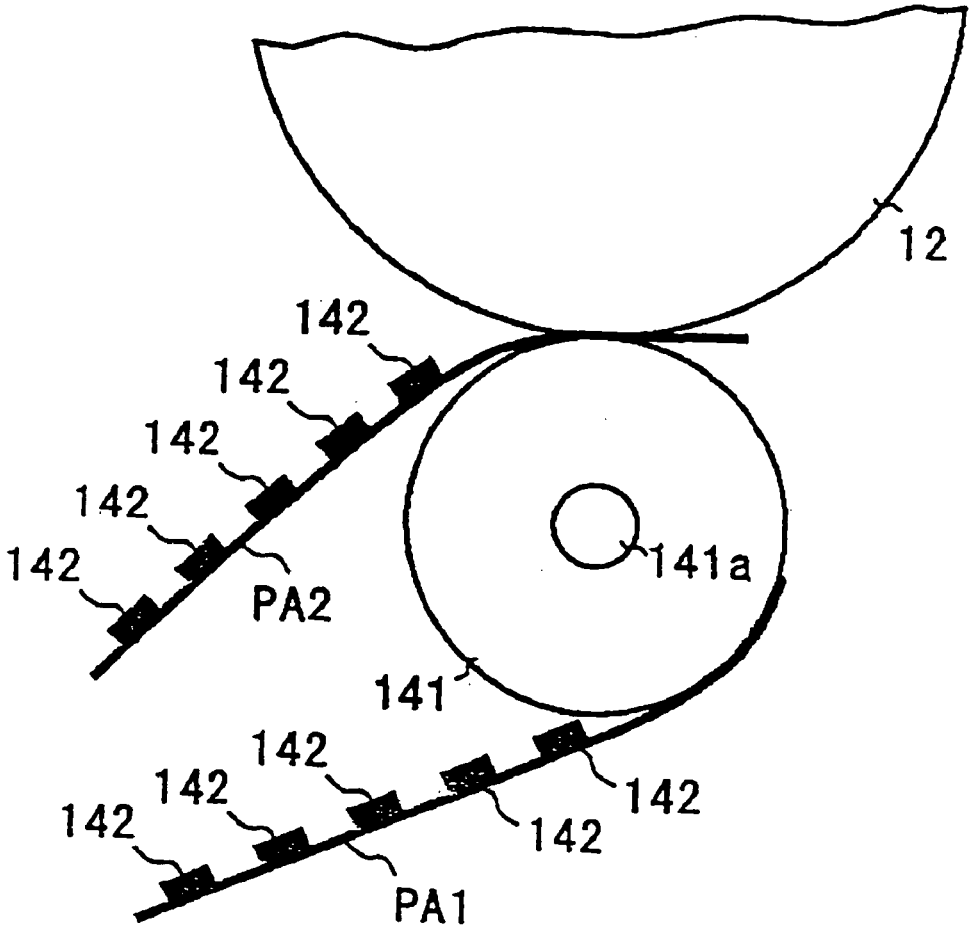
FIGS. 25 through 27 are views for describing problems with the second embodiment.

FIG. 25 shows a specific condition wherein a first sheet, fed from the sheet feeding section 4, is conveyed to the auxiliary tray 8 as a one-sided sheet PA1 carrying ink 142 thereon while a second sheet P, following the first sheet P, is conveyed to the tray 8 as a one-sided sheet PA2 carrying ink 142 thereon. The one-sided sheet PA 1 is being again fed from the auxiliary tray 8 toward the printing section 2.

Figure 26:
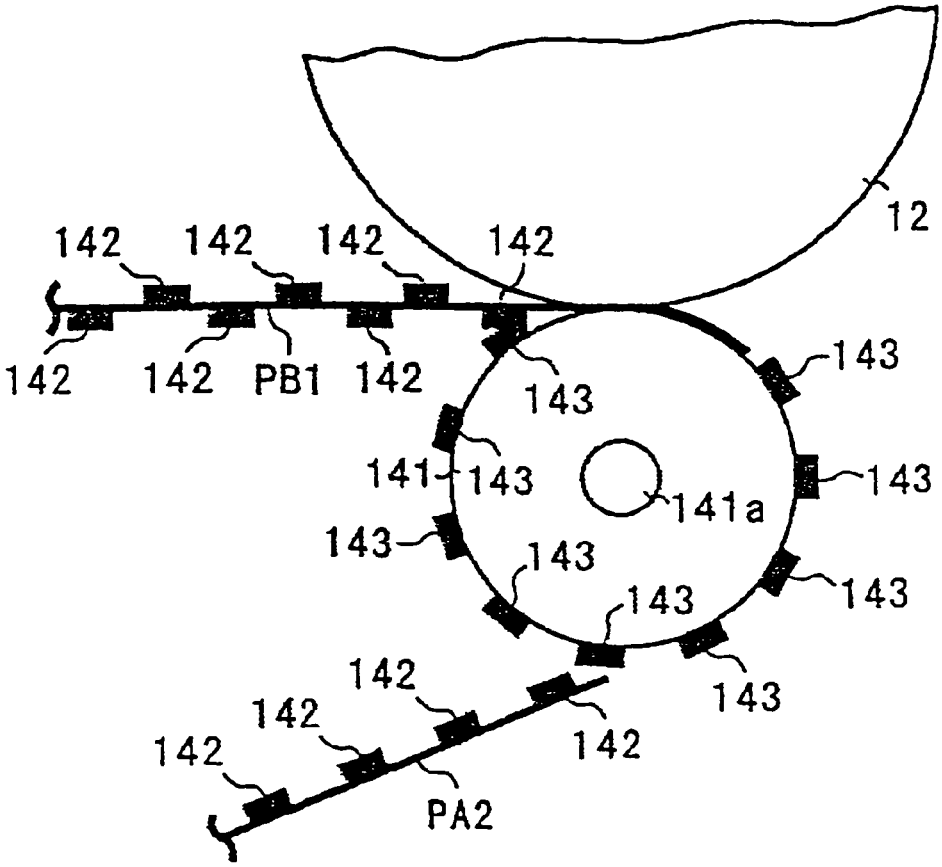

FIG. 26 shows another specific condition following the condition of FIG. 25. As shown, the one-sided sheet PA1 refed from the auxiliary tray 8 is pressed against the print drum 12 by the press roller 141 and becomes a two-sided sheet PB1 carrying the ink 142 on the other side also. The ink 142 transferred to the one side of the two-sided sheet PA1 is still wet. Therefore, if the wet ink 142 is pressed by the press roller 141, then it is again transferred to the press roller 141 as retransferred ink 143.

Figure 27:
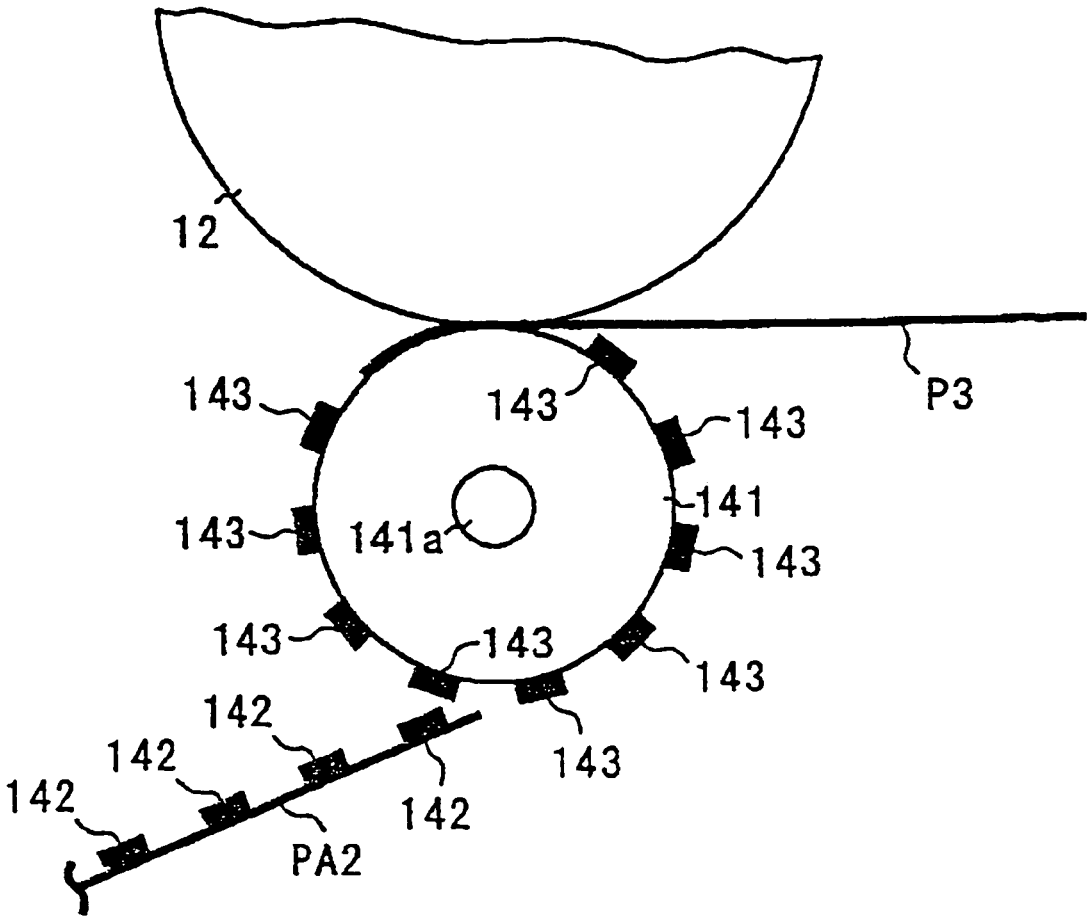

As shown in FIG. 27, as the printing operation further proceeds, a third sheet P3 is fed from the sheet feeding section 4. At this instant, the retransferred ink 143 on the press roller 141 is transferred to the reverse side of the sheet P3 and smears it. At the same time, the retransferred ink 143 is transferred to the one side of the one-sided sheet PA2 refed from the auxiliary tray 8 also, disfiguring the image carried on the sheet PA2.

In light of the above, in the illustrative embodiment, the sheet member 13*e* is wrapped around the press roller 13 to reduce the retransferred ink 143 as far as possible for thereby producing attractive prints. We conducted a series of experiments to estimate image quality and smearing ascribable to the retransferred ink 143 by varying the angle θ and radius R of the peak 13*i* and the pitch L between the peaks 13*i*. FIG. 28 lists the results of experiments.

As FIG. 28 indicates, the retransferred ink 143 easily deposited on the press roller 13 and brought about smearing when the radius R was larger than 0.04 mm, but deposited little when the radius R was 0.04 mm or less. Particularly, smearing ascribable to the retransferred ink 143 was not noticeable when the radius R was 0.03 mm or less. On the other hand, the retransferred ink 143 easily deposited on the press roller 13 when the angle θ was larger than 100°, but deposited little when the angle θ was 100° or less. Particularly, smearing ascribable to the retransferred toner 143 was not noticeable when the angle θ was 90° or less. However, when the angle θ was 60° or below, the strength of the projections 13*h* was short. When the pitch L between the peaks 13*i* was larger than 0.4 mm, apparent smoothness and therefore the image forming function required of a press roller was not achieved, so that irregularity in the form of spots appeared in the resulting images. By contrast, when the pitch L was 0.4 mm or below, such irregularity was not conspicuous; hardly any irregularity was observed when the pitch L was 0.3 mm or below. However, when the pitch was less than 0.1 mm, the depth of grooves between the projections was too small to obviate smearing.

It follows that the radius R of the peaks 13*i* should be 0.04 mm or below, preferably 0.03 mm or below, that the angle θ of the peaks 13*i* should be 100° or below, preferably between 70° and 90°, and that the pitch L between the peaks 13*i* should be 0.4 mm or below, preferably between 0.1 mm and 0.3 mm. By using the press roller 13 with the sheet member 13*e* having such a configuration, it is possible to reduce the retransferred ink 143 and therefore smearing as far as possible while insuring high image quality.

Figure 29:
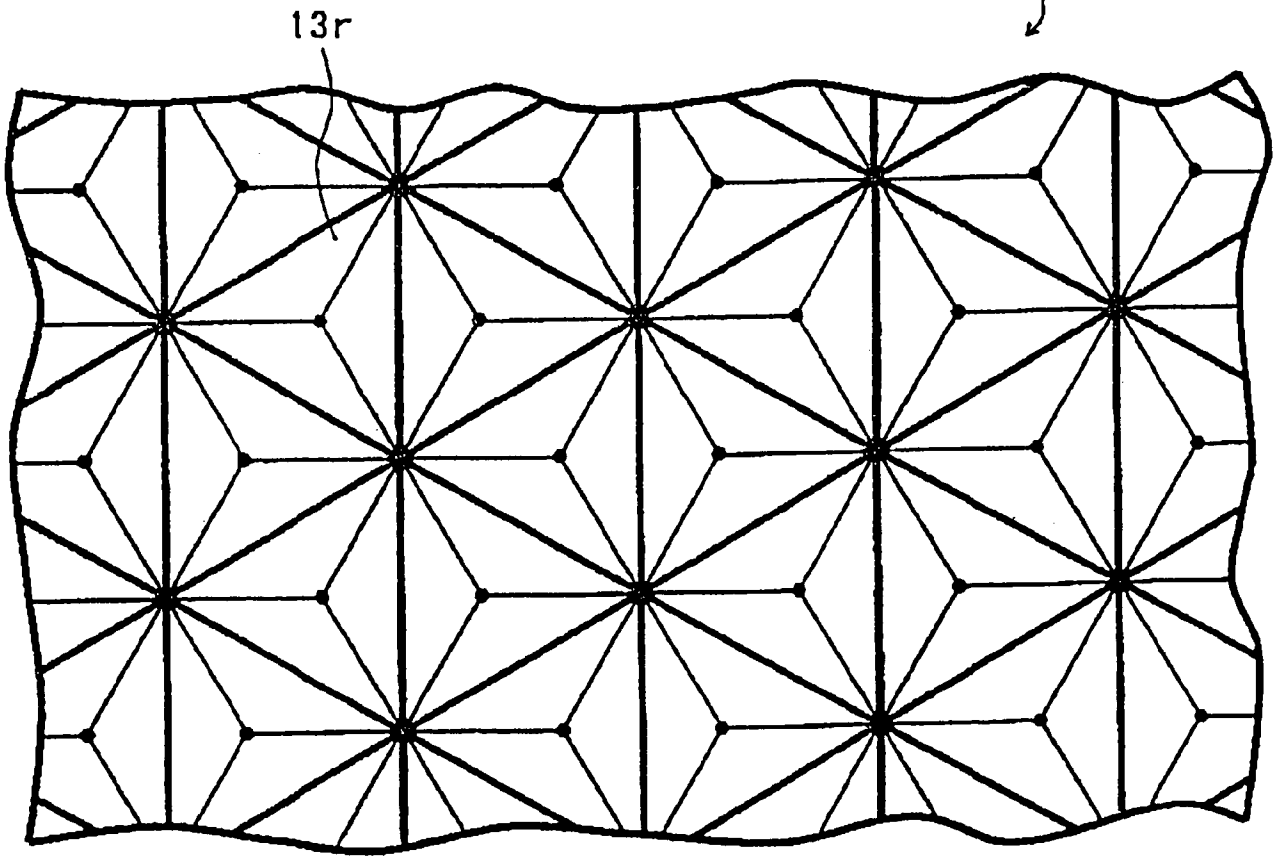
FIG. 29 is a plan view showing a first modification of the second embodiment.

FIG. 29 shows part of a sheet member 13*q* that is a first modification of the sheet member 13*e*. As shown, the sheet member 13*q*, also produced by molding thermoplastic synthetic resin with a special mold, has a plurality of trigonal pyramidal projections 13*r* regularly arranged in a bidimensional pattern. In FIG. 29, thick lines indicate the bases of the projections 13*r*, thin lines indicate the ridges of the projections 13*r*, and dots indicate the peaks of the projections 13*r*. With this sheet member, it is also possible to achieve the above advantages by confining the radius, angle and pitch in the particular ranges stated above. Each projection 13*r* may be conical or polygonal pyramidal, if desired.

Figure 30:
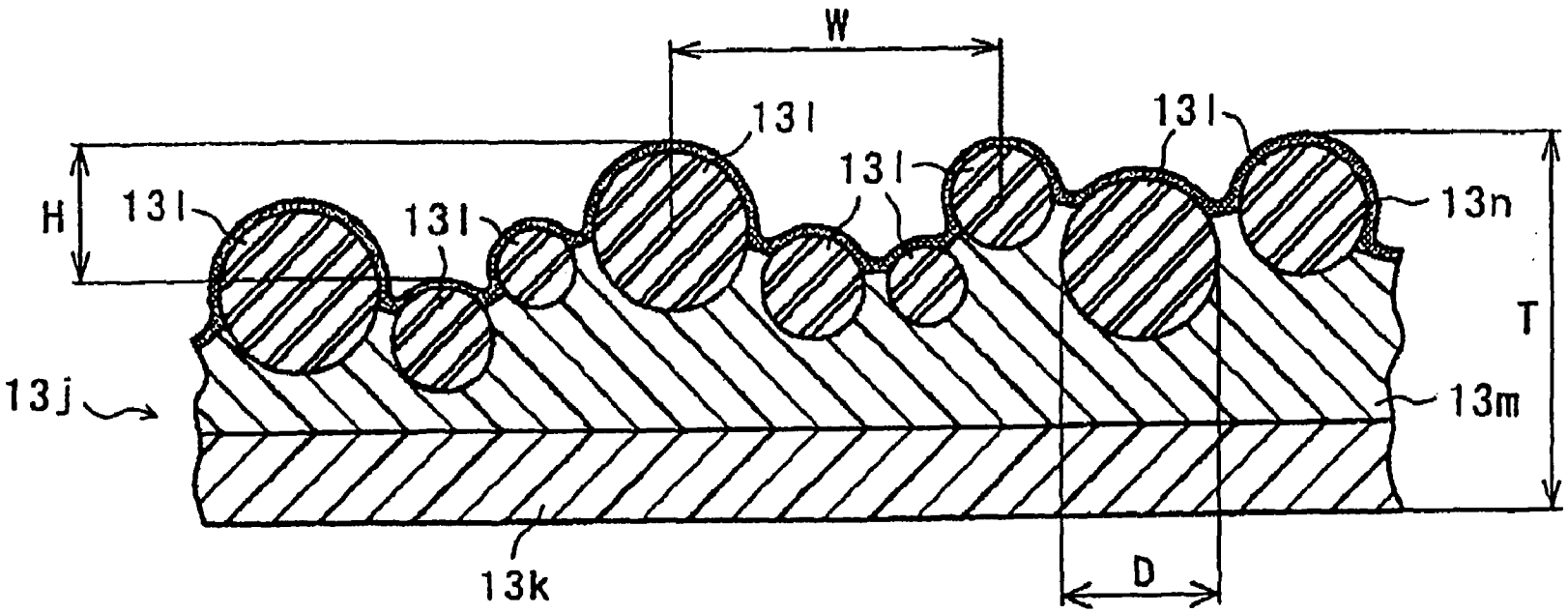
FIG. 30 is a view showing a second modification of the second embodiment.

FIG. 30 shows part of a sheet member 13*j*, which is a second modification of the sheet member 13*e*, in a sectional view. As shown, the sheet member 13*j* includes a 0.05 mm to 0.1 mm thick resin sheet 13*k* formed of polyester or similar thermoplastic resin. A plurality of glass balls 13*l* are adhered to the resin sheet 13*k* by urethane- or epoxy-based adhesive 13*m* such that the glass balls 13*l* do not lie in the same plane. With this configuration, the sheet member 13*j* constitutes a stepped portion.

The sheet member 13*j* is provided with thickness T ranging from 0.15 mm to 0.2 mm. The glass balls 13*l*, provided with a mean diameter D, are arranged such that the maximum difference in height between the peaks of the balls 13*l* is H and such that the mean pitch between the highest peaks is W. Adhesive with low viscosity should preferably be coated on the glass balls 13*l* in the form of a layer 13*n* in order to increase strength, which guarantees the difference in height, and to allow a minimum of retransferred ink 143 to deposit.

Again, we conducted a series of experiments to estimate image quality and smearing ascribable to the retransferred ink 143 by varying the mean radius D, maximum difference in height H and mean pitch W of the glass balls 13*l* included in the sheet member 13*j*. FIG. 31 lists the results of experiments.

As FIG. 31 indicates, smearing in the form of spots was noticeable when the mean diameter D was larger than 0.1 mm, it was not noticeable when the diameter D was 0.1 mm or below, particularly 0.08 mm or below. When the diameter D was 0.03 mm or below, it was difficult to control the maximum difference in height H and mean pitch W to adequate values to be described hereinafter. When the maximum difference in height H was less than 0.03 mm, the surface of the balls 13*l* was so smooth, sand-like smearing appeared. When the maximum difference H was larger than 0.03 mm, hardly any smearing was observed. However, when the maximum difference H was larger than 0.10 mm, irregularity appeared in the resulting images. When the mean pitch W was larger than 0.4 mm, irregularly in the form of spots appeared in images. When the mean pitch W was 0.4 mm or below, desirable images free from irregularity were achieved. However, when the mean pitch W was less than 0.15 mm, the surface of the balls 13*l* were so smooth, sand-like smearing occurred.

It follows that the mean diameter D should be 0.1 mm or below, preferably between 0.04 mm and 0.08 mm, that the maximum difference in height H should be 0.03 mm or above, preferably between 0.03 mm and 0.10 mm, and that the mean pitch W should be 0.15 mm or above, preferably between 0.15 mm and 0.40 mm. By using the press roller 13 with the sheet member 13*j* having such a configuration, it is possible to reduce the retransferred ink and therefore smearing as far as possible while insuring high image quality.

Figure 32:
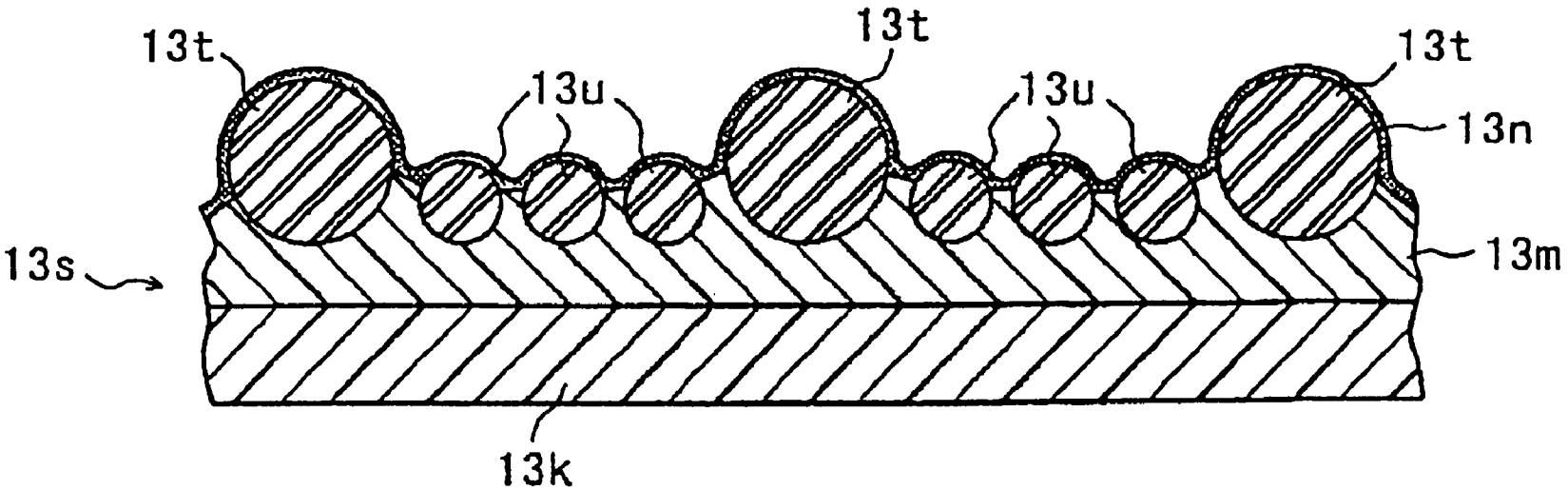
FIG. 32 shows a third modification of the second embodiment.

FIG. 32 shows a sheet member 13*s* that is a third modification of the sheet member 13*e*. This modification is identical with the second modification, FIG. 30, except that balls 13*t* having a mean diameter D of 80 ρm and balls 13*u* having a mean diameter D of 30 μm are adhered to the resins sheet 13*k* in a predetermined ratio, i.e., 1:3 in the modification. This modification achieves the same advantages as the second embodiment if the mean pitch between the balls 13*t* is selected to be 0.15 mm or above, preferably between 0.15 mm and 0.40 mm.

Figure 33:
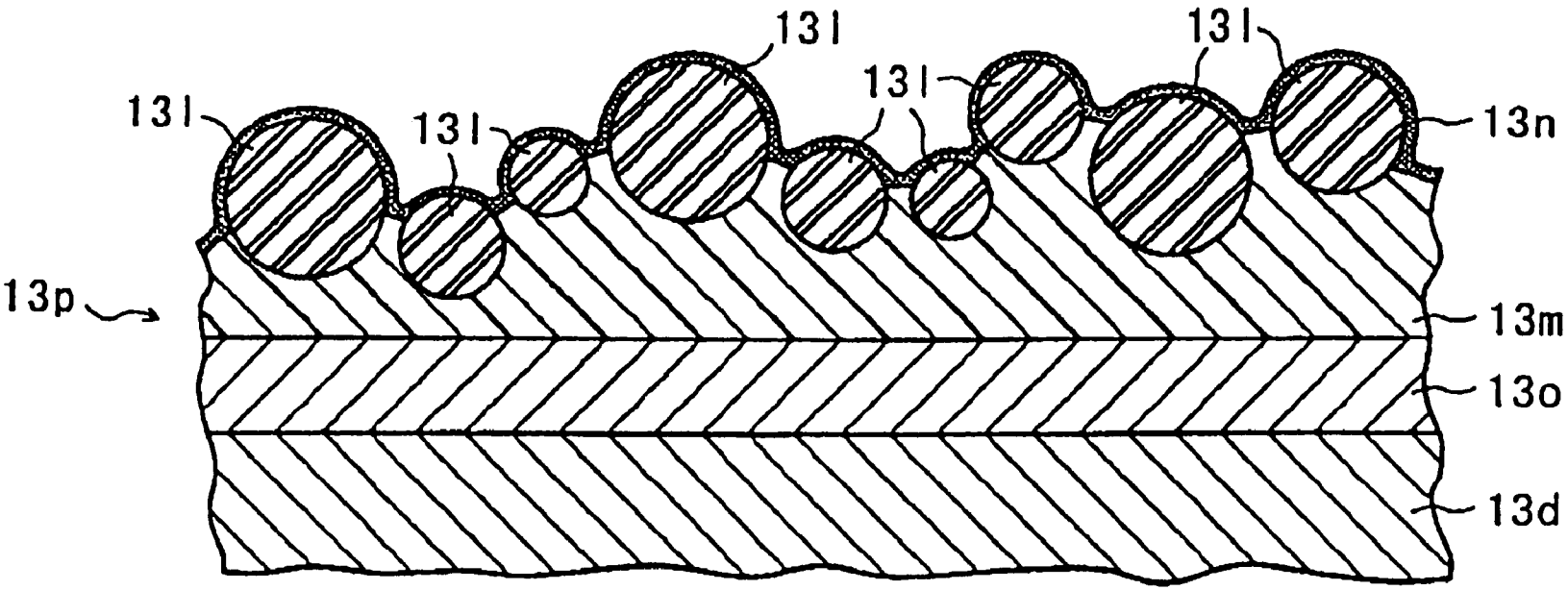
FIG. 33 shows a fourth modification of the second embodiment.

The sheet members 13*j* and 13*s* described above each are spirally wrapped around the elastic layer 13*d*. FIG. 33 shows another specific sheet member 13*p*. As shown, the sheet member 13*p* includes a particular surface hardening agent 13*o*, which bifunctions as primer treatment, coated on the surface of the elastic layer 13*d*. The balls 13*l* are adhered to the surface hardening agent 13*o*.

The sheet members 13*e*, 13*j*, 13*p*, 13*q* and 13*s* shown and described are also applicable not only to the printer 1 of the illustrative embodiment, but also to a stencil printer of the type including a plurality of press rollers, as taught in Laid-Open Publication No. 9-95033 or 2002-103768 mentioned earlier. In this type of printer, when a press roller positioned at the upstream side in the direction of sheet conveyance presses a sheet, ink transfer from the sheet to the press roller does not occur because an image is absent on the sheet. The sheet members 13*e* through 13*s* therefore each may be applied to at least a press roller positioned at the downstream side in the above direction.

Figure 34:
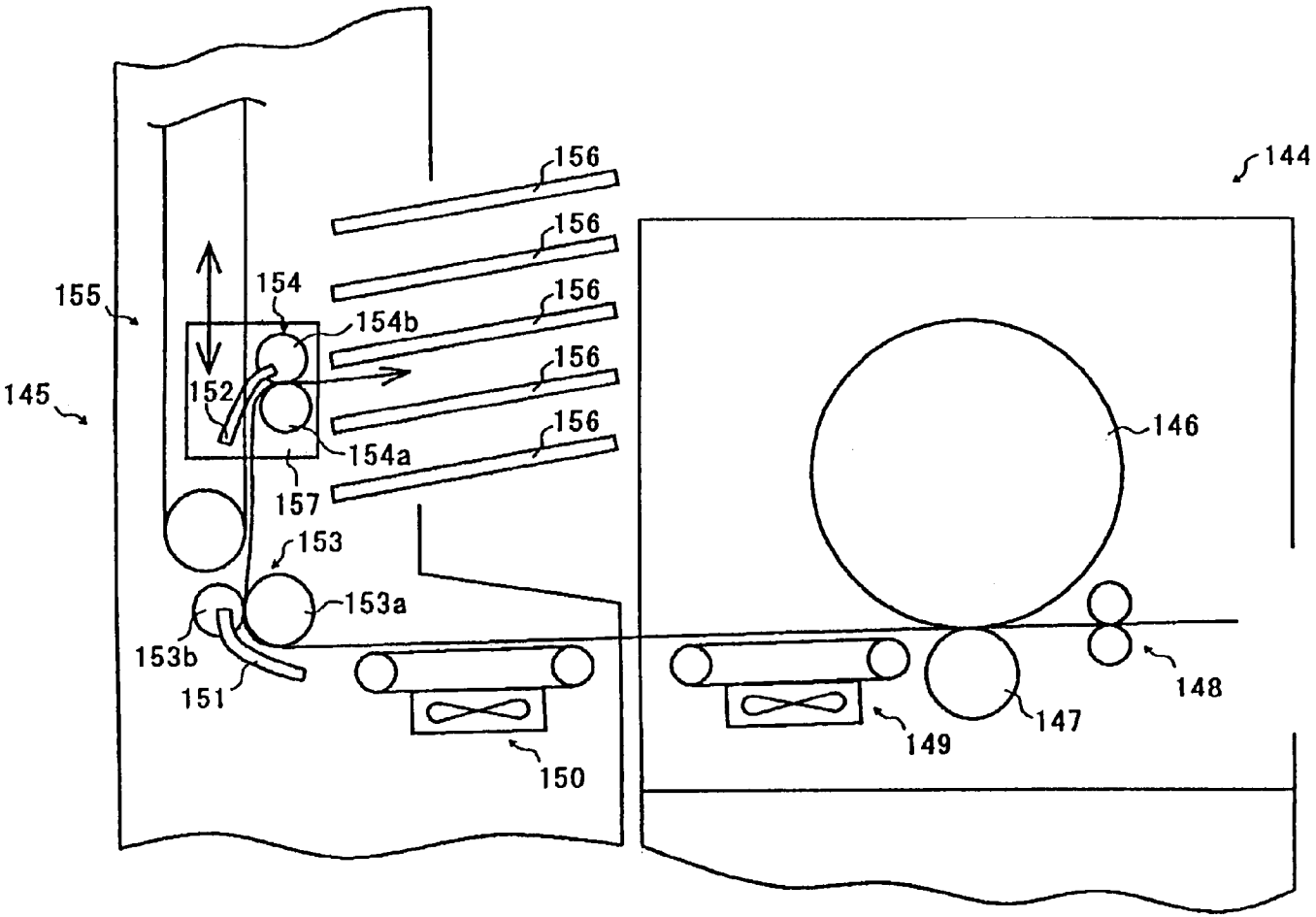
FIG. 34 shows a modification of the second embodiment implemented as a combination of a stencil printer and a sorter.

Reference will be made to FIG. 34 for describing a stencil printer 144, which is a modification of the illustrative embodiment, and a sorter 145 operatively connected to the printer 144. As shown, the printer 144 includes print drum 146, a press roller 147, a registration roller pair 148 and a sheet discharge conveyor 149 as well as an image reading section, a master making section, a master discharging section and a sheet feeding section not shown specifically. The registration roller pair 148 starts conveying, at preselected timing, a sheet fed from the sheet feeding section toward a nip between the print drum 146 and the press roller 147. The press roller 147 presses the sheet against the print drum 146 to thereby print an image on the sheet. The sheet, carrying the image thereon, is driven out of the printer 144 by the sheet discharge conveyor 149.

The sorter 145 includes a horizontal conveyor 150 for horizontally conveying the sheet introduced into the sorter 145 from the printer 144. Guides 151 and 152 guide the sheet. Roller pairs or conveying members 153 and 154 convey the sheet each. A vertical conveyor 155 vertically conveys the sheet. A plurality of bin trays 156 are disposed one above the other and fixed in position. An indexer 157 causes the guide plate 152 and roller pair 154 to move integrally with each other in the vertical direction. The roller pairs 153 and 154 are respectively made up of rollers 153*a* and 153*b* and rollers 154*a* and 154*b*. In each roller pair, one roller is a drive roller while the other roller is a driven roller pressed against the drive roller.

In operation, the sheet, carrying an image thereon and driven out of the printer 144, is introduced into the sorter 145 and conveyed by the horizontal conveyor 150, roller pair 153 and vertical conveyor 155. The sheet is then delivered to one of the bin trays 156 by the roller pair 154 held at a preselected position by the indexer 157. Usually, the sheet driven out of the printer 144 arrives at one of the bin trays 156 within 3 seconds.

In the sorter 145, the sheet contacts the rollers 153*a* and 154*a* and therefore causes ink to deposit on the rollers 153*a* and 154*a* in the same manner as it deposits on the press roller 13. The ink deposited on the rollers 153*a* and 154*a* are again transferred to the image surface of the following sheet, disfiguring the image of the following sheet. To solve this problem, any one of the sheet members 13*e*, 13*j*, 13*p*, 13*q* and 13*s* may be applied to the rollers 153*a* and 154*a*.

Figure 35:
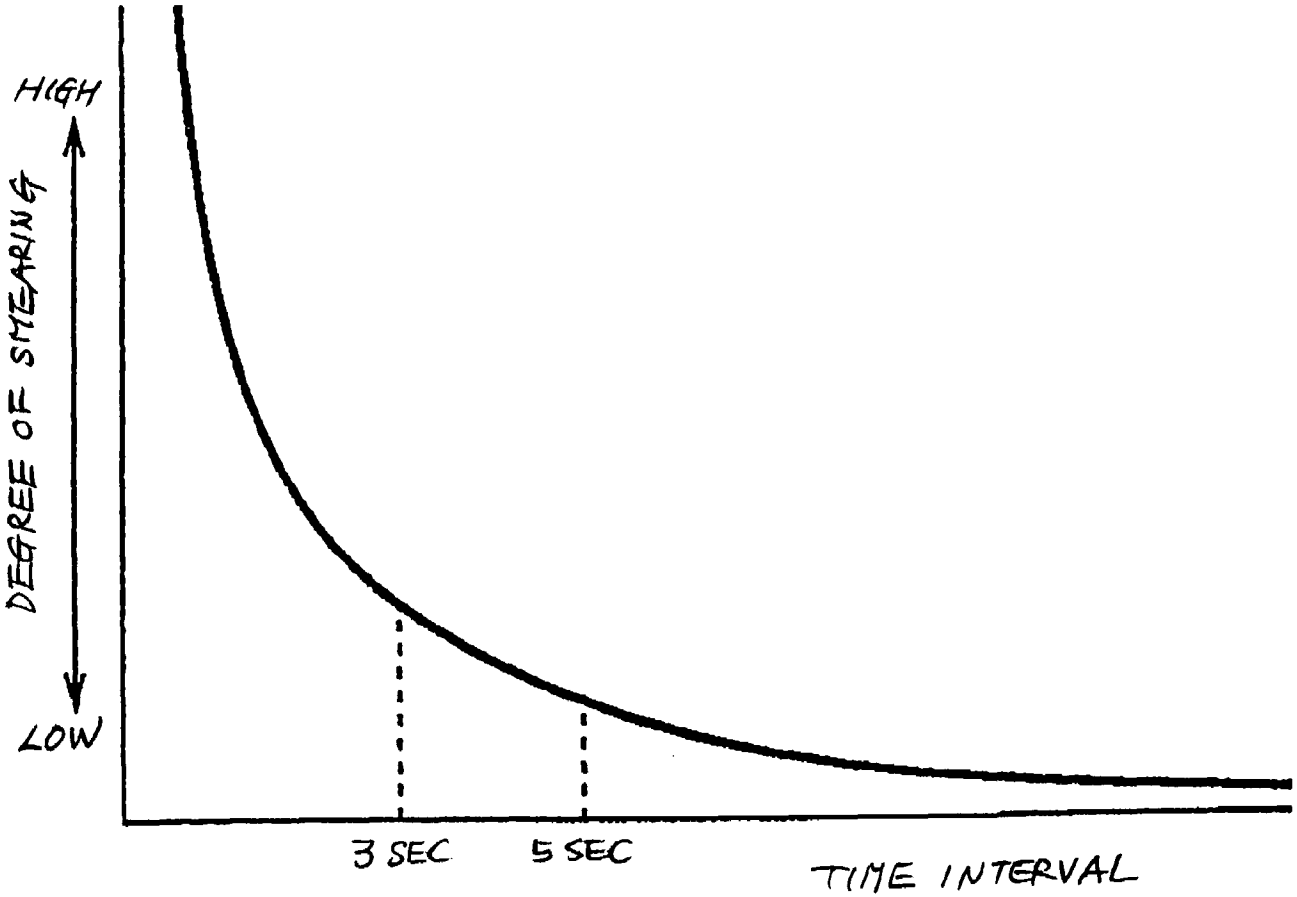
FIG. 35 is a graph showing a relation between the time interval between printing and the degree of smearing ascribable to retransferred ink.

FIG. 35 shows the results of experiments conducted to determine, when a press roller presses one surface of a sheet, carrying an image on the one surface, to print an image on the other surface in the duplex print mode, a time interval after the printing on the one surface that reduces smearing ascribable to retransferred ink. As shown, smearing ascribable to retransferred ink can be almost obviated if the time interval between the printing on the one surface and the printing on the other surface is 5 seconds or more. In practice, however, the time interval should be 3 seconds or less in order to make the most of the merits of a stencil printer.

Third Embodiment

A third embodiment of the printer in accordance with the present invention will be described hereinafter. Because FIGS. 1 and 3 through 13 and the description made with reference thereto apply to the second embodiment also, the following description will concentrate on differences between the first and third embodiments. Briefly, the illustrative embodiment is configured to protect members, which contact the image surface of a sheet, from smearing ascribable to ink.

Figure 36:
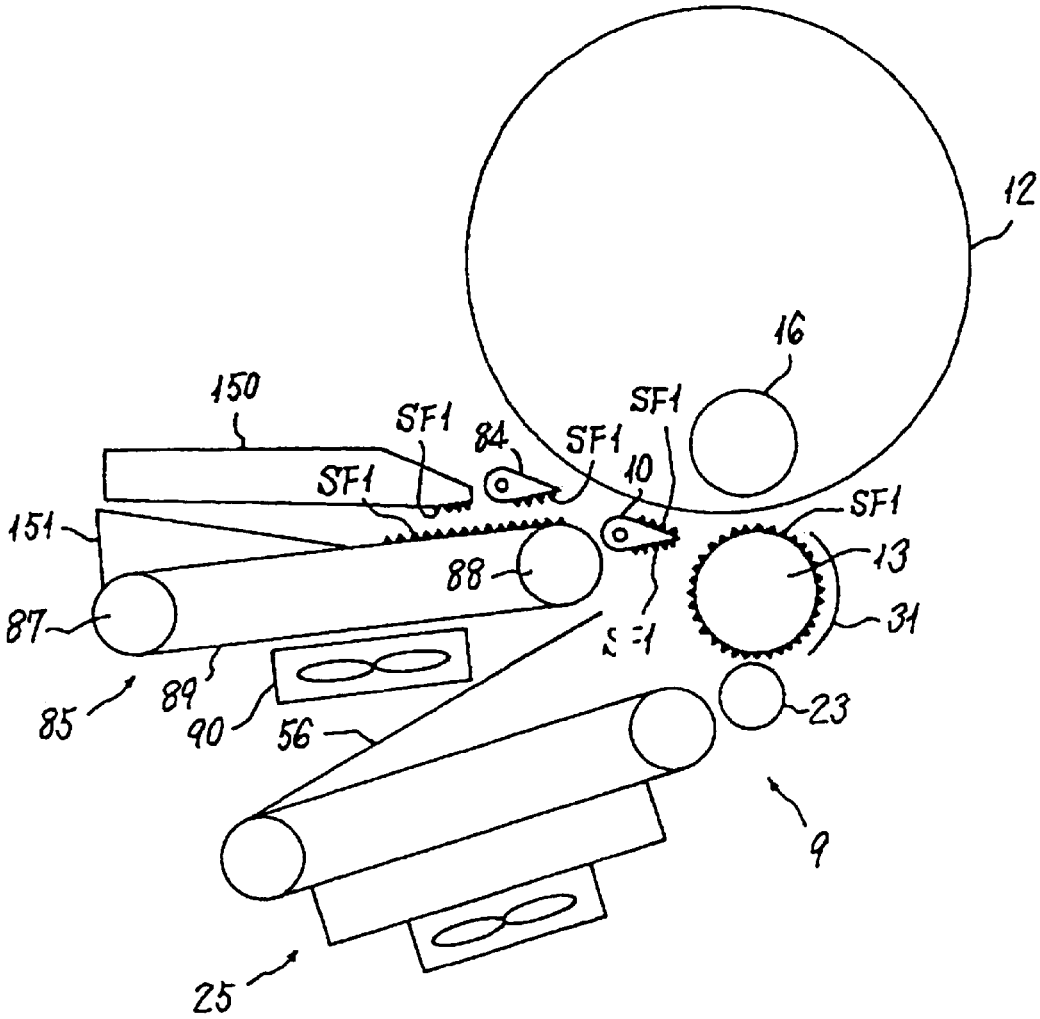
FIG. 36 shows fine projections formed on a conveying member and representative of a third embodiment of the present invention.

FIG. 36 shows the general arrangement of the sheet discharging section 6 and refeeding means 9 included in the illustrative embodiment. An air knife 150, not shown in FIG. 1, is positioned downstream of the peeler 84 in the direction of sheet discharge in order to assist the peeler 84 by sending air with a fan. A pair of jump boards 151 (only one is visible) are included in the sheet discharging section 6 and positioned on the belt 89 for causing a sheet to curl.

In the illustrative embodiment, the press roller 13 is a rotatable member that contacts the first image of the one-sided sheet PA being refed. Fine projections SF1 are formed on the surface of the press roller 13 over the entire circumference of the press roller 13. The path selector 10 is a stationary member that also contacts the first image of the one-sided sheet PA being refed. Fine projections SF1 are formed on the lower surface of the path selector 10. The path selector 10 bifunctions as a stationary member that contacts the first image of the two-sided sheet or duplex print PB being discharged.

The belt 89 is a member movable in contact with the first image of the two-sided sheet PB being discharged; fine projections SF1 are formed over the entire circumference although only part thereof is shown. The peeler 84 is a stationary member that contacts the second image of the two-sided sheet PB being discharged; fine projections SF1 are formed on the lower surface. The air knife 150 is also a stationary member that contacts the second image of the two-sided sheet PB being discharged; fine projections SF1 are formed on the lower surface of the edge portion.

Figure 37:
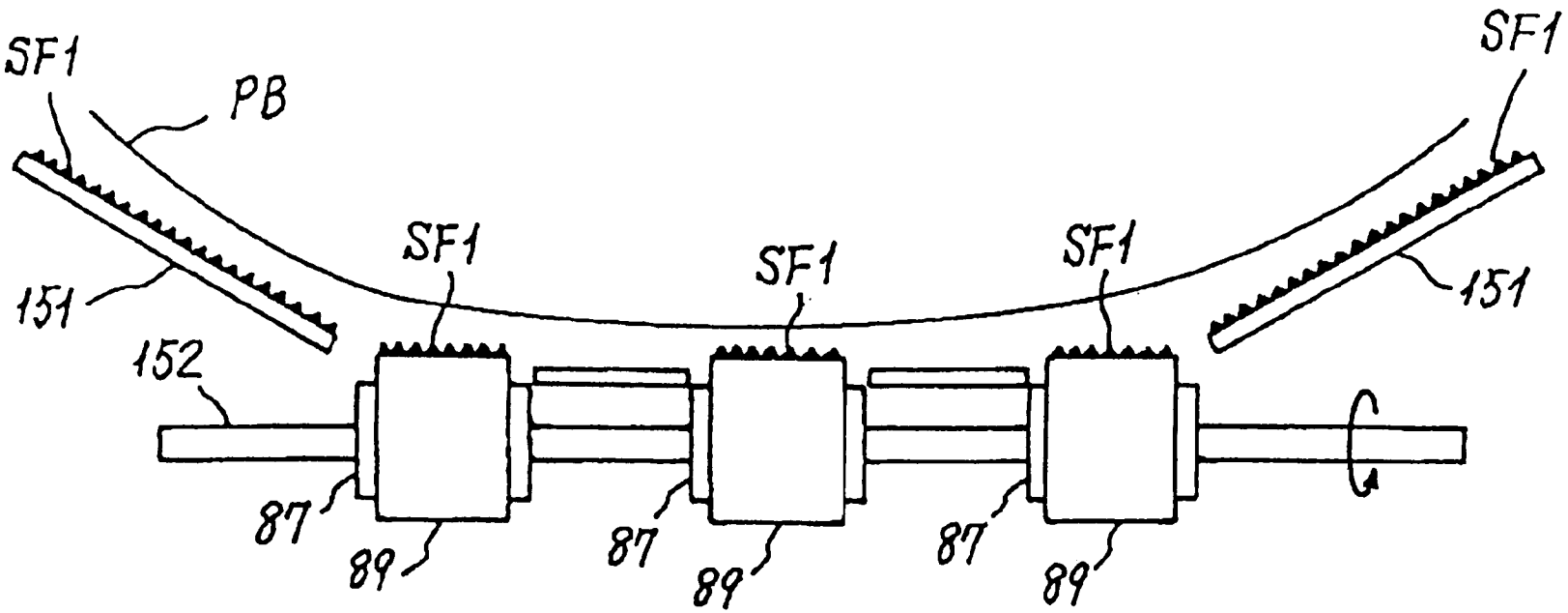
FIG. 37 shows the fine projections formed on an endless belt and jump boards, as seen in a direction of sheet discharge.

As shown in FIG. 37, each jump board 151 is a stationary member that contacts the first image of the two-sided sheet PB being discharged; fine projections SF1 are formed in the inner surface facing the two-sided sheet. FIG. 37 additionally shows a shaft 152 on which the drive roller segments 87 are mounted.

Figure 38:
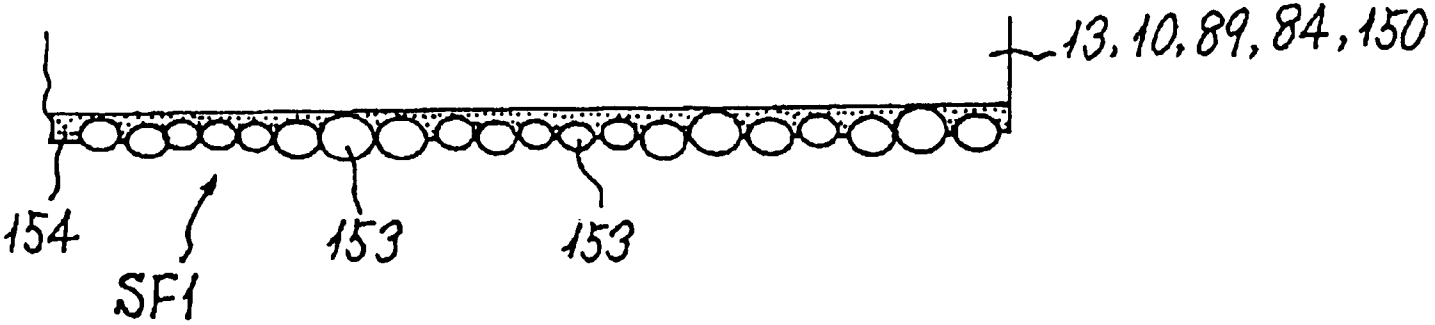
FIG. 38 shows the fine projections implemented by substantially spherical bodies.

As shown in FIG. 38, to form the fine projections SF1, glass beads 153 are adhered or affixed to the surface of, e.g., the press roller 13 by adhesive or binder 154. The glass beads 153 do not have the same diameter. FIG. 39 lists experimental results representative of a relation between the diameter of the beads 153 and image smearing observed by eye.

As FIG. 39 indicates, when the diameter was smaller than 20 μm, the beads 153 formed an almost smooth surface and reduced the effect of the fine projections SF1, i.e., the smear reducing function. On the other hand, when the diameter was larger than 200 μm, the area of ink transferred to the surfaces of the beads 153 increased, rendering the transfer of ink to an image conspicuous. It follows that if the diameter is between 20 m and 200 m, then the area of ink deposited on the beads 153 is so small and is not recognized by eye when transferred to an image. The beads 153 do not have to have the same diameter, but should preferably have different diameters.

FIG. 40 shows experimental results showing a relation between the material of the beads 153 and image smearing and durability. As shown, the beads 153 were formed of glass, ceramics, rubber A, rubber B lower in hardness than rubber A, and resin. Glass and ceramics were comparable in smear reducing effect and were desirable in both of image smearing and durability. Rubber A were insufficient in both of image smearing and durability while rubber B was insufficient in durability although reduced image smearing. This was also true with resin. It follows that glass or ceramics successfully implements the desired effect.

Figure 41:
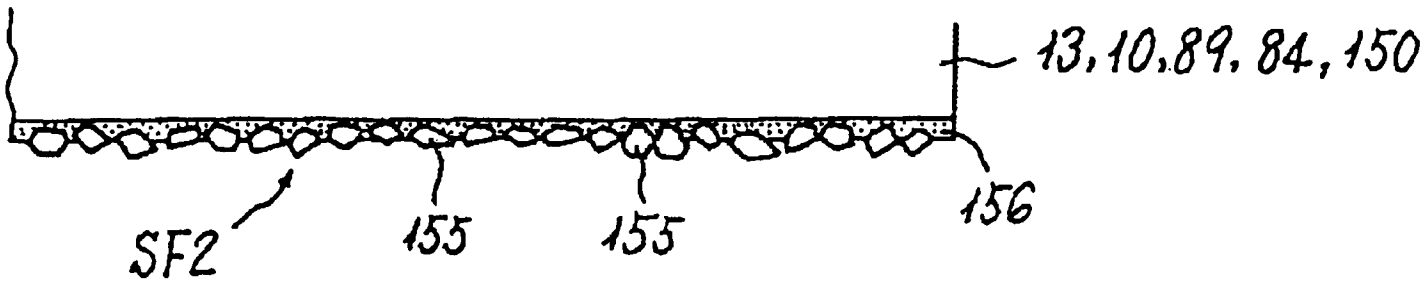
FIG. 41 shows a first modification of the third embodiment.

FIG. 41 shows a first modification of the illustrative embodiment. As shown, fine projections SF2 are formed on, e.g., the press roller 13 and implemented by abrasive grains 155. The abrasive grains 155 are adhered or affixed to, e.g., the press roller 13 by adhesive or binder 156.

FIG. 42 shows experimental results showing a relation between the mean grain size of the abrasive grains 155 and image smearing observed by eye. The mean grain size refers to a mesh size used to sieve the abrasive grains 155; the smaller the number, the smaller the mesh and the size for an abrasive grain unit. As shown, when the mean grain size is smaller than #2,000, the surface becomes smooth and reduces the effect of the fine projections SF2. On the other hand, when the mean grain size is smaller than #250, the area of ink deposited on the abrasive grains 155 increases and conspicuous when transferred to an image while scratching a sheet or a master due to friction between it and the grains 155 or even tearing a thin sheet.

Figure 43:
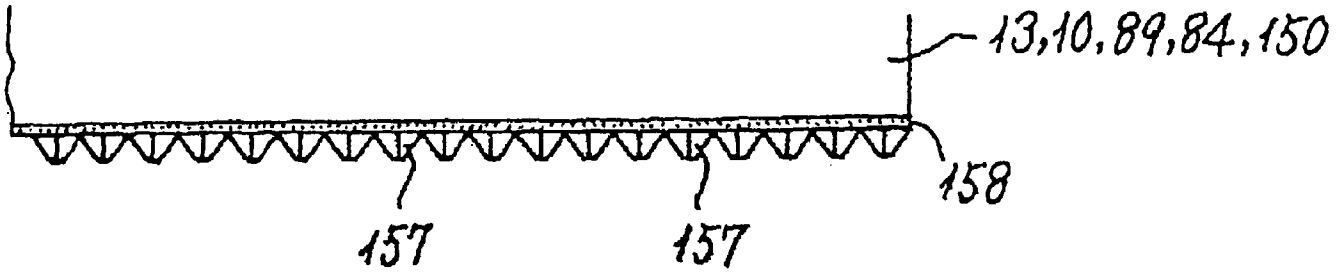
FIG. 43 shows a second modification of the third embodiment.
Figure 44:
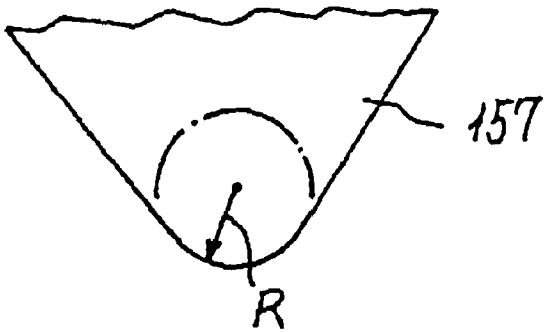
FIG. 44 is an enlarged view showing the peak portion of a projection.

FIGS. 43 and 44 show a second modification of the illustrative embodiment. As shown, fine projections SF3 are implemented by conical or polygonal pyramidal projections 157 adhered or affixed to, e.g., the press roller 13 by adhesive or binder 158. FIG. 45 shows experimental results showing a relation between the mean pitch of the projections 157, the radius of curvature R of the peaks of the projections 157 and image smearing observed by eye.

As FIG. 45 indicates, when the mean pitch is smaller than 20 μm, the distance between nearby projections 157 decreases and makes the surface smooth, thereby reducing the smear reducing effect of the fine projections SF3. When the mean pitch is larger than 300 μm, ink deposits not only on the projections 157 but also on the grooves between the projections 157 and is therefore transferred when pressed. If the radius R of the peak of the individual projection 157 increases, then the degree of transfer of ink to an image also increases. In this sense, the radius of curvature R should preferably be 50 μm or below.

Figure 46:
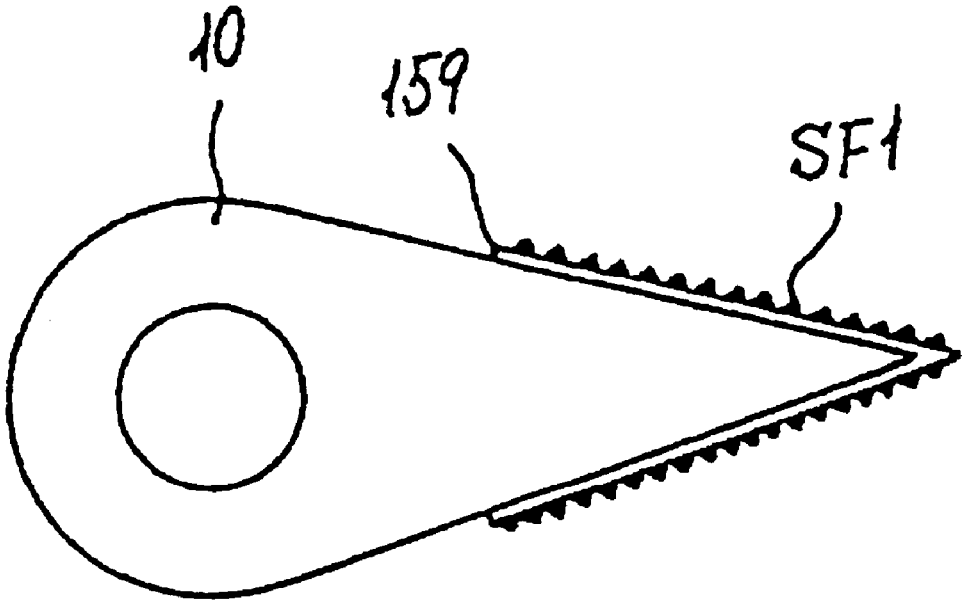
FIG. 46 shows a modification of the fine projections.

FIG. 46 shows a film- or tape-like member 159 adhered affixed or otherwise provided on the surface of, e.g., the path selector 10 in place of the fine projections SF1 through SF3 shown and described. Fine projections SF 1 are formed on the member 159.

Further, fine projections SF4, not shown, may be formed on the member that needs them by shot peening. Fine projections SF5, not shown, may be formed by etching if the member that needs them can be etched, if desired. Alternatively, a film- or tape-like member formed with the projections SF4 or SF5 may be provided on the member.

Figure 47:
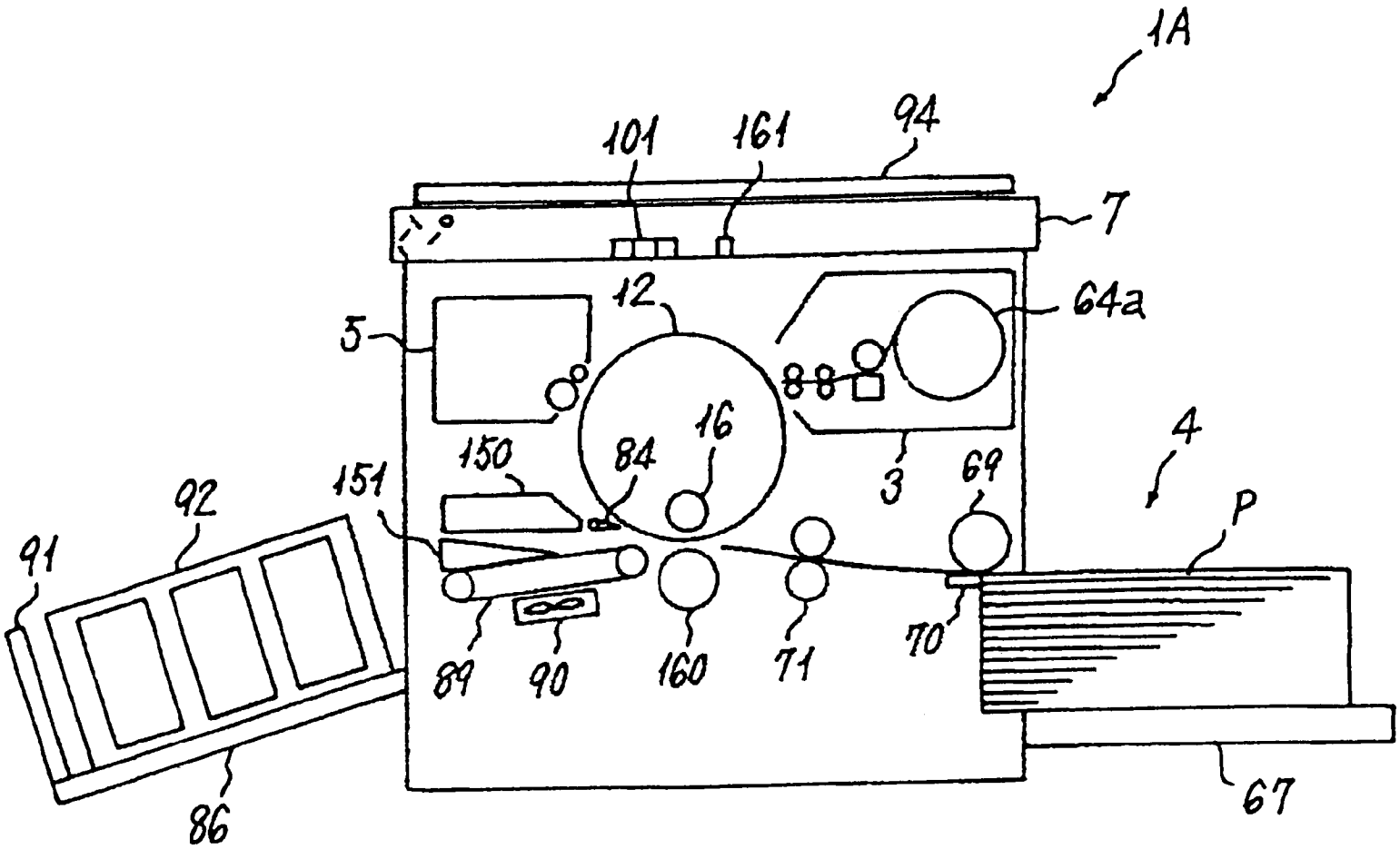
FIG. 47 shows a third modification of the third embodiment.
Figure 48:
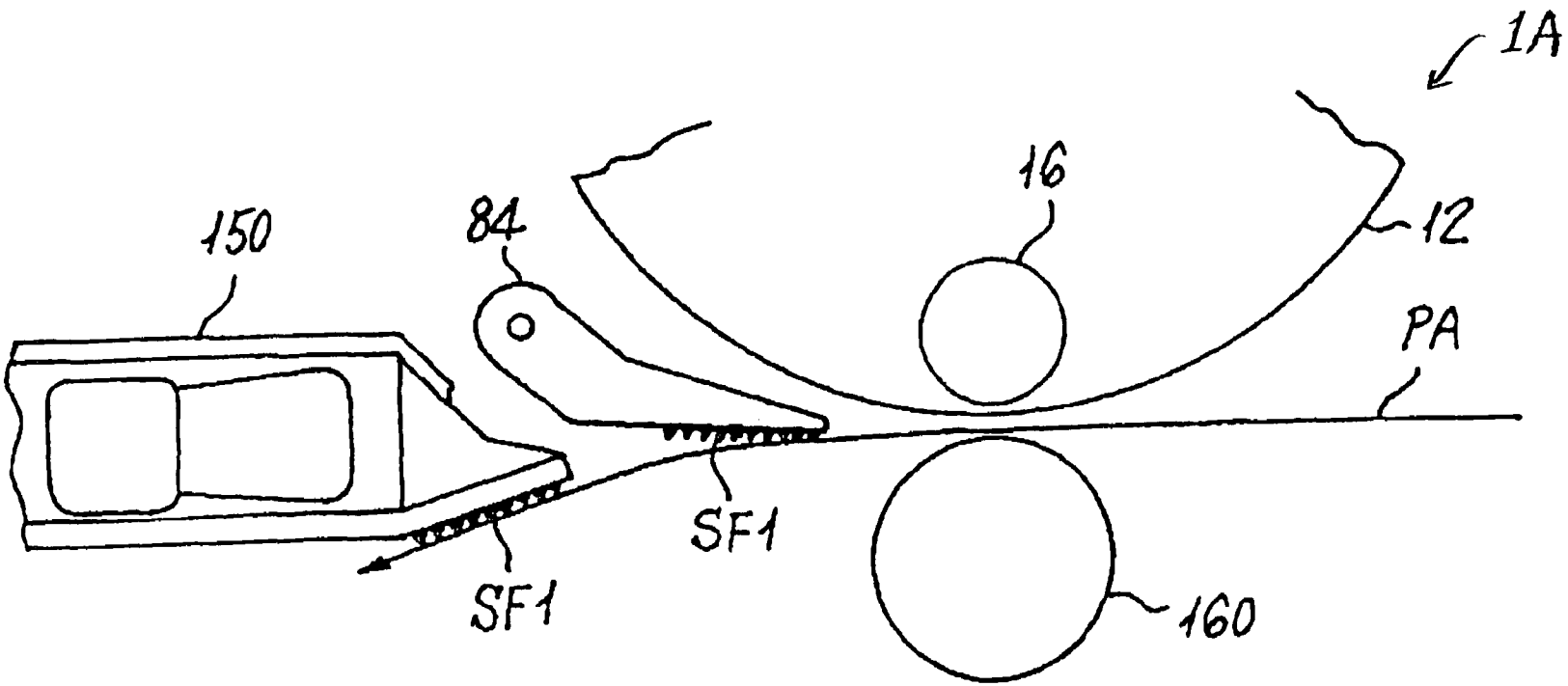
FIG. 48 shows fine projections formed on a conveying member included in the third modification and arranged on a sheet discharge path.

FIGS. 47 and 48 show a third modification of the illustrative embodiment pertaining to a stencil printer 1A operable only in a simple print mode. As shown, the stencil printer 1A includes a document sensor 161 response to a document and a press roller 160 movable into and out of contact with the print drum 12. In this case, the peeler 84 is a stationary member that contacts the image surface of a printed sheet PA being discharged. Any one of the fine projections SF1 through SF5 are formed on the lower surface of the peeler 84. The air knife 150 is another stationary member that contacts the image surface of the printed sheet PA being discharged; any one of the fine projections SF1 through SF5 are formed on the lower surface. The experimental results shown in FIGS. 39, 40, 42 and 45 similarly apply to this modification as well as to the other modifications to follow.

Figure 49:
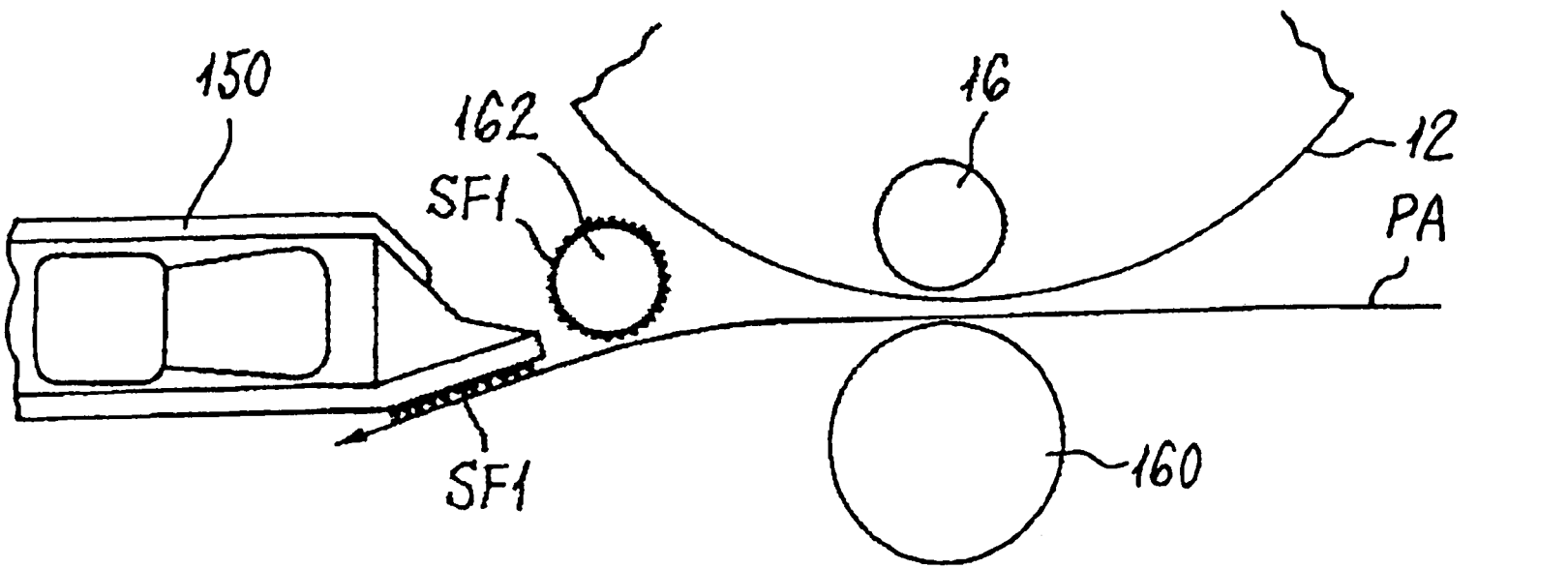
FIG. 49 shows a fourth modification of the third embodiment.

FIG. 49 shows a fourth modification of the illustrative embodiment. As shown, a discharge roller 162 is substituted for the peeler 84 as a member that contacts the image surface of the printed sheet PA being discharged. Any one of fine projections FA1 through FA5 are formed on the circumference of the discharge roller 162.

Figure 50:
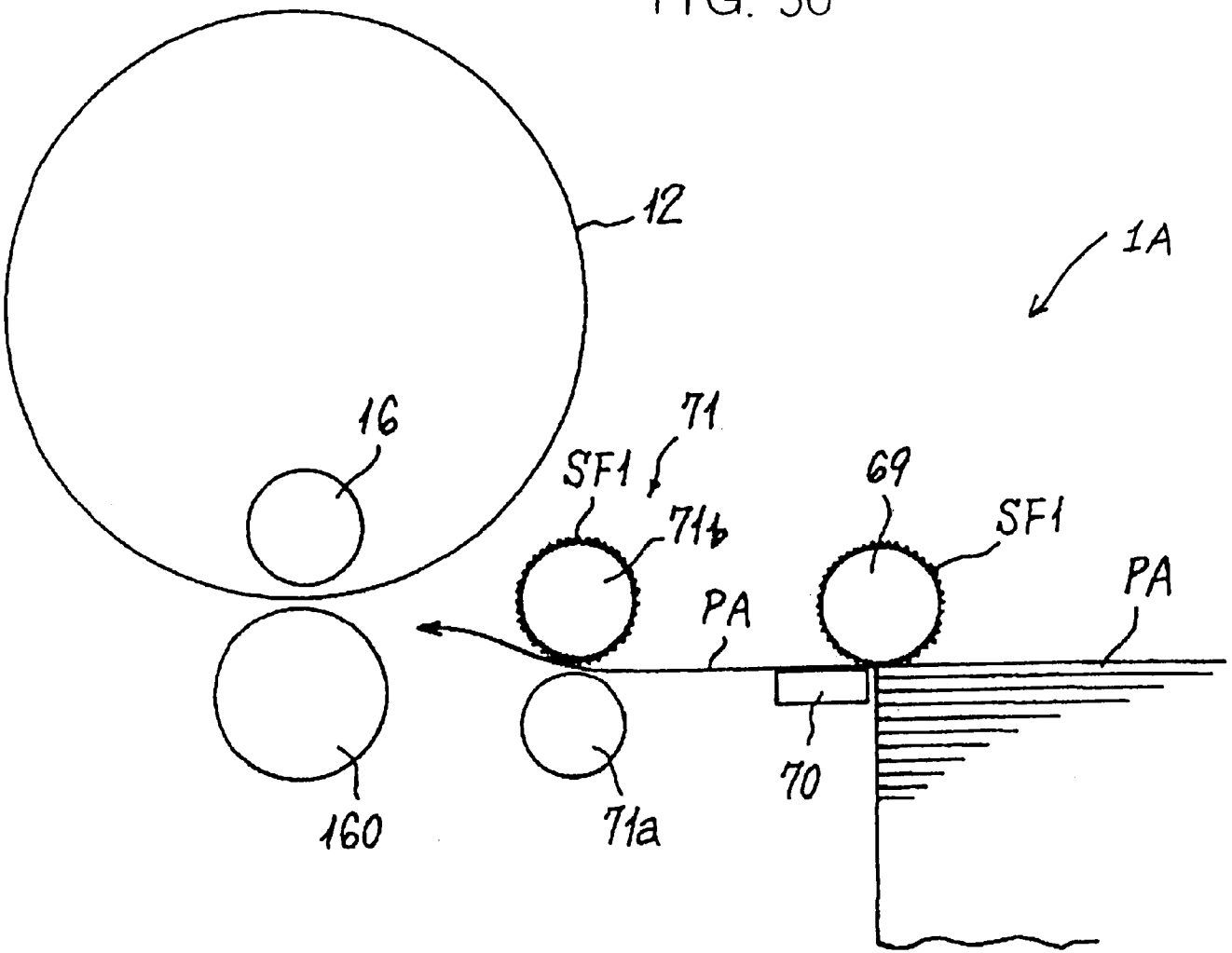
FIG. 50 shows a fifth modification of the third embodiment.

FIG. 50 shows a fifth modification of the illustrative embodiment. As shown, when the printer 1A is to print a second image on the surface of the sheet PA over a first image present on the sheet PA in a multicolor mode, the sheet PA once discharged is again set on the sheet tray 67 and then refed. In this case, the reverse roller 69, bifunctioning as a pickup roller, is a rotatable member that contacts the first image of the sheet PA to be refed. Any one of fine projections SF1 through SF5 are formed on the circumference of the reverse roller 69. The drive roller 71*b* of the registration roller pair 71 is another rotatable member that contacts the first image of the sheet PA being refed; any one of fine projections SF1 through SF5 are formed on the circumference.

Figure 51:
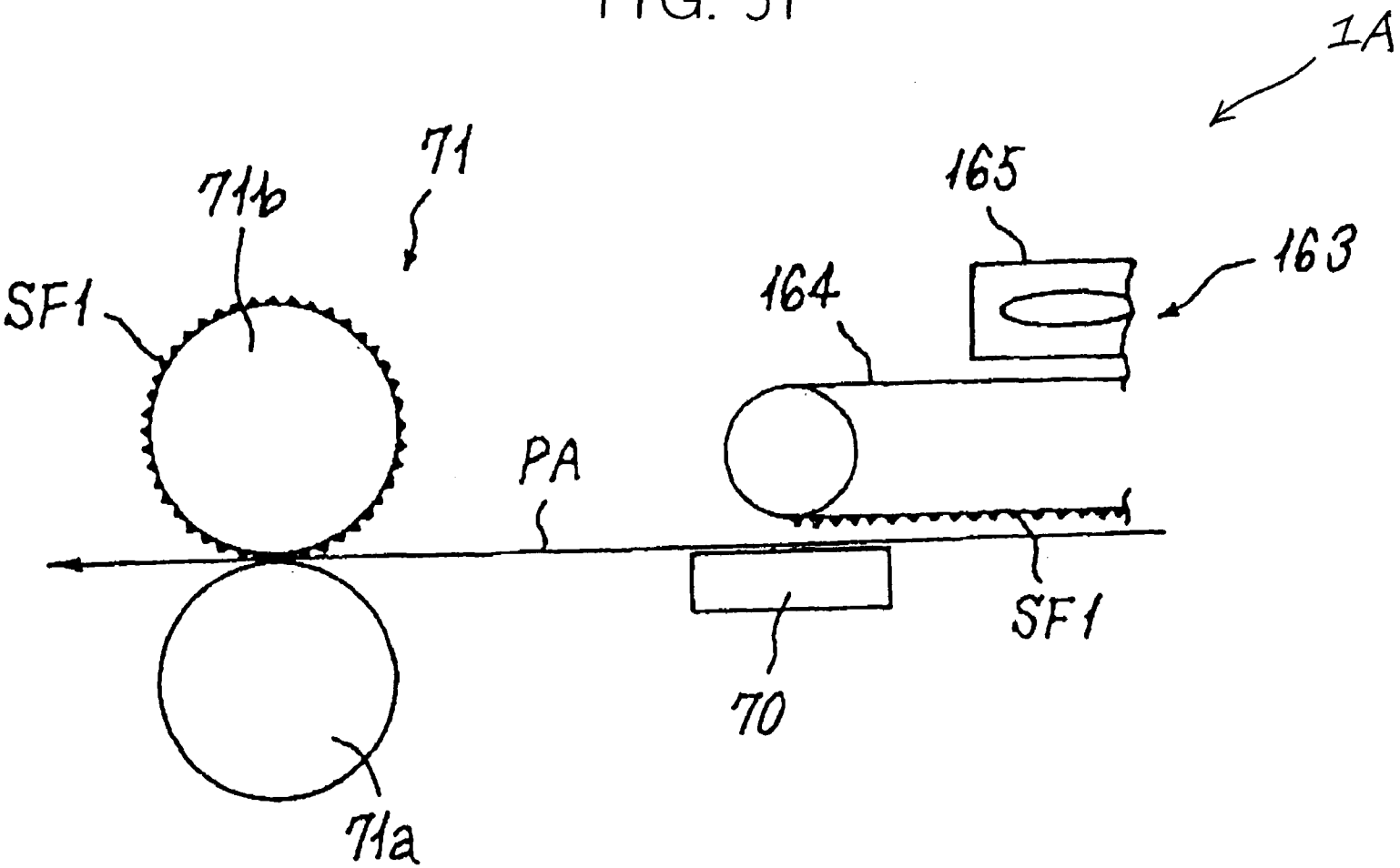
FIG. 51 shows a sixth modification of the third embodiment.

FIG. 51 shows a sixth modification of the illustrative embodiment in which a suction unit 163, using air, is used to feed sheets in place of the pickup roller. As shown, the suction unit 163 includes an endless belt 164 and a suction fan 165. The endless belt 164 is a member movable in contact with the first image of the sheet PA being refed; any one of the fine projections SF1 through SF5 are formed on the outer surface.

Figure 52:
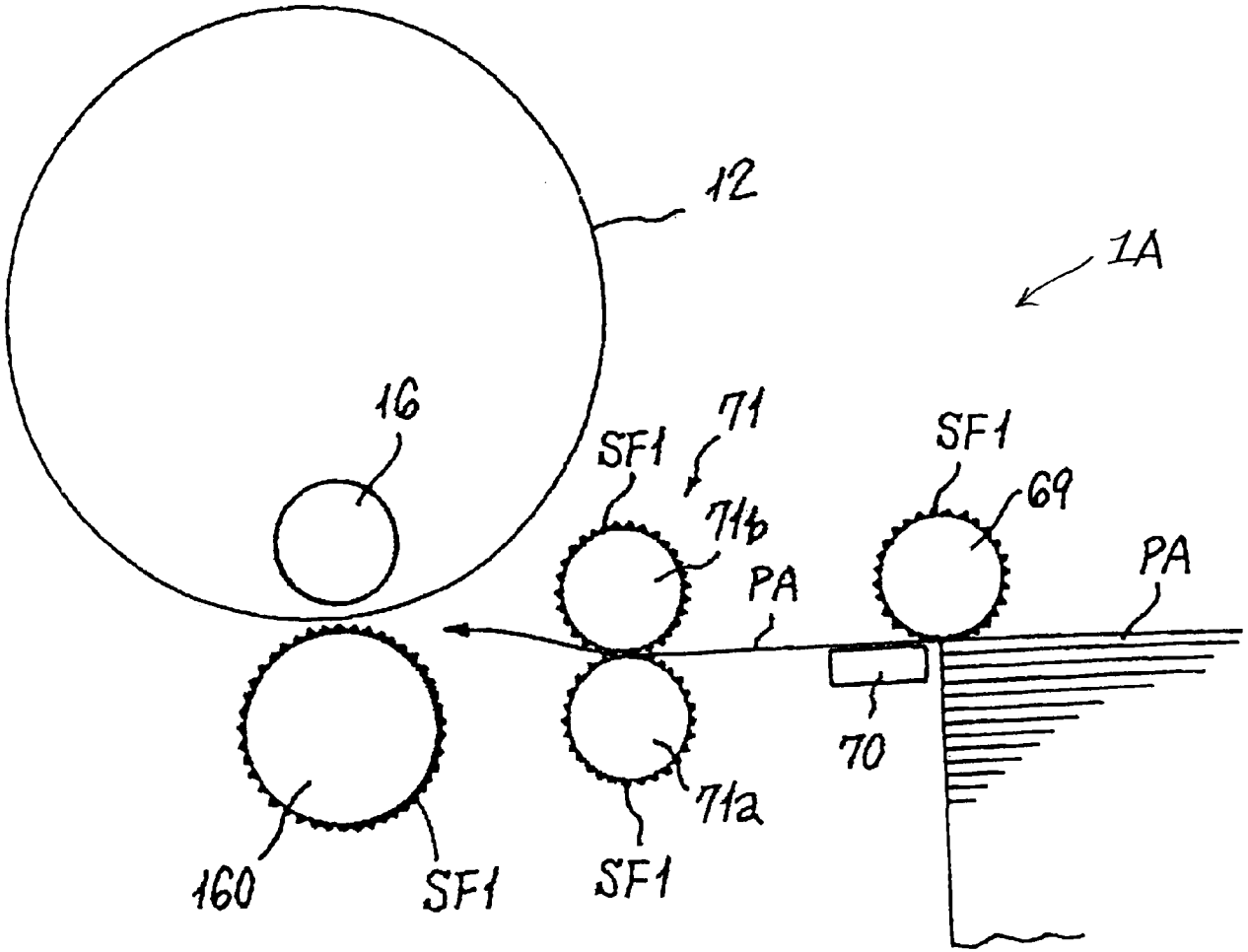
FIG. 52 shows a seventh modification of the third embodiment.

FIG. 52 shows a seventh modification of the illustrative embodiment implemented as a stencil printer 1A selectively operable in a simplex, multicolor print mode or a duplex print mode. In the duplex print mode, the sheet PA, carrying an image on one side thereof, is set on the sheet tray 67 face down. The drive roller 71*a* of the registration roller pair 71 is a rotatable member that contacts the first image surface of the sheet PA being refed; any one of the fine projections SF1 through SF5 are formed on the circumference. The press roller 160 is another rotatable member that contacts the first image surface of the sheet PA being refed; any one of the fine projections SF1 are formed on the circumference.

Figure 53:
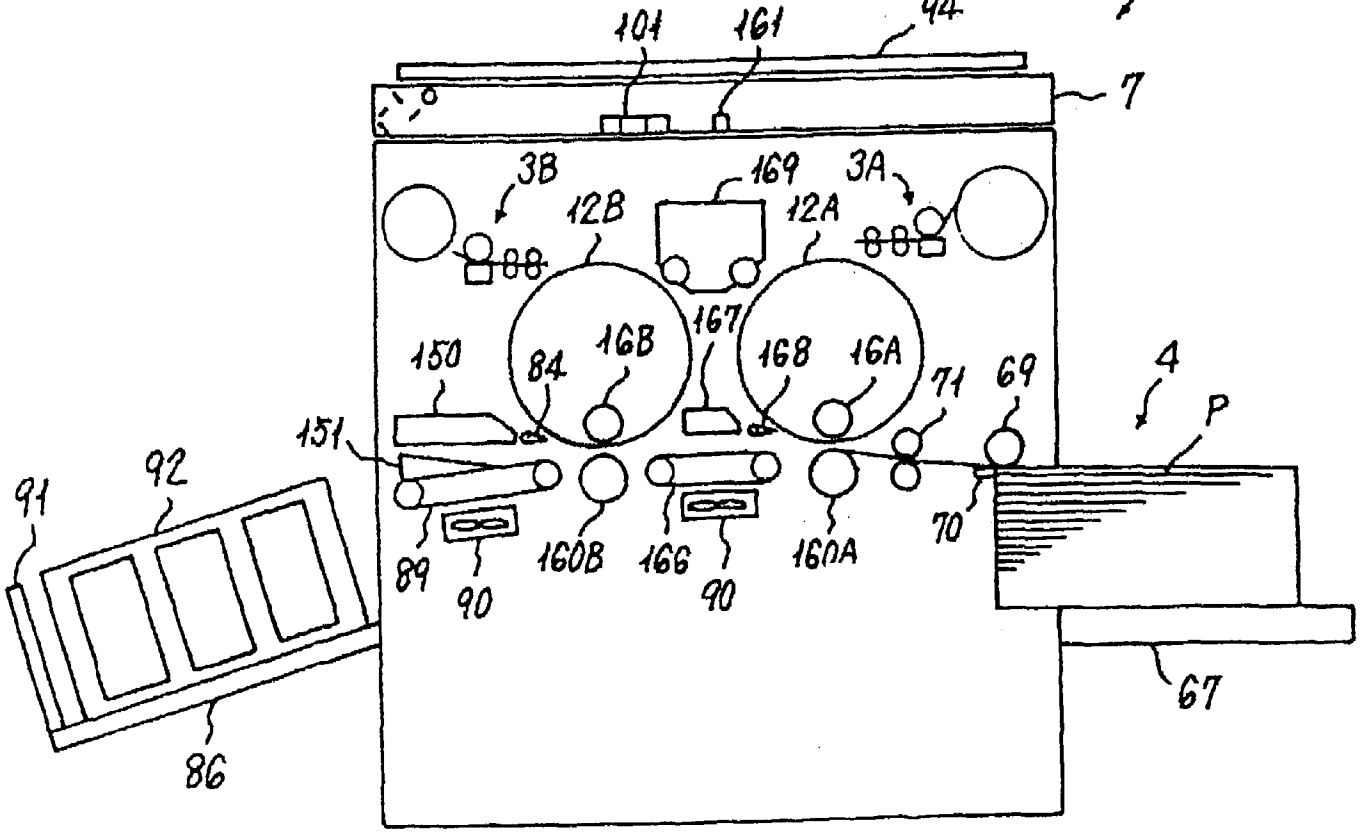
FIG. 53 shows an eighth modification of the third embodiment.

FIG. 53 shows an eighth modification of the illustrative embodiment implemented as a stencil printer 1B. As shown, the stencil printer 1B includes two print drums 12A and 12B positioned side by side in the direction of sheet conveyance and can print a two-color image on a sheet by passing the sheet only one time. An endless belt 166 is positioned between the drums 12A and 12B for conveying the sheet while sucking it. There are also shown in FIG. 53 an air knife 167, a peeler 168, and a master discharging section 169 shared by the print drums 12A and 12B.

In the eighth modification, the peeler 168 and air knife 167 each are a stationary member that contacts the first image of the sheet PA being discharged; any one of the fine projections SF1 through SF5 are formed on the lower surface. Also, the peeler 84 and air knife 150 assigned to the downstream print drum 12B each are a stationary member that contacts the first and second images of the sheet PA being discharged; any one of the fine projections SF1 through SF5 are formed on the lower surface. In a duplex, two-color print mode available with the eighth modification, any one of the fine projections SF1 through SF5 are similarly formed on members that contact the first image surface of the sheet PA being refed.

Figure 54:
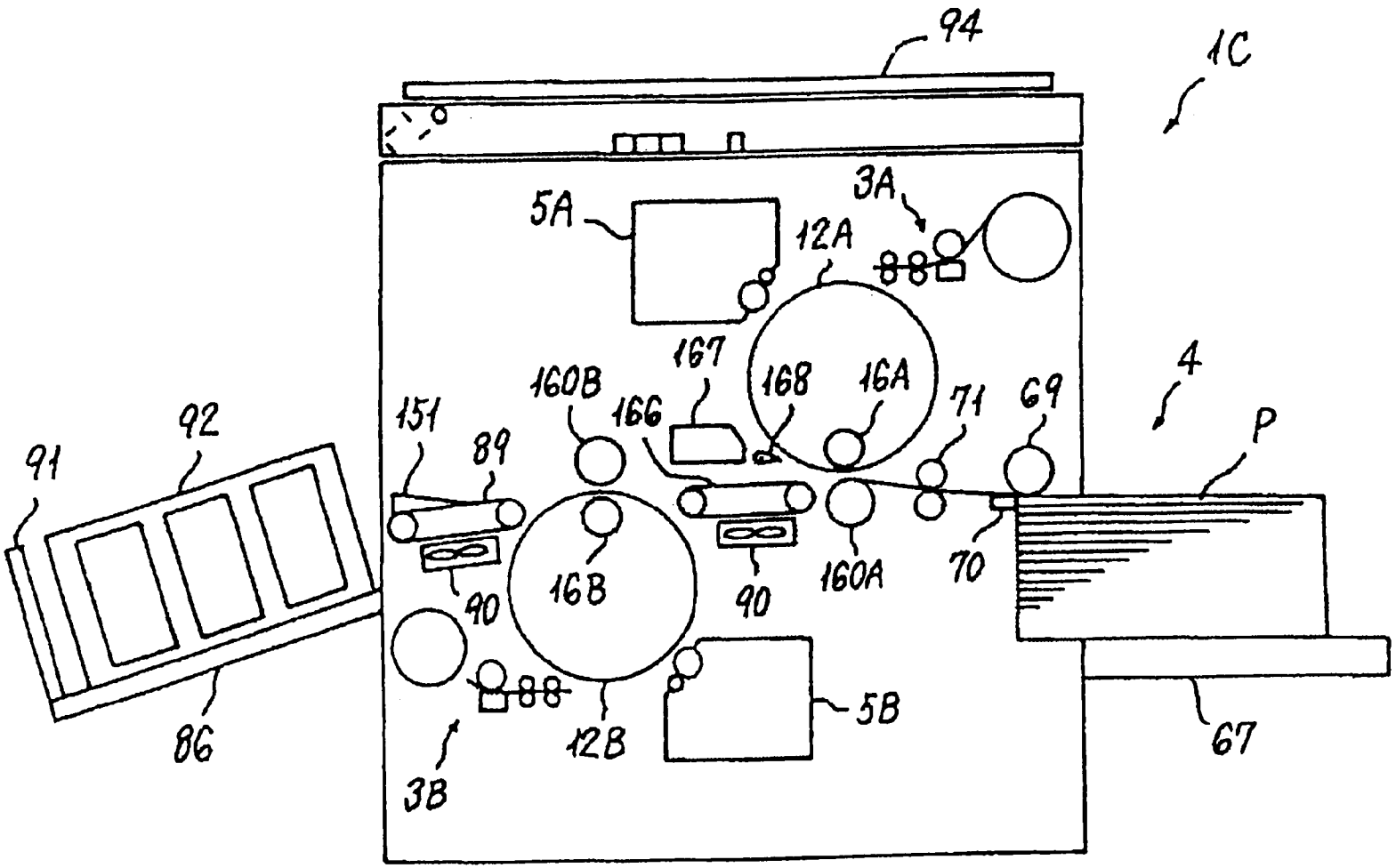
FIG. 54 shows a ninth modification of the third embodiment.
Figure 55:
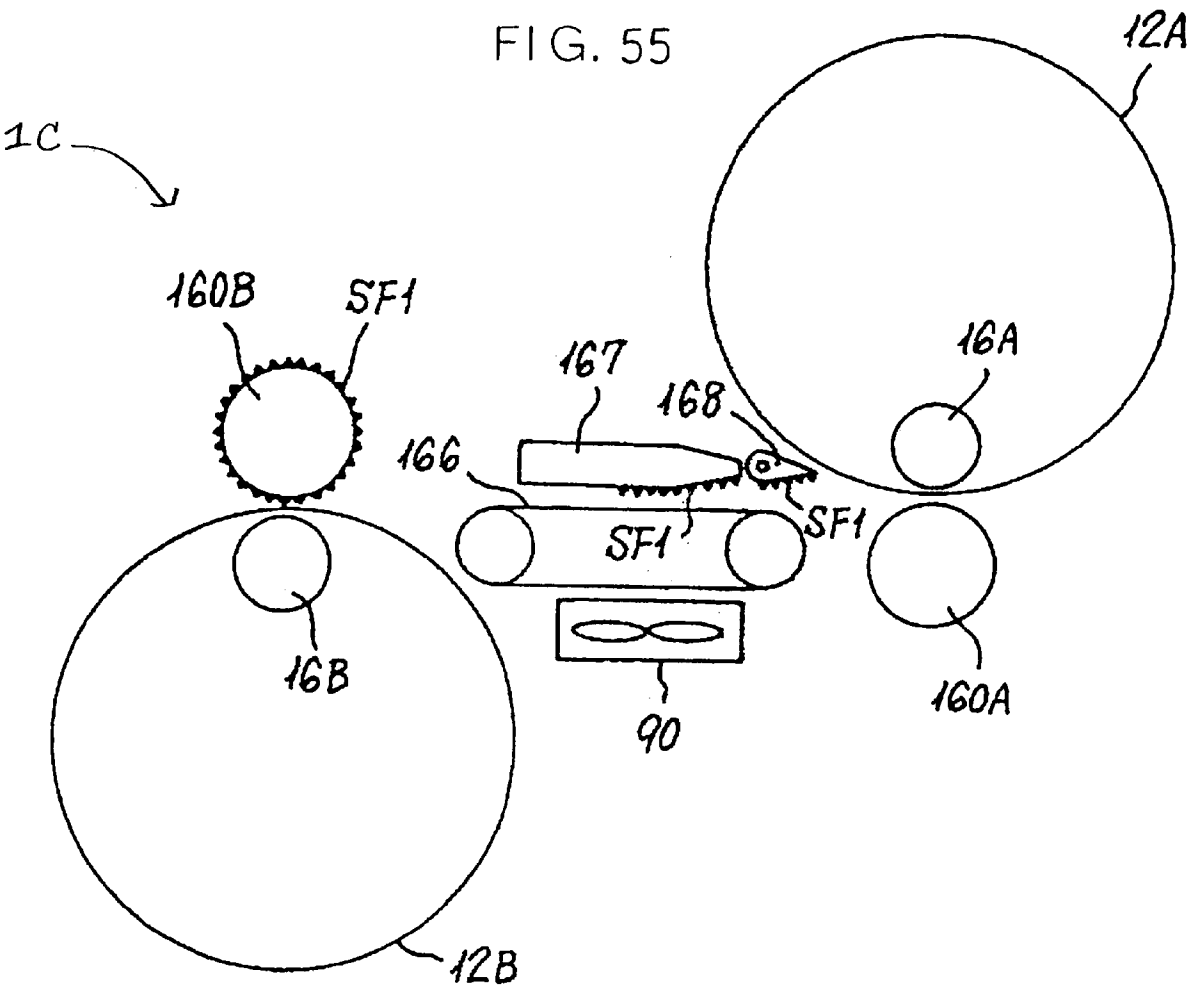
FIG. 55 shows fine projections formed on a conveying member included in the ninth modification and arranged on a sheet feed path.

FIGS. 54 and 55 show a ninth modification of the illustrative embodiment. As shown, the ninth embodiment is implemented as a stencil printer capable of producing a duplex print by passing a sheet only one time. More specifically, the portion of FIG. 23 assigned to the formation of the second image is so arranged as to form an image on the reverse side of a sheet.

In the ninth modification, the peeler 168 and air knife 167 between the print drums 12A and 12B each are a stationary member that contacts the first image surface of the sheet PA being discharged; any one of the fine projections SF1 through SF5 are formed on the lower surface. A press roller 160B, assigned to the downstream print drum 12B, is a rotatable member that contacts the first image surface of the sheet PA fed toward the print drum 12B; any one of the fine projections SF1 through SF5 are formed on the circumference.

As stated above, in the illustrative embodiment and modifications thereof, at least two or preferably all members that contact the image surface of a sheet being discharged or being fed each are formed with the fine projections in order to reduce smearing ascribable to ink.

Various modifications will become possible for those skilled in the art after receiving the teachings of the present disclosure without departing from the scope thereof.

What is claimed is:

1. A printer operable in a duplex print mode for printing an image on one side of a sheet-like recording medium and then printing an image on the other side of said sheet-like recording medium, said printer comprising:

at least one print drum;

at least one press roller facing said print drum for pressing the recording medium against said print drum; and a roller pressed against said press roller by a preselected pressure for removing ink deposited on the surface of said press roller by causing said ink to be transferred to said roller, wherein said roller comprises an elastic roller having an adhesive surface while said elastic roller comprises rubber and is caused to rotate by said press roller, and wherein said press roller comprises, when configured to press the other side of the recording medium against said print drum, an elastic body having a fluorine compound layer on a surface thereof, said fluorine compound layer including a film tube closely fitted on the surface of said elastic body.

2. The printer as claimed in claim 1, wherein said elastic body comprises rubber.

3. The printer as claimed in claim 1, wherein said elastic body comprises rubber while said fluorine compound layer is formed by coating.

4. The printer as claimed in claim 1, further comprising cleaning means for removing ink deposited on a surface of said press roller.

5. The printer as claimed in claim 4, wherein said cleaning means is located between a position for transferring an image to the recording medium and a position for refeeding the recording medium, which carries the image on one side thereof, in a direction of rotation of said press roller.

6. The printer as claimed in claim 4, wherein said cleaning means comprises:

a roller pressed against said press roller by preselected pressure for wiping off ink deposited on said press roller; and drive means for causing said roller to rotate at a peripheral speed different from a peripheral speed of said press roller.

7. The printer as claimed in claim 6, wherein at least a surface of said roller is porous.

8. The printer as claimed in claim 4, wherein said cleaning means comprises:

coating means for coating a small amount of liquid on the surface of said press roller; and a blade contacting the surface of said press roller.

9. The printer as claimed in claim 1, wherein said roller is formed of either one of rubber and metal and has a smooth surface, said printer further comprising a blade configured to scrape off the ink deposited on said smooth surface.

10. In a printer operable in a duplex print mode by forming in a master a first and a second image, which are to be respectively transferred to one side and the other side of a sheet-like recording medium, side by side in a circumferential direction of a print drum, wrapping said master around said print drum, pressing said sheet-like recording medium against said print drum with a press roller to thereby print said first image on said one side, and then pressing said sheet-like recording medium against said print drum with said press roller to thereby print said second image on said other side, said press roller comprises an elastic body having a fluorine compound layer on a surface thereof, said fluorine compound layer including a film tube closely fitted on the surface of said elastic body and further comprising a roller pressed against said press roller by a preselected pressure for removing ink deposited on the surface of said press roller by causing said ink to be transferred to said roller, wherein said roller comprises an elastic roller having an adhesive surface while said elastic roller comprises rubber and is caused to rotate by said press roller.

11. The printer as claimed in claim 10, wherein said elastic body comprises rubber.

12. The printer as claimed in claim 10, wherein said elastic body comprises rubber while said fluorine compound layer is formed by coating.

13. The printer as claimed in claim 10, further comprising cleaning means for removing ink deposited on a surface of said press roller.

14. The printer as claimed in claim 13, wherein said cleaning means is located between a position for transferring an image to the recording medium and a position for refeeding the recording medium, which carries the image on one side thereof, in a direction of rotation of said press roller.

15. The printer as claimed in claim 13, wherein said cleaning means comprises:

a roller pressed against said press roller by preselected pressure for wiping off ink deposited on said press roller; and drive means for causing said roller to rotate at a peripheral speed different from a peripheral speed of said press roller.

16. The printer as claimed in claim 15, wherein at least a surface of said roller is porous.

17. The printer as claimed in claim 13, wherein said cleaning means comprises:

coating means for coating a small amount of liquid on the surface of said press roller; and a blade contacting the surface of said press roller.

18. The printer as claimed in claim 10, wherein said roller is formed of either one of rubber and metal and has a smooth surface, said printer further comprising a blade configured to scrape off the ink deposited on said smooth surface.

19. A printer operable in a duplex print mode for printing an image on one side of a sheet-like recording medium and then printing an image on the other side of said sheet-like recording medium, said printer comprising:

at least one print drum; and at least one press roller facing said print drum for pressing the sheet-like pressing member against said print drum;

wherein said press roller comprises, when configured to press the other side of the sheet-like recording medium against said print drum, an elastic body on which a film, formed with fine projections by surface treatment, is coated or adhered, and wherein said elastic body comprises rubber while said film comprises at least one of fine glass grains and fine ceramic grains.

20. The printer as claimed in claim 19, wherein said fine glass grains and said fine ceramic grains both are spherical.

21. The printer as claimed in claim 19, wherein said fine glass grains and said fine ceramic grains both are not spherical.

22. The printer as claimed in claim 19, further comprising cleaning means for removing ink deposited on a surface of said press roller.

23. The printer as claimed in claim 22, wherein said cleaning means is located between a position for transferring an image to the recording medium and a position for refeeding the recording medium, which carries the image on one side thereof, in a direction of rotation of said press roller.

24. The printer as claimed in claim 22, wherein said cleaning means comprises:

a roller pressed against said press roller by preselected pressure for wiping off ink deposited on said press roller; and drive means for causing said roller to rotate at a peripheral speed different from a peripheral speed of said press roller.

25. The printer as claimed in claim 24, wherein at least a surface of said roller is porous.

26. The printer as claimed in claim 22, wherein said cleaning means comprises:

coating means for coating a small amount of liquid on the surface of said press roller; and a blade contacting the surface of said press roller.

27. The printer as claimed in claim 19, further comprising a roller pressed against said press roller by preselected pressure for removing ink deposited on the surface of said press roller by causing said ink to be transferred to said roller.

28. The printer as claimed in claim 27, wherein said roller comprises an elastic roller having an adhesive surface while said elastic roller comprises rubber and is caused to rotate by said press roller.

29. The printer as claimed in claim 19, wherein said roller is formed of either one of rubber and metal and has a smooth surface, said printer further comprising a blade configured to scrape off the ink deposited on said smooth surface.

30. In a printer operable in a duplex print mode by forming in a master a first and a second image, which are to be respectively transferred to one side and the other side of a sheet-like recording medium, side by side in a circumferential direction of a print drum, wrapping said master around said print drum, pressing said sheet-like recording medium against said print drum with a press roller to thereby print said first image on said one side, and then pressing said sheet-like recording medium against said print drum with said press roller to thereby print said second image on said other side, said press roller comprises an elastic body on which a film, formed with fine projections by surface treatment, is coated or adhered, wherein said elastic body comprises rubber while said film comprises at least one of fine glass grains and fine ceramic grains.

31. The printer as claimed in claim 30, wherein said fine glass grains and said fine ceramic grains both are spherical.

32. The printer as claimed in claim 30, wherein said fine glass grains and said fine ceramic grains both are not spherical.

33. The printer as claimed in claim 30, further comprising cleaning means for removing ink deposited on a surface of said press roller.

34. The printer as claimed in claim 33, wherein said cleaning means is located between a position for transferring an image to the recording medium and a position for refeeding the recording medium, carrying the image on one side thereof, in a direction of rotation of said press roller.

35. The printer as claimed in claim 33, wherein said cleaning means comprises:

a roller pressed against said press roller by preselected pressure for wiping off ink deposited on said press roller; and drive means for causing said roller to rotate at a peripheral speed different from a, peripheral speed of said press roller.

36. The printer as claimed in claim 35, wherein at least a surface of said roller is porous.

37. The printer as claimed in claim 33, wherein said cleaning means comprises:

coating means for coating a small amount of liquid on the surface of said press roller; and a blade contacting the surface of said press roller.

38. The printer as claimed in claim 30, further comprising a roller pressed against said press roller by preselected pressure for removing ink deposited on the surface of said press roller by causing said ink to be transferred to said roller.

39. The printer as claimed in claim 38, wherein said roller comprises an elastic roller having an adhesive surface while said elastic roller comprises rubber and is caused to rotate by said press roller.

40. The printer as claimed in claim 38, wherein said roller is formed of either one of rubber and metal and has a smooth surface, said printer further comprising a blade configured to scrape off the ink deposited on said smooth surface.

41. A printer operable in a duplex print mode for printing an image on one side of a sheet-like recording medium and then printing an image on the other side of said sheet-like recording medium, said printer comprising:

at least one print drum; and at least one press roller facing said print drum for pressing the sheet-like recording medium against said print drum;

wherein said press roller comprises, when configured to press the other side of the sheet-like recording medium against said print drum, an elastic body having a surface formed with fine projections, and wherein said elastic body comprises rubber while said projections are formed by at least one of fine glass grains and fine ceramic grains.

42. The printer as claimed in claim 41, wherein said fine glass grains and said fine ceramic grains both are spherical.

43. The printer as claimed in claim 41, wherein said fine glass grains and said fine ceramic grains both are not spherical.

44. The printer as claimed in claim 41, further comprising cleaning means for removing ink deposited on a surface of said press roller.

45. The printer as claimed in claim 44, wherein said cleaning means is located between a position for transferring an image to the recording medium and a position for refeeding the recording medium, which carries the image on one side thereof, in a direction of rotation of said press roller.

46. The printer as claimed in claim 44, wherein said cleaning means comprises:

a roller pressed against said press roller by preselected pressure for wiping off ink deposited on said press roller; and drive means for causing said roller to rotate at a peripheral speed different from a peripheral speed of said press roller.

47. The printer as claimed in claim 44, wherein at least a surface of said roller is porous.

48. The printer as claimed in claim 44, wherein said cleaning means comprises:

coating means for coating a small amount of liquid on the surface of said press roller; and a blade contacting the surface of said press roller.

49. The printer as claimed in claim 41, further comprising a roller pressed against said press roller by preselected pressure for removing ink deposited on the surface of said press roller by causing said ink to be transferred to said roller.

50. The printer as claimed in claim 49, wherein said roller comprises an elastic roller having an adhesive surface while said elastic roller comprises rubber and is caused to rotate by said press roller.

51. The printer as claimed in claim 49, wherein said roller is formed of either one of rubber and metal and has a smooth surface, said printer further comprising a blade configured to scrape off the ink deposited on said smooth surface.

52. A printer operable in a duplex print mode for printing an image on one side of a sheet-like recording medium and then printing, within 3 seconds, an image on the other side of said sheet-like recording medium, said printer comprising:

at least one print drum; and at least one press roller facing said print drum for pressing the sheet-like recording medium against said print drum, wherein said press roller comprises, when configured to press the other side of the sheet-like recording medium against said print drum, a surface formed with a number of projections, each having a peak provided with a radius of 0.04 mm or below, at a mean pitch of 0.4 mm or below, and wherein said projections are formed on an elongate sheet member having a preselected width and spirally wrapped around the surface of said press roller.

53. The printer as claimed in claim 52, wherein said projections are formed of synthetic resin and provided with a conical or polygonal pyramidal shape whose peak angle is 100° or below each.

54. The printer as claimed in claim 52, further comprising cleaning means for removing ink deposited on the surface of said press roller.

55. The printer as claimed in claim 54, wherein said cleaning means comprises a porous cleaning roller caused to rotate at a lower peripheral speed than said press roller during printing.

56. The printer as claimed in claim 55, wherein said cleaning roller is pressed against said pressure roller by a biasing force of 3N or below.

57. In a printer operable in a duplex print mode by forming in a master a first and a second image, which are to be respectively transferred to one side and the other side of a sheet-like recording medium, side by side in a circumferential direction of a print drum, wrapping said master around said print drum, pressing said sheet-like recording medium against said print drum with a press roller to thereby print said first image on said one side, and then pressing, within 3 seconds, said sheet-like recording medium against said print drum with said press roller to thereby print said second image on said other side, said press roller comprises a surface formed with a number of projections, each having a peak provided with a radius of 0.04 mm or below, at a mean pitch of 0.4 or below, and wherein said projections are formed on an elongate sheet member having a preselected width and spirally wrapped around the surface of said press roller.

58. The printer as claimed in claim 57, wherein said projections are formed of synthetic resin and provided with a conical or polygonal pyramidal shape whose peak angle is 100° or below each.

59. The printer as claimed in claim 57, further comprising cleaning means for removing ink deposited on the surface of said press roller.

60. The printer as claimed in claim 59, wherein said cleaning means comprises a porous cleaning roller caused to rotate at a lower peripheral speed than said press roller during printing.

61. The printer as claimed in claim 60, wherein said cleaning roller is pressed against said pressure roller by a biasing force of 3N or below.

62. A printer operable in a duplex print mode for printing an image on one side of a sheet-like recording medium and then printing, within 3 seconds, an image on the other side of said sheet-like recording medium, said printer comprising:

at least one print drum; and at least one press roller facing said print drum for pressing the sheet-like recording medium against said print drum;

wherein said press roller comprises, when configured to press the other side of the sheet-like recording medium against said print drum, a surface including a stepped portion formed by a number of spherical bodies, each having a radius of 0.1 mm or below, arranged with a maximum difference in height of 0.03 mm or above and a mean pitch of 0.15 mm or above between nearby highest peaks.

63. The printer as claimed in claim 62, wherein said projections are formed of synthetic resin and provided with a conical or polygonal pyramidal shape whose peak angle is 100° or below each.

64. The printer as claimed in claim 63, wherein said projections are formed on an elongate sheet member having a preselected width and spirally wrapped around the surface of said press roller.

65. The printer as claimed in claim 62, further comprising cleaning means for removing ink deposited on the surface of said press roller.

66. The printer as claimed in claim 65, wherein said cleaning means comprises a porous cleaning roller caused to rotate at a lower peripheral speed than said press roller during printing.

67. The printer as claimed in claim 66, wherein said cleaning roller is pressed against said pressure roller by a biasing force of 3N or below.

68. In a printer operable in a duplex print mode by forming in a master a first and a second image, which are to be respectively transferred to one side and the other side of a sheet-like recording medium, side by side in a circumferential direction of a print drum, wrapping said master around said print drum, pressing said sheet-like recording medium against said print drum with a press roller to thereby print said first image on said one side, and then pressing, within 3 seconds, said sheet-like pressing member against said print drum with said press roller to thereby print said second image on said other side, said press roller comprises a surface including a stepped portion formed by a number of spherical bodies, each having a radius of 0.1 mm or below, arranged with a maximum difference in height of 0.03 mm or above and a mean pitch of 0.15 mm or above between nearby highest peaks.

69. The printer as claimed in claim 68, wherein said projections are formed of synthetic resin and provided with a conical or polygonal pyramidal shape whose peak angle is 100° or below each.

70. The printer as claimed in claim 69, wherein said projections are formed on an elongate sheet member having a preselected width and spirally wrapped around the surface of said press roller.

71. The printer as claimed in claim 68, further comprising cleaning means for removing ink deposited on the surface of said press roller.

72. The printer as claimed in claim 71, wherein said cleaning means comprises a porous cleaning roller caused to rotate at a lower peripheral speed than said press roller during printing.

73. The printer as claimed in claim 72, wherein said cleaning roller is pressed against said pressure roller by a biasing force of 3N or below.

* * * * *

UNITED STATES PATENT AND TRADEMARK OFFICE

CERTIFICATE OF CORRECTION

PATENT NO. : 7,284,479 B2
APPLICATION NO. : 10/626604
DATED : October 23, 2007
INVENTOR(S) : Mitsuo Sato It is certified that error appears in the above-identified patent and that said Letters Patent is hereby corrected as shown below:

On title page, item (54), after "IN" insert --A--.

Column 6, line 13, change "damper" to --clamper--.

Signed and Sealed this

Twenty-second Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,284,479 B2
APPLICATION NO. : 10/626604
DATED : October 23, 2007
INVENTOR(S) : Mitsuo Sato It is certified that error appears in the above-identified patent and that said Letters Patent is hereby corrected as shown below:

On title page, item (54) and Column 1, line 1, after "IN" insert --A--.

Column 6, line 13, change "damper" to --clamper--.

This certificate supersedes the Certificate of Correction issued July 22, 2008.

Signed and Sealed this

Twelfth Day of August, 2008

JON W. DUDAS
*Director of the United States Patent and Trademark Office*